US007419774B2

(12) United States Patent
Inoue

(10) Patent No.: US 7,419,774 B2
(45) Date of Patent: Sep. 2, 2008

(54) PHOTOTHERMOGRAPHIC MATERIAL AND METHOD FOR PROCESSING THE SAME

(75) Inventor: Rikio Inoue, Kanagawa (JP)

(73) Assignee: FUJILFILM Corporation, Tokyo (JP)

( * ) Notice: Subject to any disclaimer, the term of this patent is extended or adjusted under 35 U.S.C. 154(b) by 522 days.

(21) Appl. No.: 10/326,420

(22) Filed: Dec. 23, 2002

(65) Prior Publication Data

US 2003/0170573 A1 Sep. 11, 2003

(30) Foreign Application Priority Data

Dec. 27, 2001 (JP) ..... 2001-397684

(51) Int. Cl.
*G03C 5/16* (2006.01)
*G03C 1/498* (2006.01)
*G03C 1/76* (2006.01)

(52) U.S. Cl. ..... 430/351; 430/513; 430/517; 430/581; 430/584; 430/619; 430/640; 430/642

(58) Field of Classification Search ..... 430/619, 430/640, 642, 513, 517, 351, 581, 584, 523
See application file for complete search history.

(56) References Cited

U.S. PATENT DOCUMENTS

| | | | | |
|---|---|---|---|---|
| 4,830,948 | A * | 5/1989 | Ishikawa et al. | 430/372 |
| 6,300,053 | B1 * | 10/2001 | Fujiwara et al. | 430/619 |
| 6,576,413 | B2 * | 6/2003 | Uytterhoeven et al. | 430/619 |

FOREIGN PATENT DOCUMENTS

| | | |
|---|---|---|
| JP | 7-261336 | 10/1995 |
| JP | 9-265148 | 10/1997 |
| JP | 10-307365 | 11/1998 |
| JP | A-11-352626 | 12/1999 |
| JP | 2000-112104 | 4/2000 |
| JP | 2001-100363 | 4/2001 |

* cited by examiner

*Primary Examiner*—Thorl Chea
(74) *Attorney, Agent, or Firm*—Margaret A. Burke; Sheldon J. Moss

(57) ABSTRACT

Disclosed is a photothermographic material comprising a support having disposed on a surface thereof, a non-photosensitive silver source, a photosensitive silver halide, and a reducing agent, and having disposed another surface thereof at least one non-photosensitive layer, wherein at least one of the non-photosensitive layers contains at least one type of gelatin having an isoelectric point of from 5.0 to 9.5; and a method for processing the photothermographic material.

19 Claims, No Drawings

PHOTOTHERMOGRAPHIC MATERIAL AND METHOD FOR PROCESSING THE SAME

BACKGROUND OF THE INVENTION

1. Field of the Invention

The present invention relates to a photothermographic material (this may be hereinafter referred to as "photographic material"), in particular to that favorable for medical diagnosis, industrial analysis, industrial photography, printing or COM.

2. Description of the Related Art

Reduction of the amount of waste after development and fixing of films for medical diagnostics and photographic printing has been strongly demanded in recent years in view of environmental preservation and for saving work space. Accordingly, technologies related to photothermographic materials are urgently required for providing films for medical diagnosis and photographic printing, by which efficient exposure is possible using a laser image setter or laser imager to form clear monochromatic images with high resolution and sharpness. No liquid chemicals are needed for development and fixing when the photothermographic materials is used, making it possible to supply to customers a photothermographic systems that is more simple and friendly to the environment.

The same applies to the field of general purpose image forming materials, which, however, differ from those in the field of medical diagnosis. Specifically, photo-images for medical diagnosis must clarify the details of body parts and therefore must have sharp and good image quality with fine graininess.

To photosensitive materials, dye is generally added and it serves as a filter dye or acts for antihalation or anti-irradiation. In general, the dye added to photosensitive materials functions while the photographic materials are exposed to have an image thereon, and it is completely removed while the materials are developed. After developed, therefore, the images formed on the photosensitive materials should not be stained with the dye that is not removed but has still remained therein after development. If having still remained in the processed photographic materials, the dye absorbs some visible light to thereby stain the images formed on the processed photosensitive materials.

In conventional wet development, it is relatively easy to remove the dye from the processed photosensitive materials into the processing solutions. However, in dry development such as heat development, the dye is difficult to remove. To overcome the problem, a method of decolaring the dye by heat during heat development has been proposed. For example, JP-A No. 11-352626 discloses a technique of decolaring the dye in processed photothermographic materials, which comprises controlling the melting point of a base precursor in the materials and decolaring the dye in the processed materials by the action of the base formed during the step of heat-developing the materials.

However, this technique does not satisfy some customers' demand for more rapid heat development of photothermographic materials. The drawback of the technique is that dye erasure in developed photothermographic materials is unsatisfactory and some dye still remains in the processed materials.

In the technique proposed, if an excess amount of a base precursor is in the photothermographic materials in order to improve the dye erasure in the processed materials, it causes another problem in that water drops given to the images of the processed materials leave their traces thereon, or that is, the water resistance of the processed materials worsens.

SUMMARY OF THE INVENTION

The present invention is provided to solve the problems in the prior art noted above and to attain the objects mentioned below. Specifically, one object of the invention is to provide a photothermographic material in which the dye added for improving the image sharpness of the processed material is readily decolored by heat development of the material.

Another object of the invention is to provide a photothermographic material of good water resistance, which, when having received water drops on its surface that contains an image sharpness-improving dye and has an image formed after heat development, well repels the traces of such water drops.

To attain the objects as above, the photothermographic material that the invention provides is as follows:

A first embodiment of the photothermographic material of the invention is a photothermographic material comprising a support having disposed on a surface thereof, a non-photosensitive silver source, a photosensitive silver halide, and a reducing agent, and having disposed on another surface thereof at least one non-photosensitive layer, wherein at least one of the non-photosensitive layers contains at least one type of gelatin having an isoelectric point of from 5.0 to 9.5.

A second embodiment of the photothermographic material of the invention is subsidiary to the first embodiment thereof, further comprising on the another surface of the support, at least one type of dye that is decolored by heat development.

A third embodiment of the photothermographic material of the invention is subsidiary to the first embodiment thereof, further comprising a base precursor on the another surface of the support.

A forth embodiment of the photothermographic material of the invention is subsidiary to the first embodiment thereof, further comprising on the other surface of the support, a dye that is decolored by heat development and a base precursor.

A fifth embodiment of the photothermographic material of the invention is subsidiary to the first embodiment thereof, wherein the gelatin comprises an acid-processed gelatin.

A sixth embodiment of the photothermographic material of the invention is subsidiary to the first embodiment thereof, wherein the jelly strength of the gelatin is from 200 g to 350 g.

A seventh embodiment of the photothermographic material of the invention is subsidiary to the first embodiment thereof, wherein the viscosity of the gelatin is from 20 mP to 120 mP.

A eighth embodiment of the photothermographic material of the invention is subsidiary to the first embodiment thereof, wherein the transmittance of the gelatin is at least 50%.

A ninth embodiment of the photothermographic material of the invention is subsidiary to the first embodiment thereof, wherein the electroconductivity of the gelatin is less than or equal to 800 μs/cm.

A tenth embodiment of the photothermographic material of the invention is subsidiary to the first embodiment thereof, wherein a pH of the gelatin is from 4.0 to 7.0.

A eleventh embodiment of the photothermographic material of the invention is subsidiary to the first embodiment thereof, wherein the amount of gelatin is from 0.1 $g/m^2$ to 2.0 $g/m^2$, and wherein at least one of the non-photosensitive layers contains at least one of a dye that is decolored by heat development and a base precursor.

A twelfth embodiment of the photothermographic material of the invention subsidiary to the second embodiment thereof, wherein the dye is a cyanine dye represented by the following general formula (1) or a salt thereof:

General Formula (1)

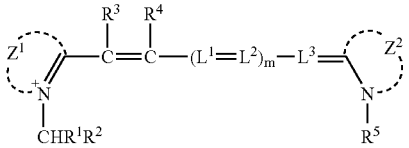

wherein $R^1$ represents an electron-attracting group; $R^2$ represents a hydrogen atom, an aliphatic group or an aromatic group; $R^3$ and $R^4$ each independently represent a hydrogen atom, a halogen atom, an aliphatic group, an aromatic group, —$NR^6R^7$, —$OR^6$ or —$SR^7$; $R^6$ and $R^7$ each independently represent a hydrogen atom, an aliphatic group or an aromatic group; $R^5$ represents an aliphatic group; $L^1$, $L^2$ and $L^3$ each independently represent an optionally-substituted methine group, and the substituents, if any, of the methine group may bond to each other to form an unsaturated aliphatic ring or an unsaturated heterocycle; $Z^1$ and $Z^2$ each independently represent an atomic group to form a 5-membered or 6-membered, nitrogen-containing heterocycle, the nitrogen-containing heterocycle may be condensed with an aromatic ring, and the nitrogen-containing heterocycle and its condensed ring may be substituted; m indicates 0, 1, 2 or 3.

A thirteenth embodiment of the photothermographic material of the invention is subsidiary to the twelfth embodiment thereof, wherein the cyanine dye of general formula (1) is represented by the following general formula (1a):

General Formula (1a)

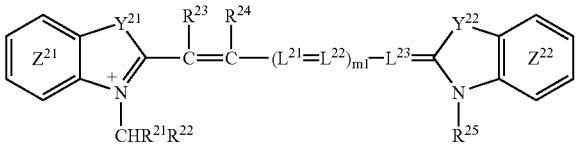

wherein $R^{21}$, $R^{22}$, $R^{23}$, $R^{24}$, $R^{25}$, $L^{21}$, $L^{22}$, $L^{23}$ and $m_1$ have the same meanings as those of $R^1$, $R^2$, $R^3$, $R^4$, $R^5$, $L^1$, $L^2$, $L^3$ and m in general formula (1); $Y^{21}$ and $Y^{22}$ each independently represent —$CR^{26}R^{27}$—, —$NR^{26}$—, —O—, —S— or —Se—; $R^{26}$ and $R^{27}$ each independently represent a hydrogen atom or an aliphatic group, and they may bond to each other to form a ring; the benzene rings $Z^{21}$ and $Z^{22}$ may be condensed with any other benzene ring.

A fourteenth embodiment of the photothermographic material of the invention is subsidiary to the second embodiment, thereof wherein the amount of the dye is from 0.001 to 1 g/$m^2$.

A fifteenth embodiment of the photothermographic material of the invention is subsidiary to the third embodiment thereof, wherein the base precursor is a decarboxylating base precursor.

A sixteenth embodiment of the photothermographic material of the invention is subsidiary to the third embodiment thereof, wherein the base precursor is a diacidic base precursor of an amidine derivative or a guanidine derivative.

A seventeenth embodiment of the photothermographic material of the invention is subsidiary to the fourth embodiment, thereof wherein the amount of the base precursor is from 1 to 100 times by mol of the dye.

A eighteenth embodiment of the photothermographic material of the invention is subsidiary to the first embodiment thereof, further comprising on the another surface of the support, a substance that decreases the melting point of the base precursor by 3 to 30° C. when mixed with the base precursor.

A nineteenth embodiment of the photothermographic material of the invention is subsidiary to the eighteenth embodiment thereof, wherein the substance that decreases the melting point of the base precursor is at least one selected from those represented by the following general formulae (M1) to (M3):

General Formula (M1)

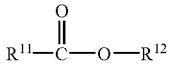

wherein $R^{11}$ and $R^{12}$ each independently represent an aliphatic group, an aromatic group or a heterocyclic group; but when $R^{12}$ is an aliphatic group, $R^{11}$ is an aromatic group or a heterocyclic group;

$R^{21}X—R^{22}$ General Formula (M2)

wherein $R^{21}$ and $R^{22}$ each independently represent an aromatic group or a heterocyclic group; and X represents a linking group except a sulfonyl group and a carboxyl group;

General Formula (M3)

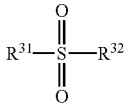

wherein $R^{31}$ and $R^{32}$ each independently represent an aromatic group or a heterocyclic group; but the compound of formula (M3) does not have a substituent of a carboxyl group or a salt of a carboxyl group.

The invention also provides a method for processing a photothermographic material comprising the steps of:

(a) providing a photothermographic material comprising a support having disposed on a surface thereof, a non-photosensitive silver source, a photosensitive silver halide, and a reducing agent, and having disposed another surface thereof at least one non-photosensitive layer, wherein at least one of the non-photosensitive layers contains at least one type of gelatin having an isoelectric point of from 5.0 to 9.5; and (b) heat-developing the photothermographic material at a temperature of from 80° C. to 250° C. for a period of time of from 1 second to 60 seconds.

DESCRIPTION OF THE PREFERRED EMBODIMENTS

The present invention is described in detail hereinunder.

The photothermographic material of the invention is a photothermographic material comprising a support having disposed on a surface thereof, a non-photosensitive silver source, a photosensitive silver halide, and a reducing agent, and having disposed on another surface thereof at least one non-photosensitive layer, wherein at least one of the non-photosensitive layers contains at least one type of gelatin having an isoelectric point of from 5.0 to 9.5 (this is hereinafter referred to as "specific gelatin").

The specific gelatin for use in the invention is described.

The preferred range of the isoelectric point of the specific gelatin for use herein is determined basically depending on the necessary properties of the photothermographic material. If the isoelectric point of the specific gelatin is too high, however, the coating liquid that contains the specific gelatin may coagulate. To evade the problem of liquid coagulation, some chemical additive will have to be added to the coating liquid. If so, the latitude in controlling the pH of the coating liquid will be narrowed. Taking this into consideration, the isoelectric point of the specific gelatin for use in the invention is from 5.0 to 9.5, and preferably from 5.5 to 8.5, more preferably from 5.5 to 8.0.

The isoelectric point of the specific gelatin may be measured, for example, according to a method of isoelectric electrophoresis (see Maxey, C. R.; 1976, *Photogr. Gelatin* 2, Editor Cox, P. J., Academic, London, Engl.) or a test method for photographic gelatin (PAGI method), 7th Ed. (by the Joint Council for Photographic Gelatin Test Method, published in October 1992). Concretely, a 1% gelatin solution is passed through a mixed crystal column of cation and anion exchange resins, and then its pH is measured.

The specific gelatin includes, for example, lime-processed gelatin, acid-processed gelatin, and other gelatins of which the functional group has been chemically modified to control the isoelectric point thereof.

One preferred specific gelatin for use in the invention is acid-processed gelatin. This is because the isoelectric point of acid-processed gelatin is generally higher than that of lime-processed gelatin.

One general method for obtaining acid-processed gelatin comprises dipping pigskin, bone or gelatin in a diluted acid solution of, for example, hydrochloric acid, sulfuric acid, sulfurous acid or phosphorus acid or their mixture. A concrete method of gelatin production is described in Veis, A., *The Macromolecular Chemistry of Gelatin* (Academic Press, 1964).

Preferred examples of acid-processed gelatin for use in the invention are 950 Gelatin (by Nitta Gelatin Inc), PS Gelatin and ABA Gelatin (both by Nippi Inc).

Apart from the acid-processed gelatin mentioned above, also preferred for use in the invention are esterified gelatins (e.g., methyl-esterified gelatin) and amidated gelatins (e.g., ethyl-amidated gelatin) in which the carboxylic group is reduced to increase the isoelectric point of the gelatins.

For gelatin esterification, for example, referred to are the hydrochloric acid-methanol method described in H. Fraenkel-Conrat, H. S., Olcott, J., *Biol. Chem.,* 161, 259 (1945); the thionyl chloride-methanol method described in J. Bello, *Biochem. Biophys. Acta.,* 20, 456 (1956); the sulfuric acid-methanol method described in A. W. Kenchington, *Biochem., J.,* 68, 458 (1958); and the hydrochloric acid-methanol method described in E. Kein, E. Moioar, E. Roche, *J. Photogr. Sci.,* 19, 55 (1971). For gelatin amidation, for example, referred to is gelatin amidated with water-soluble carbodiimide as in D. G. Hoare, D. E. Koshland Jr., *J. Am. Chem. Soc.,* 88, 2057 (1966).

Regarding the physical properties of the specific gelatin for use in the invention, it is indispensable that the isoelectric point thereof falls within the range defined as above, and other preferred properties of the specific gelatin for use herein are mentioned below.

The jelly strength (defined by the PAGI method) of the specific gelatin is preferably from 200 g to 350 g, more preferably from 250 g to 350 g. Concretely, the jelly strength of gelatin may be measured with a Bloom-type jelly strength meter or a texture analyzer, for example, according to the test method for photographic gelatin (PAGI method), 7th Ed. (by the Joint Council for Photographic Gelatin Test Method, published in October 1992).

Also preferably, the viscosity (defined by the PAGI method) of the specific gelatin is from 20 mP to 120 mP, more preferably from 35 mP to 90 mP.

The transmittance (defined by the PAGI method) of the specific gelatin is preferably at least 50%, more preferably at least 80%.

The electroconductivity (defined by the PAGI method) of the specific gelatin is preferably less than or equal to 800 ps/cm, more preferably less than or equal to 400 μs/cm, most preferably less than or equal to 200 μs/cm.

The pH value (defined by the PAGI method) of the specific gelatin is preferably from 4.0 to 7.0, more preferably from 5.0 to 6.5.

The non-photosensitive layer that contains the specific gelatin is on the side of the support opposite to that thereof coated with the photosensitive layer (or that is, on the back of the support, and preferably as a back layer of the support). The non-photosensitive layer may be in any form of a filter layer, an antihalation layer, a surface protective layer or the like, but is preferably one and the same layer that contains a dye decolorable in heat development and/or a base precursor.

In case where the specific gelatin is in the layer that contains a dye decolorable in heat development and/or a base precursor in the invention, its amount is preferably from 0.1 $g/m^2$ to 2.0 $g/m^2$, more preferably from 0.1 $g/m^2$ to 1.0 $g/m^2$.

One and the same type or two or more different types of specific gelatins as above may be used in the invention either singly or as combined. If desired, the specific gelatin may be combined with any other gelatin for use herein.

The non-photosensitive layer of the photothermographic material of the invention preferably contains at least one type of dye decolorable in heat development and/or at least one base precursor.

The non-photosensitive layer that contains a dye decolorable in heat development and/or a base precursor may contain any of artificially synthesized polymers, polymer latexes or natural polymers, and these may be of any type of hydrophobic or hydrophilic binders. For these in the invention, especially preferred are hydrophilic binders, or hydrophobic or hydrophilic polymer latexes, for example, dextrin, polyacrylamide, and styrene-butadiene copolymer.

The dye decolorable in heat development (this will be hereinafter simply referred to as "thermally decolorable dye") for use in the invention is described below.

The thermally decolorable dye for use in the invention is an antihalation dye, and is preferably a solid particulate dye. The thermally decolorable dye may be combined with any other dye not decolorable in heat development.

The density of the particles that constitute the solid particulate dye for the thermally decolorable dye for use in the invention is described. The photothermographic material of the invention is processed to remove the photosensitive layers and therearound on one side of its support, and its transmission image or reflection image is photographically taken in any desired unit area of 0.1 $mm^2$, using an optical microscope. On the thus-taken image, the number of the dye particles not smaller than 1 μm in terms of the diameter of the circle that corresponds to the projected area of each particle is counted. For the solid particulate dye for use in the invention, the number of the dye particles not smaller than 1 μm in terms of the diameter of the circle that corresponds to the projected area of each particle, thus counted, is preferably less than or equal to 100, more preferably less than or equal to 50, even more preferably less than or equal to 25.

Also preferably, the volume-weighted mean particle size of the thermally decolorable, solid particulate dye for use in the invention is less than or equal to 1.0 μm, more preferably less than or equal to 0.6 μm, even more preferably less than or equal to 0.3 μm.

The volume-weighted mean particle size of the dye is measured as follows: A sample of the dye dispersion is dried in solid on a mesh, and then coated with carbon through vapor deposition. On the mesh inclined in some degree, the thus-coated dye particles are photographed through an electronic microscope. On the thus-taken image, the sphere-corresponding diameter and the volume of each dye particle are obtained, and the volume-weighted mean particle size of the dye is derived from the thus-measured data. Seemingly overlapping dye particles are considered as one particle.

The number of the dye particles in the population is preferably from 500 to 1000 or so.

The amount of the thermally decolorable dye that may be in the photothermographic material of the invention shall be larger than 0.1 in terms of the optical density (absorbance) measured at an intended wavelength. Preferably, the optical density is from 0.15 to 2, more preferably from 0.2 to 1. To attain the optical density that falls within the range, the amount of the thermally decolorable dye to be in the material may be generally from 0.001 g/m$^2$ to 1 g/m$^2$ or so.

After heat development, the dye is decolored, and in that condition, the optical density of the processed material is preferably less than or equal to 0.1.

Preferred examples of the thermally decolorable dye for use in the invention are described in detail hereinunder.

The thermally decolorable dye is preferably a dye or a salt thereof that is decolored by the action of a base (this will be hereinafter referred to as "decolorable dye"). Concretely, preferred for it are cyanine dyes represented by the following general formula (1) and a salt thereof.

General Formula (1)

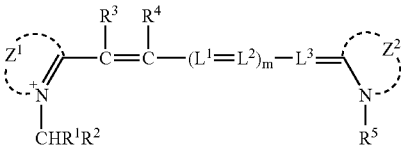

In general formula (1), $R^1$ represents an electron-attracting group; $R^2$ represents a hydrogen atom, an aliphatic group or an aromatic group; $R^3$ and $R^4$ each independently represent a hydrogen atom, a halogen atom, an aliphatic group, an aromatic group, —$NR^6R^7$, $R^6$ or —$SR^7$; $R^6$ and $R^7$ each independently represent a hydrogen atom, an aliphatic group or an aromatic group; $R^5$ represents an aliphatic group; $L^1$, $L^2$ and $L^3$ each independently represent an optionally-substituted methine group, and the substituents, if any, of the methine group may bond to each other to form an unsaturated aliphatic ring or an unsaturated heterocycle; $Z^1$ and $Z^2$ each independently represent an atomic group to form a 5-membered or 6-membered, nitrogen-containing heterocycle, the nitrogen-containing heterocycle may be condensed with an aromatic ring, and the nitrogen-containing heterocycle and its condensed ring may be substituted; m indicates 0, 1, 2 or 3.

The compounds of general formula (1) are described in detail. In general formula (1), $R^1$ represents an electron-attracting group. Preferably, its Hammett's substituent constant σm (for example, described in *Chem. Rev.*, 91, 165 (1991)) is from 0.3 to 1.5. More preferably, the group is —C(=O)$R^{11}$, —$SO_pR^{12}$, or a cyano group; and is more preferably —C(=O)$R^{11}$. $R^{11}$ represents a hydrogen atom, an aliphatic group, an aromatic group, —$OR^{13}$, —$SR^{13}$ or —$NR^{13}R^{14}$; $R^{12}$ represents an aliphatic group, an aromatic group, —$OR^{13}$ or —$NR^{13}R^{14}$; and p indicates 1 or 2. $R^{13}$ and $R^{14}$ each independently represent a hydrogen atom, an aliphatic group or an aromatic group, or $R^{13}$ and $R^{14}$ bond to each other to form a nitrogen-containing heterocycle. More preferably, $R^1$ is —C(=O)$R^{11}$, in which, even more preferably, $R^{11}$ is —$OR^{13}$ or —$NR^{13}R^{14}$. Most preferably, $R^{14}$ is —$NR^{13}R^{14}$ for good storage stability of the photosensitive material.

The "aliphatic group" in general formula (1) means an alkyl group, a substituted alkyl group, an alkenyl group, a substituted alkenyl group, an alkynyl group, a substituted alkynyl group, an aralkyl group or a substituted aralkyl group. In the invention, the aliphatic group is preferably an alkyl group, a substituted alkyl group, an alkenyl group, a substituted alkenyl group, an aralkyl group or a substituted aralkyl group, more preferably an alkyl group, a substituted alkyl group, an aralkyl group or a substituted aralkyl group. For it, an acyclic aliphatic group is preferred to a cyclic aliphatic group. The acyclic aliphatic group may be branched. Preferably, the alkyl group has from 1 to 30 carbon atoms, more preferably from 1 to 20, even more preferably from 1 to 15 carbon atoms. The alkyl moiety of the substituted alkyl group may be the same as the alkyl group.

In general formula (1), the alkenyl group or the alkynyl group preferably has from 2 to 30 carbon atoms, more preferably from 2 to 20, even more preferably from 2 to 15 carbon atoms. The alkenyl moiety of the substituted alkenyl group, and the alkynyl moiety of the substituted alkynyl group may be the same as the alkenyl group and the alkynyl group, respectively.

In general formula (1), the aralkyl group preferably has from 2 to 30 carbon atoms, more preferably from 2 to 20, even more preferably from 2 to 15 carbon atoms. The aralkyl moiety of the substituted aralkyl group may be the same as the aralkyl group.

In general formula (1), the "aromatic group" means an aryl group or a substituted aryl group. The aryl group preferably has from 6 to 30 carbon atoms, more preferably from 6 to 20, even more preferably from 6 to 15 carbon atoms. The aryl moiety of the substituted aryl group may be the same as the aryl group.

The substituents that the above-mentioned groups may have are not specifically defined. For example, they include a carboxyl group (it may form salts), a sulfo group (it may form salts), a sulfonamido group having from 1 to 20 carbon atoms (e.g., methanesulfonamido, benzenesulfonamido, butanesulfonamido, n-octanesulfonamido), a sulfamoyl group having from 0 to 20 carbon atoms (e.g., unsubstituted sulfamoyl, methylsulfamoyl, phenylsulfamoyl, butylsulfamoyl), a sulfonylcarbamoyl having from 2 to 20 carbon atoms (e.g., methanesulfonylcarbamoyl, propanesulfonylcarbamoyl, benzenesulfonylcarbamoyl), an acylsulfamoyl group having from 1 to 20 carbon atoms (e.g., acetylsulfamoyl, propionylsulfamoyl, benzoylsulfamoyl), an acyclic or cyclic alkyl group having from 1 to 20 carbon atoms (e.g., methyl, ethyl, cyclohexyl, trifluoromethyl, 2-hydroxyethyl, 4-carboxybutyl, 2-methoxyethyl, 2-ethoxyethyl, benzyl, 4-carboxybenzyl, 2-diethylaminoethyl), an alkenyl group having from 2 to 20 carbon atoms (e.g., vinyl, allyl), an alkoxy group having from 1 to 20 carbon atoms (e.g., methoxy, ethoxy, butoxy), a halogen atom (e.g., F, Cl, Br), an amino group having from 0 to 20 carbon atoms (e.g., unsubstituted amino, dimethylamino, diethylamino, carboxyethylamino), an alkoxycarbonyl group having from 2 to 20 carbon atoms (e.g., methoxycarbonyl), an amido group having from 1 to 20 carbon atoms (e.g., acetamido, benzamido, 4-chlorobenzamido), a carbamoyl group having from 1 to 20 carbon atoms (e.g., unsubstituted carbamoyl, methylcarbamoyl, phenylcarbamoyl, benzimidazol-2-onecarbamoyl), an aryl group having from 6 to 20 carbon atoms (e.g., phenyl, naphthyl, 4-carboxyphenyl, 4-methanesulfonamidophenyl, 3-benzoylaminophenyl), an aryloxy group having from 6 to 20 carbon atoms (e.g., phenoxy, 3-methylphenoxy, naphthoxy), an alkylthio group having from 1 to 20 carbon atoms (e.g., methylthio, octylthio), an arylthio group having from 6 to 20 carbon atoms (e.g., phenylthio, naphthylthio), an acyl group having from 1 to 20 carbon atoms (e.g., acetyl, benzoyl, 4-chlorobenzoyl), a sulfonyl group having from 1 to 20 carbon atoms (e.g., methanesulfonyl, benzenesulfonyl), an ureido group having from 1 to 20 carbon atoms (e.g., methylureido, phenylureido), an alkoxycarbonylamino group having from 2 to 20 carbon atoms (e.g., methoxycarbonylamino, hexyloxycarbonylamino), a cyano group, a hydroxyl group, a nitro group, and a heterocyclic group (for which the heterocycle includes, for example, 5-ethoxycarbonylbenzoxazole ring, pyridine ring, sulforane ring, furan ring, pyrrole ring, pyrrolidine ring, morpholine ring, piperazine ring, pyrimidine ring, phthalimido ring, tetrachlorophthalimido ring, benzisoquinolinedione ring).

In general formula (1), $R^2$ represents a hydrogen atom, an aliphatic group or an aromatic group. For the definition of the aliphatic group and the aromatic group, referred to are those mentioned hereinabove. Preferably, $R^2$ is a hydrogen atom or an aliphatic group, more preferably a hydrogen atom or an alkyl group, even more preferably a hydrogen atom or an alkyl group having from 1 to 15 carbon atoms, most preferably a hydrogen atom.

In general formula (1), $R^3$ and $R^4$ each independently represent a hydrogen atom, a halogen atom, an aliphatic group, an aromatic group, —$NR^6R^7$, —$OR^6$ or —$SR^7$. $R^6$ and $R^7$ each independently represent a hydrogen atom, an aliphatic group or an aromatic group. For the definition of the aliphatic group and the aromatic group, referred to are those mentioned hereinabove. Preferably, $R^3$ and $R^4$ each are a hydrogen atom or an aliphatic group, more preferably a hydrogen atom, an alkyl group, a substituted alkyl group, an aralkyl group or a substituted aralkyl group, even more preferably a hydrogen atom, an alkyl group or an aralkyl group. Most preferably, they are both hydrogen atoms.

In general formula (1), $R^5$ represents an aliphatic group. For the definition of the aliphatic group, referred to are those mentioned hereinabove. Preferably, $R^5$ is a substituted alkyl group. More preferably, $R^1$ is a substituted alkyl group represented by —$CHR^1R^2$, as the compounds are easy to synthesize.

In general formula (1), $L^1$, $L^2$ and $L^3$ each independently represent an optionally-substituted methine group. Examples of the substituents for the methine group include a halogen atom, an aliphatic group and an aromatic group. For the definition of the aliphatic group and the aromatic group, referred to are those mentioned hereinabove. The substituents, if any, of the methine group may bond to each other to form an unsaturated aliphatic ring or an unsaturated heterocycle. For it, an unsaturated aliphatic ring is preferred to an unsaturated heterocycle. Preferably, the ring to be formed is 6-membered or 7-membered, more preferably a cycloheptene ring or a cyclohexene ring. Even more preferably, the methine group is unsubstituted, or forms a cycloheptene ring or a cyclohexene ring.

In general formula (1), $Z^1$ and $Z^2$ each independently represent an atomic group to form a 5-membered or 6-membered, nitrogen-containing heterocycle. Examples of the nitrogen-containing heterocycle are oxazole ring, thiazole ring, selenazole ring, pyrroline ring, imidazole ring and pyridine ring. For it, a 5-membered ring is preferred to a 6-membered ring. The nitrogen-containing heterocycle may be condensed with an aromatic ring (e.g., benzene ring, naphthalene ring). The nitrogen-containing heterocycle and its condensed ring may be substituted. For the substituents for these, referred to are those mentioned hereinabove for the substituents for the groups in general formula (1). In general formula (1), m indicates 0, 1, 2 or 3.

The cyanine dye of general formula (1) preferably forms a salt with an anion. In case where the cyanine dye of general formula (1) has an anionic group such as a carboxyl or sulfo group for the substituent therein, it may form an internal salt. In the other cases, the cyanine dye preferably forms a salt with an external anion. The anion is preferably monovalent or divalent, more preferably monovalent. Examples of the anion are halide ion (e.g., $Cl^-$, $Br^-$, $I^-$), p-toluenesulfonate ion, ethylsulfate ion, 1,5-disulfonaphthalene dianion, $PF_6^-$, $BF_4^-$ and $ClO_4^-$. Preferred examples of the cyanine dye are represented by the following general general formula (1a):

General Formula (1a)

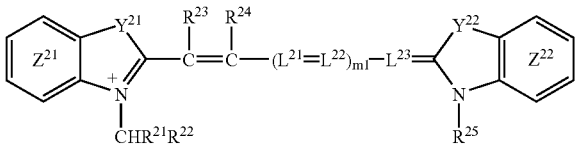

In general formula (1a), $R^{21}$, $R^{22}$, $R^{23}$, $R^{24}$, $R^{25}$, $L^{21}$ $L^{22}$, $L^{23}$ and $m_1$ have the same meanings as those of $R^1$, $R^2$, $R^3$, $R^4$, $R^5$, $L^1$, $L^2$, $L^3$ and m in general formula (1).

In general formula (1a), $Y^{21}$ and $Y^{22}$ each independently represent —$CR^{26}R^{27}$—, —$NR^{26}$—, —O—, —S— or —Se—. $R^{26}$ and $R^{27}$ each independently represent a hydrogen atom or an aliphatic group, and they may bond to each other to form a ring. The aliphatic group is more preferably an alkyl group or a substituted alkyl group.

In general formula (1a), the benzene rings $Z^{21}$ and $Z^{22}$ may be condensed with any other benzene ring. The benzene rings $Z^{21}$ and $Z^{22}$ and their condensed rings may be substituted. For the substituents for these, referred to are those mentioned hereinabove for the substituents for the groups in general formula (1).

In general formula (1a), $m_1$ indicates 0, 1, 2 or 3. The cyanine dye of general formula (1a) preferably forms a salt with an anion. For its salt, referred to are those mentioned hereinabove for the salt of the dye of general formula (1).

Specific examples [(1) to (43)] of the dyes that are decolorable with a base and their salts are mentioned below, which, however, are not limitative.

(1)
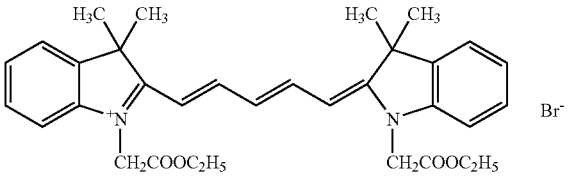
(2)
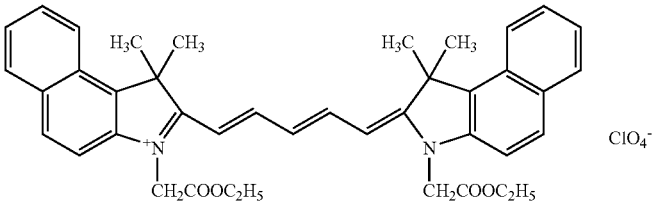
(3)
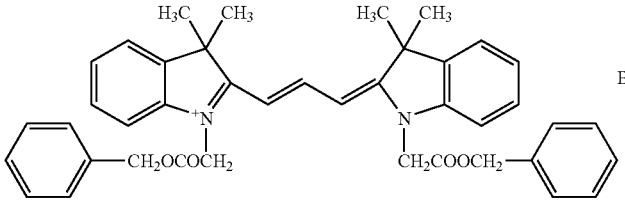
(4)
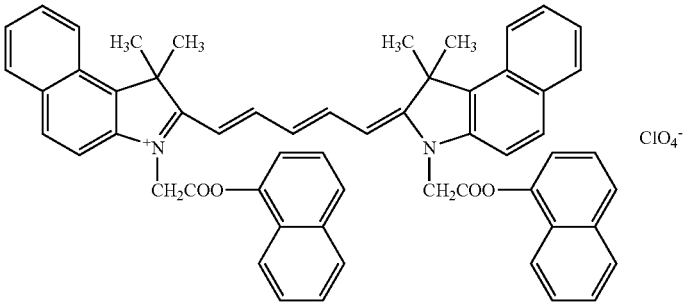
(5)
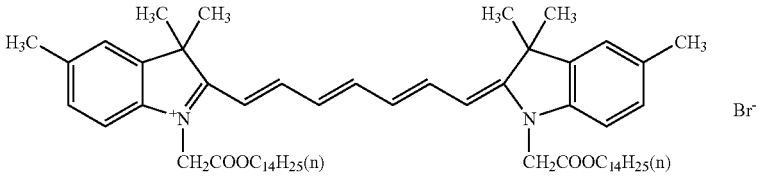
(6)
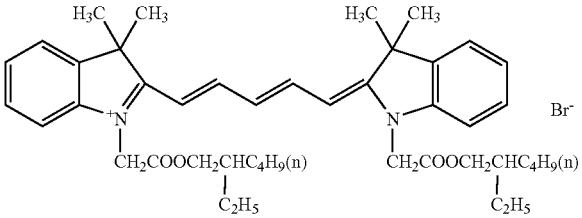
(7)
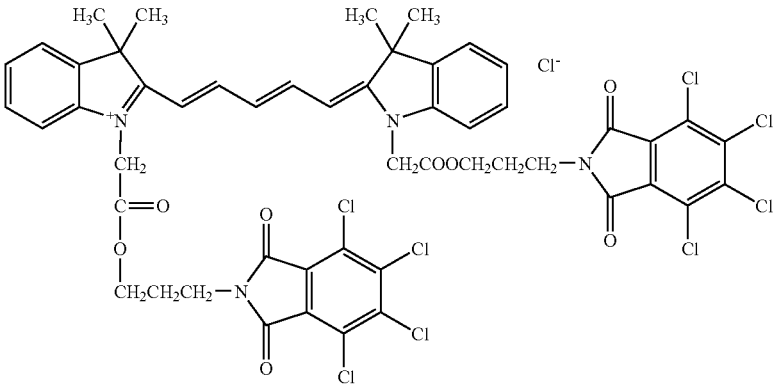

-continued
(8)
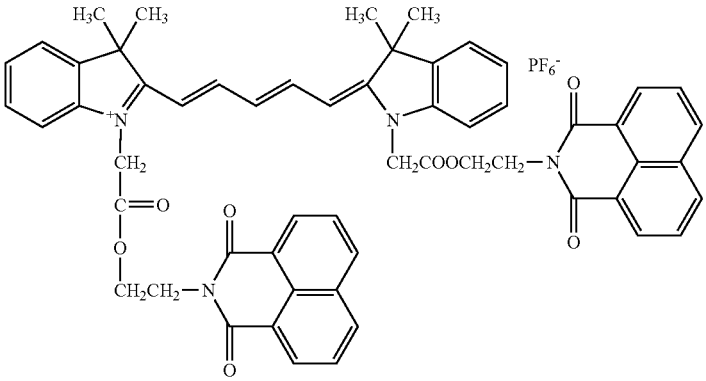
(9)
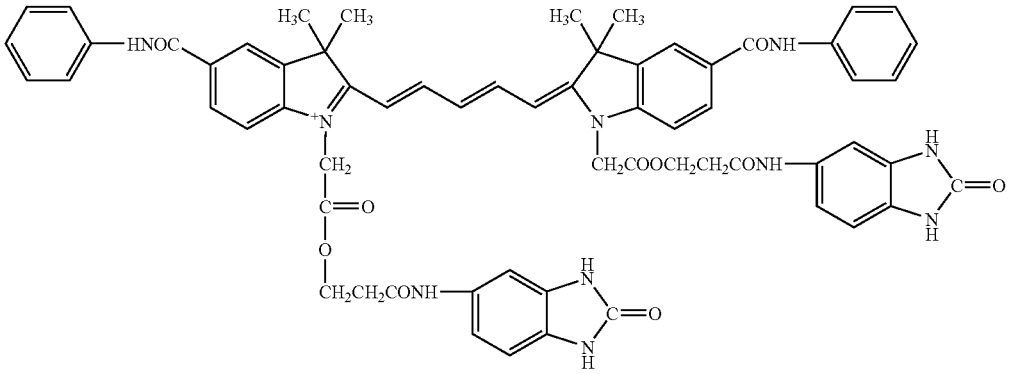
(10)
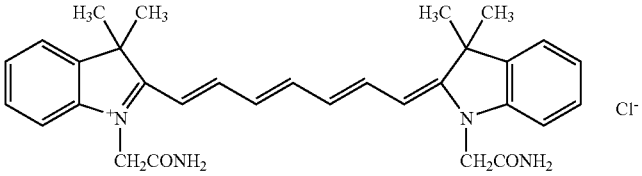
(11)
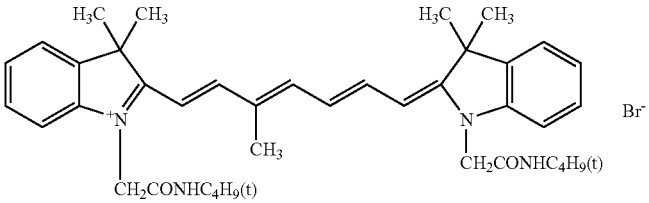
(12)
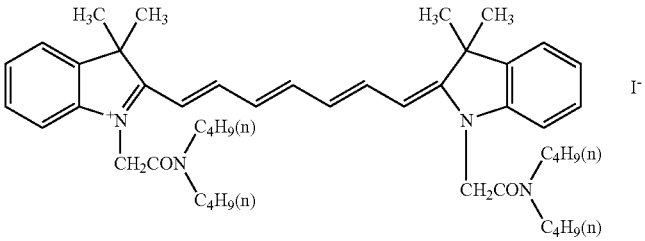
(13)
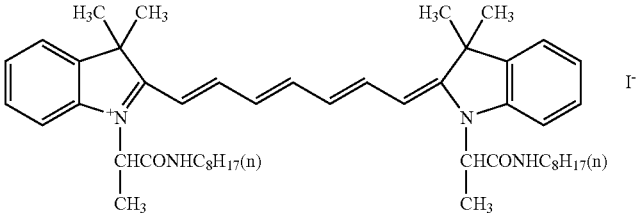

-continued
(14)
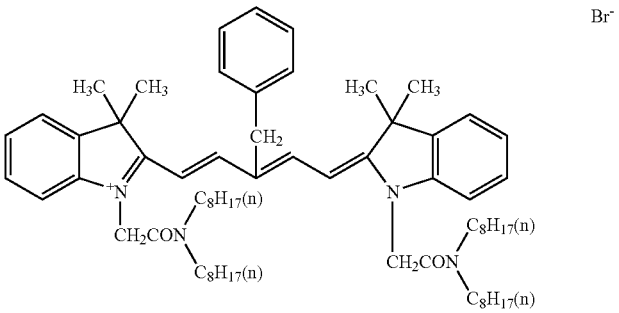
(15)
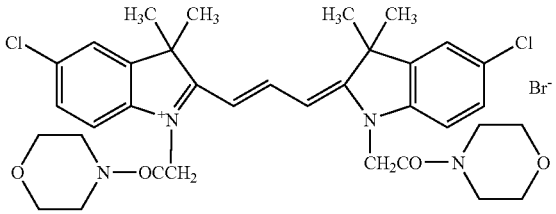
(16)
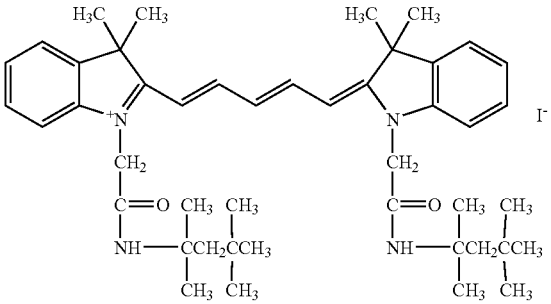
(17)
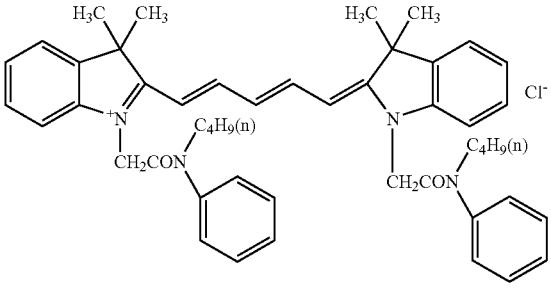
(18)
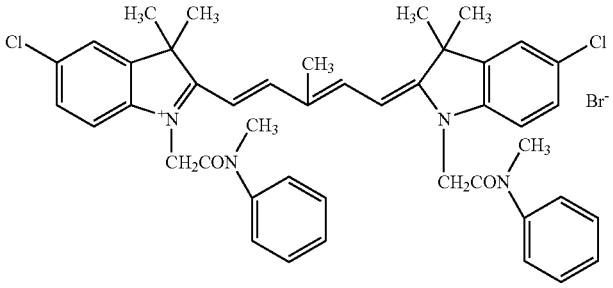

-continued
(19)
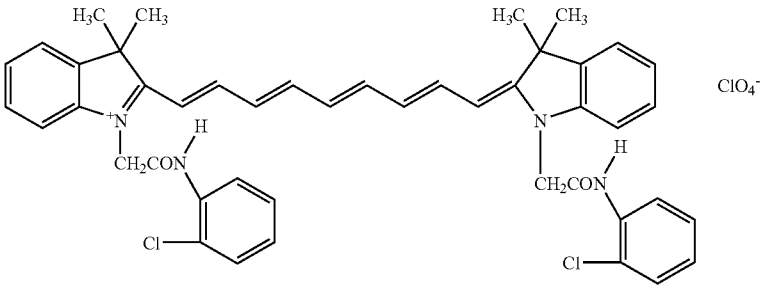
(20)
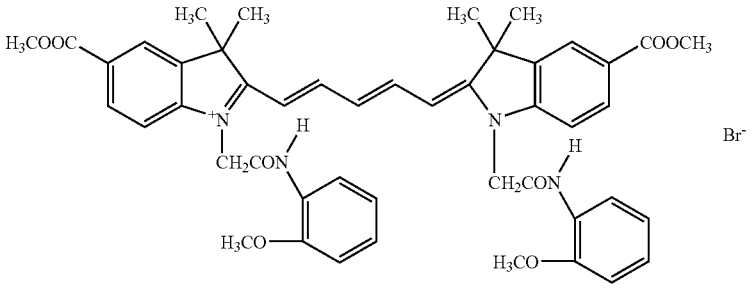
(21)
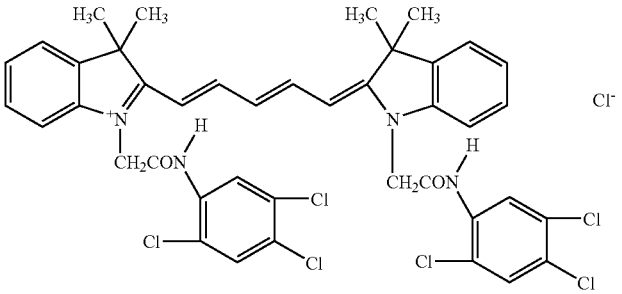
(22)
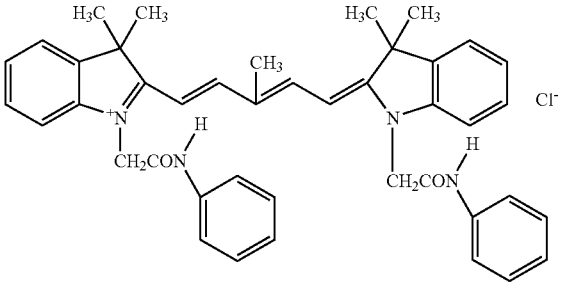
(23)
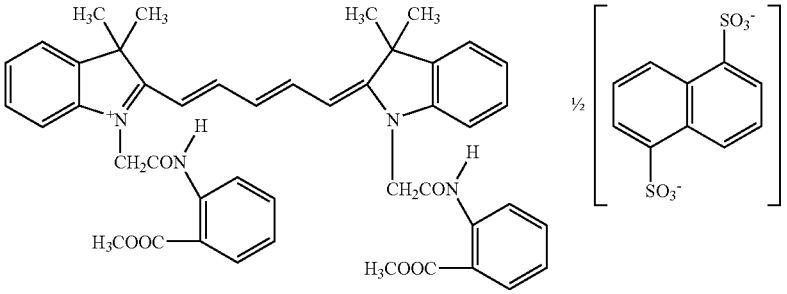

-continued
(24)
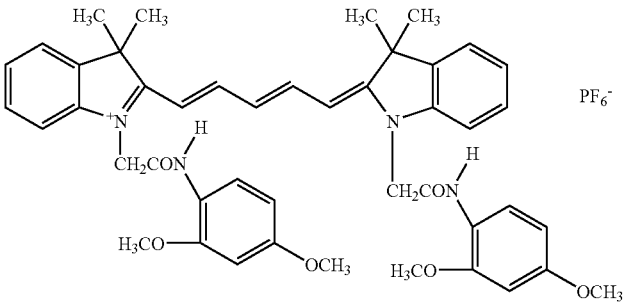
(25)
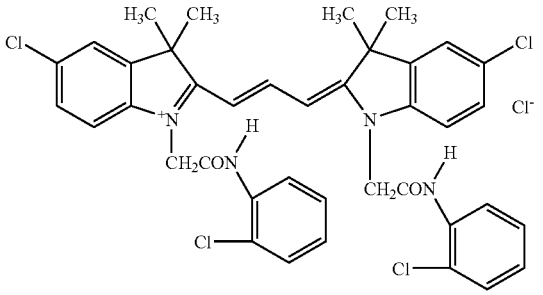
(26)
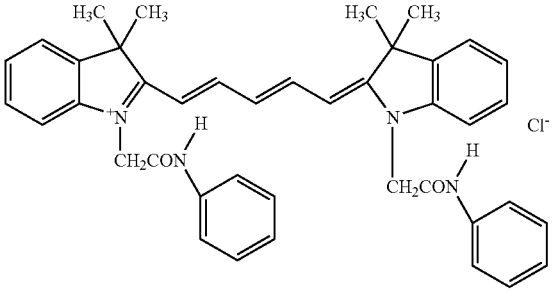
(27)
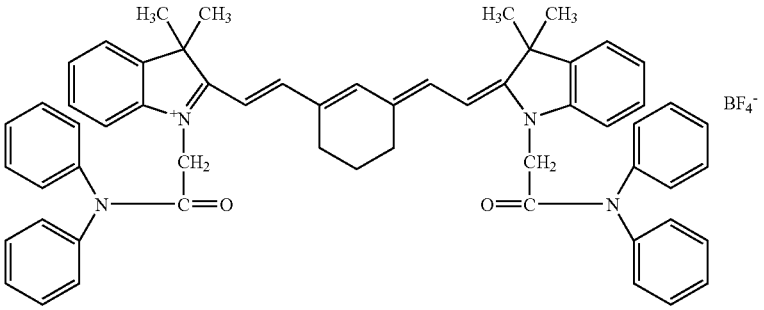
(28)
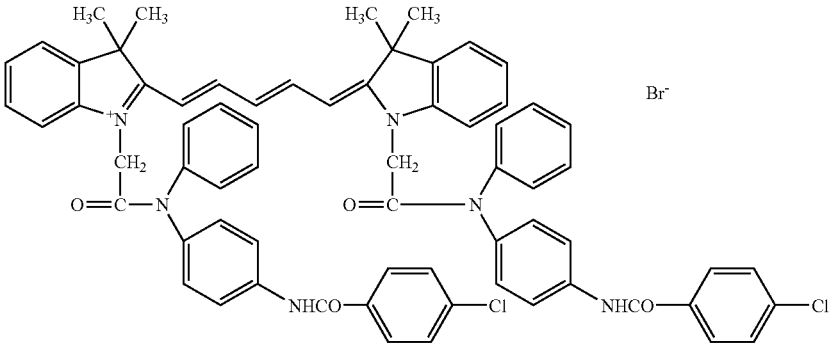

-continued
(29)
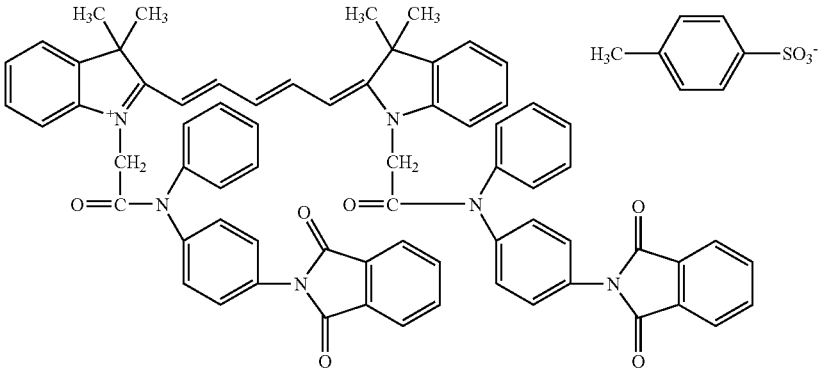
(30)
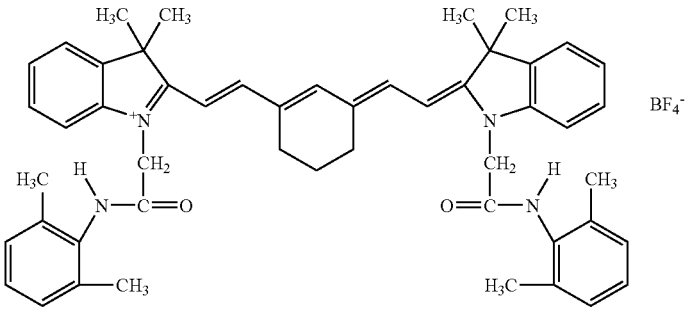
(31)
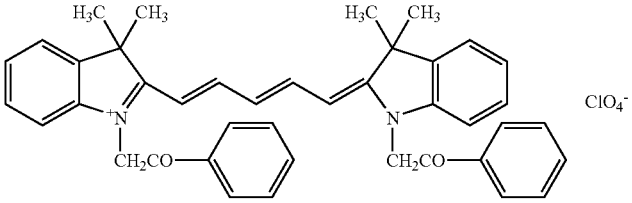
(32)
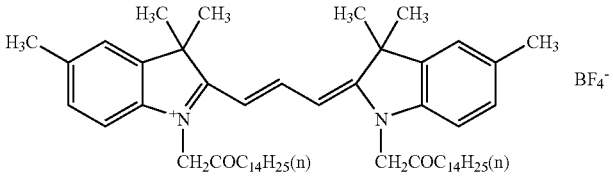
(33)
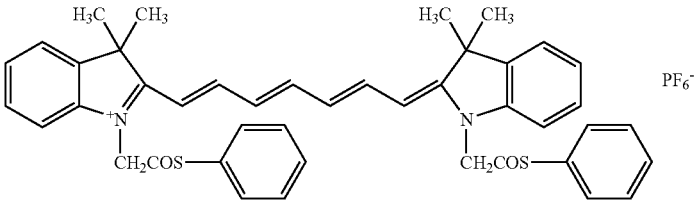
(34)
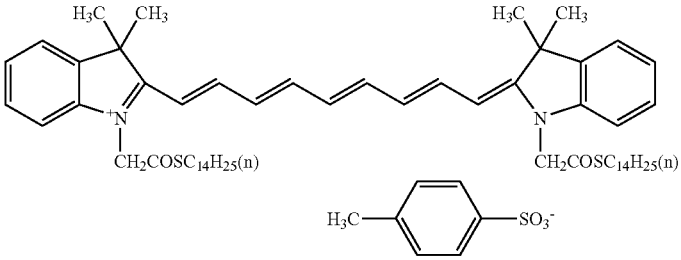

-continued
(35)
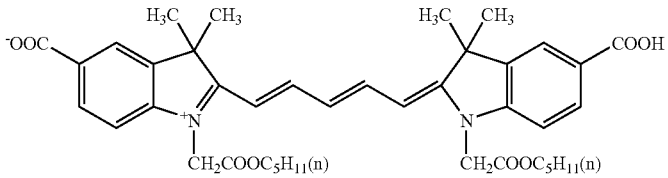
(36)
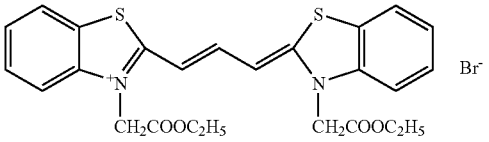
(37)
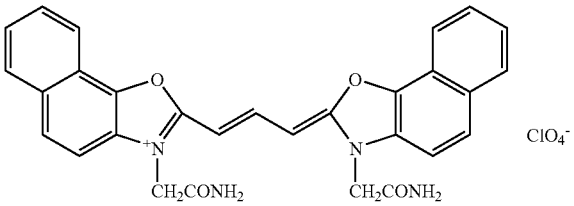
(38)
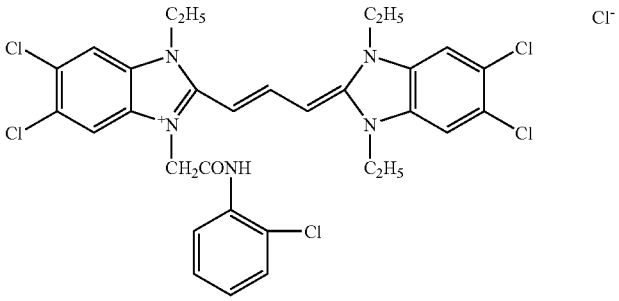
(39)
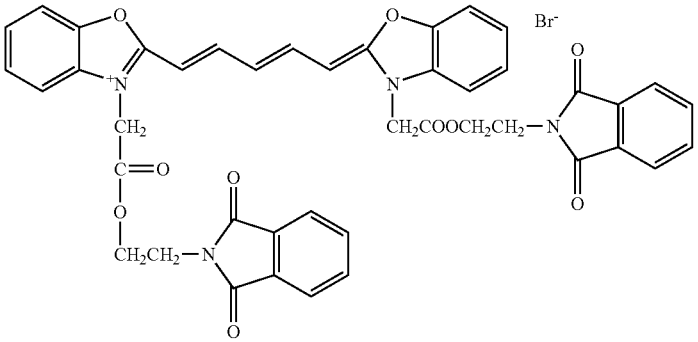
(40)
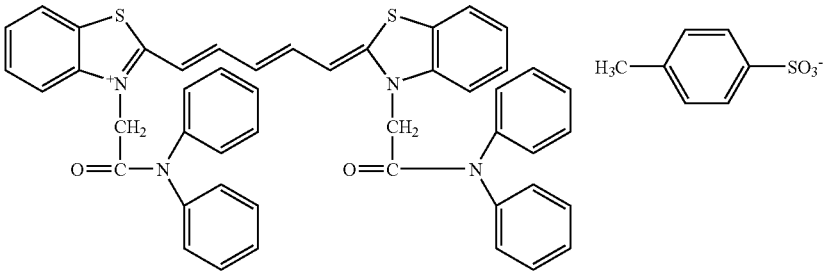

-continued (41)

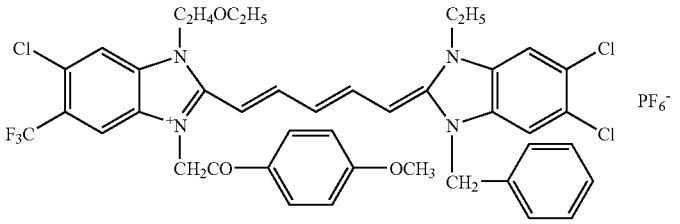

(42)

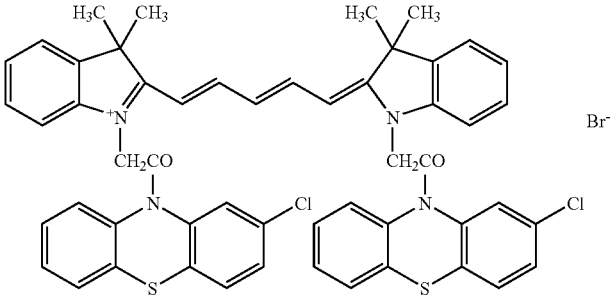

(43)

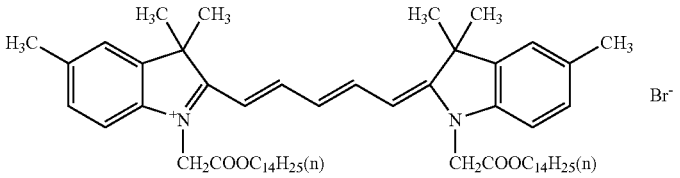

Preferred base precursors for use in the invention are described below.

Various types of base precursors are usable in the invention. In the invention, however, the color erasure is effected under heat, and therefore base precursors capable of forming (or releasing) bases under heat are preferred for use herein.

One typical example of base precursors capable of forming bases under heat is a pyrolyzing (decarboxylating) base precursor that comprises a salt of a carboxylic acid and a base. When such a decarboxylating precursor is heated, it decarboxylates to remove the carboxyl group from the carboxylic acid therein to thereby release the organic base. For the carboxylic acid, preferred is an easily decarboxylating sulfonylacetic acid or propiolic acid. Also preferably, the sulfonylacetic acid or propiolic acid is substituted with a decarboxylation-promoting aromatic group (e.g., aryl group or unsaturated heterocyclic group). Base precursors of sulfonylacetate are described in, for example, JP-A No. 59-168441; and those of propiolate are in, for example, JP-A 59-180537.

For the base component of the decarboxylating base precursor, preferred is an organic base. More preferably, it is any of amidine, guanidine or their derivatives. Also preferably, the organic base is a diacidic, triacidic or tetraacidic base, more preferably a diacidic base, most preferably a diacidic base with an amidine or guanidine derivative.

Diacidic, triacidic or tetraacidic base precursors of amidine derivatives are described in JP-B No. 7-59545. Diacidic, triacidic or tetraacidic base precursors of guanidine derivatives are described in JP-B No. 8-10321.

Diacidic bases of amidine or guanidine derivatives comprise (A) two amidine or guanidine parts, (B) substituents of the amidine or guanidine parts, and (C) a divalent linking group that links the two amidine or guanidine parts. Examples of the substituents (B) are an alkyl group (including cycloalkyl group), an alkenyl group, an alkynyl group, an aralkyl group and a heterocyclic group. Two or more of the substituents may bond to each other to form a nitrogen-containing heterocycle. The linking group (C) is preferably an alkylene group or a phenylene group.

Examples (BP-1 to BP-39) of dibasic base precursors of amidine or guanidine derivatives for use herein are mentioned below.

(BP-1)

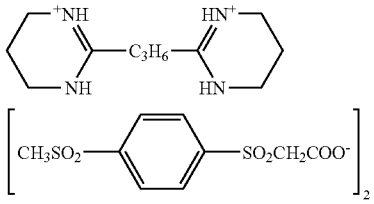

(BP-2)

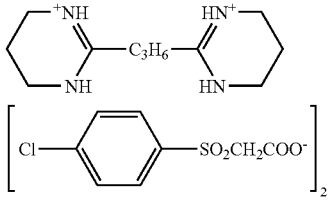

(BP-3)

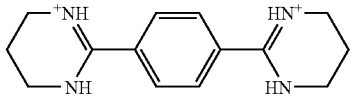

-continued
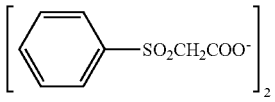
(BP-4)
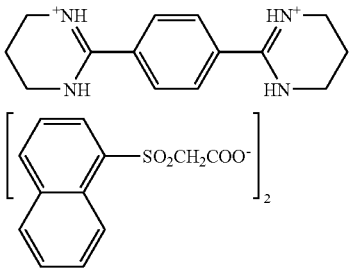
(BP-5)
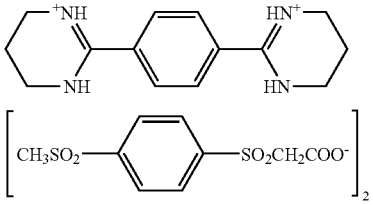
(BP-6)
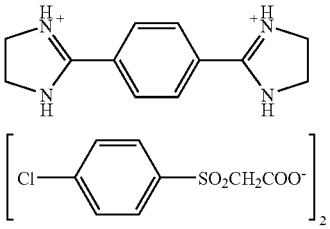
(BP-7)
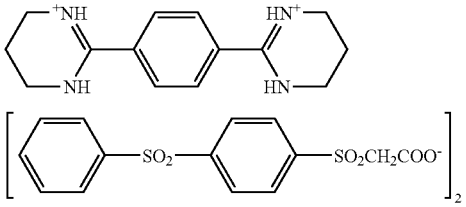
(BP-8)
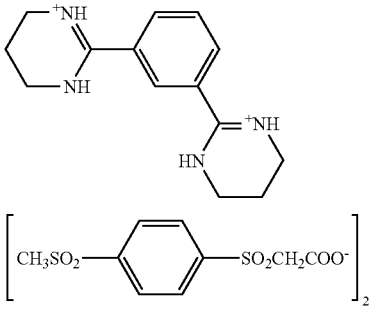
(BP-9)
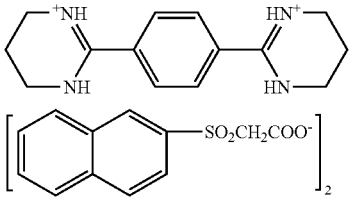
-continued
(BP-10)
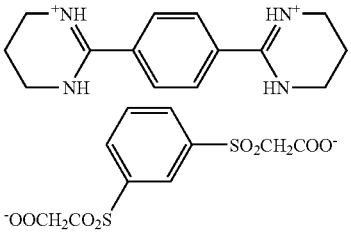
(BP-11)
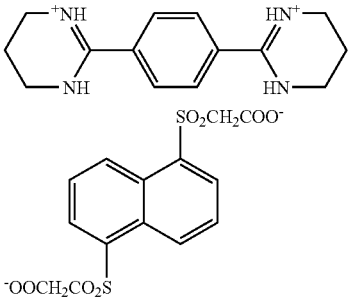
(BP-12)
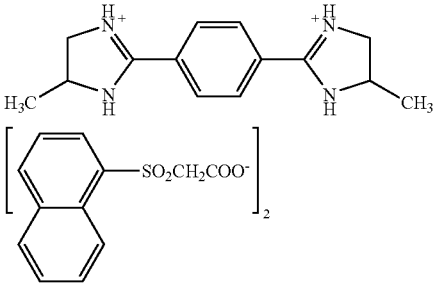
(BP-13)
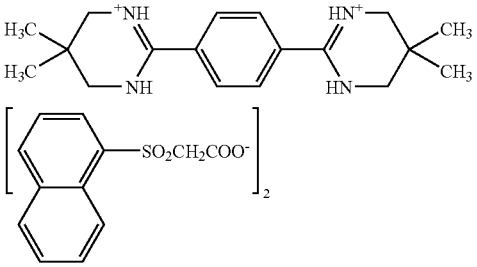
(BP-14)
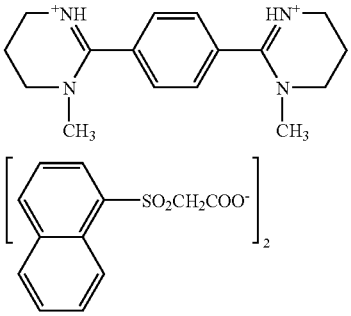
(BP-15)
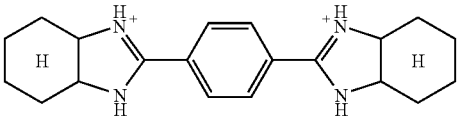

-continued
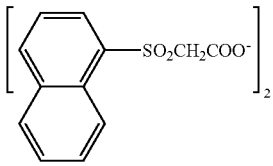
(BP-16)
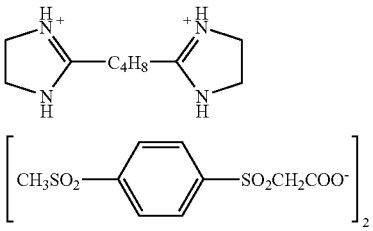
(BP-17)
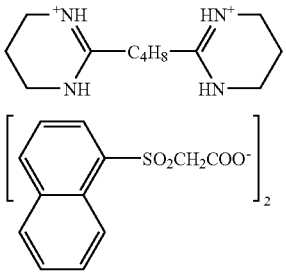
(BP-18)
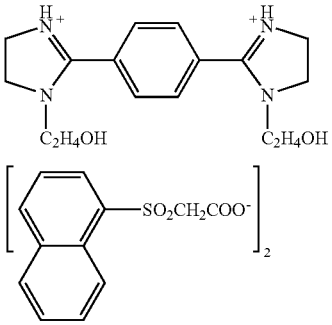
(BP-19)
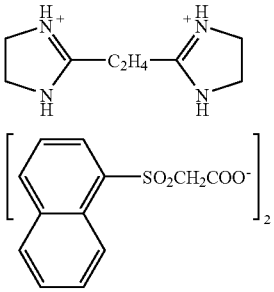
(BP-20)
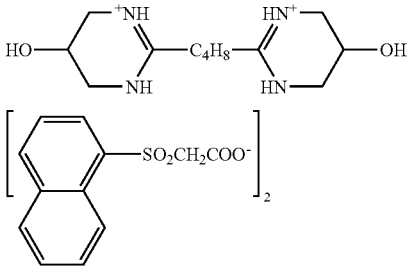
-continued
(BP-21)
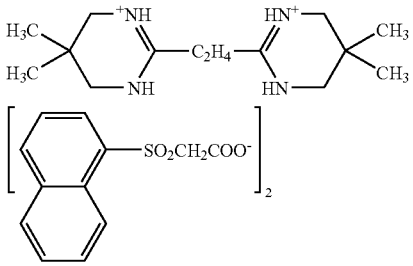
(BP-22)
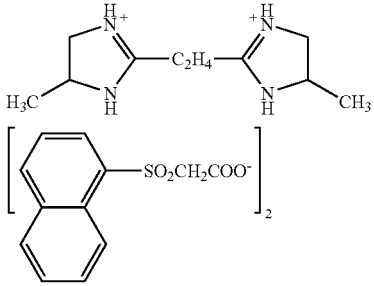
(BP-23)
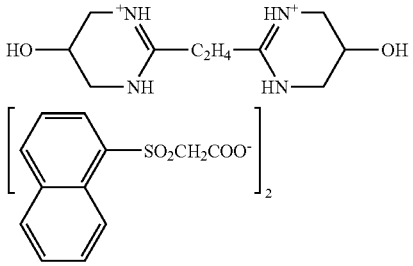
(BP-24)
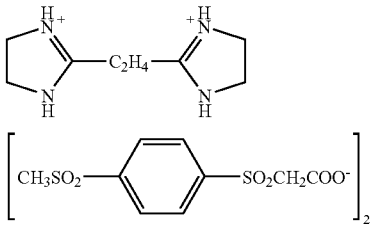
(BP-25)
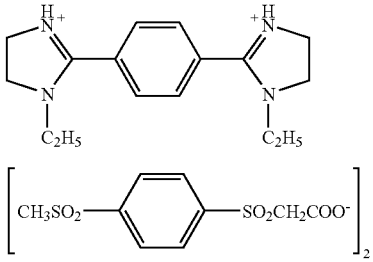
(BP-26)
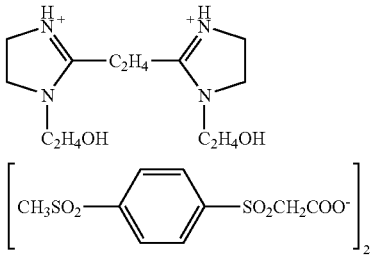

-continued
(BP-27)
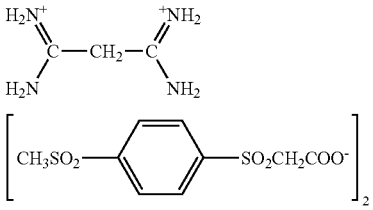
(BP-28)
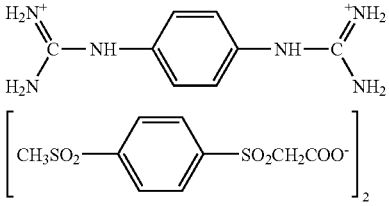
(BP-29)
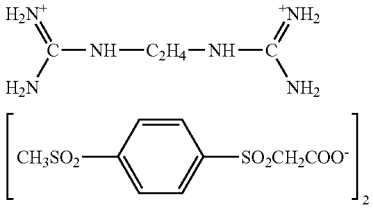
(BP-30)
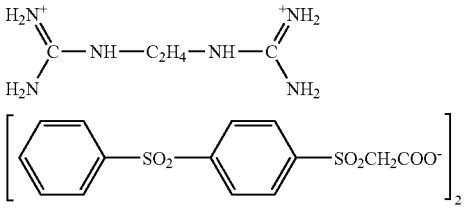
(BP-31)
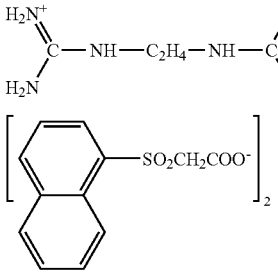
(BP-32)
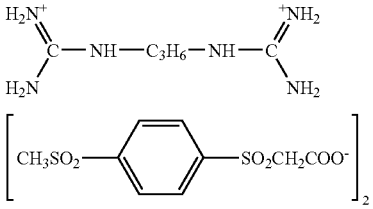
(BP-33)
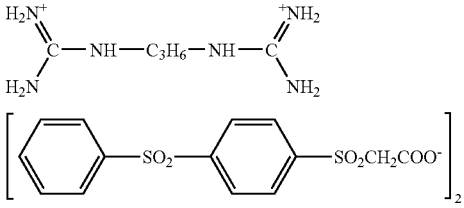
-continued
(BP-34)
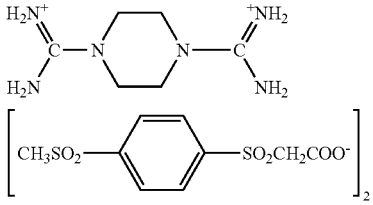
(BP-35)
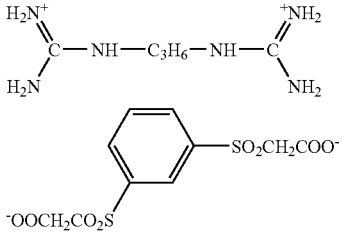
(BP-36)
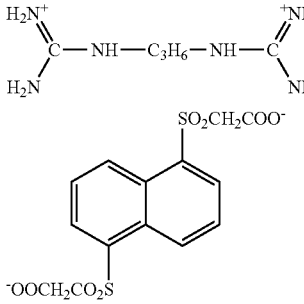
(BP-37)
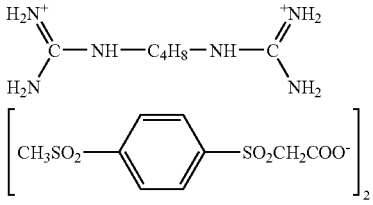
(BP-38)
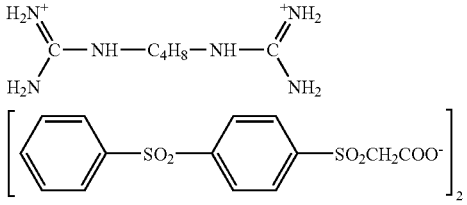
(BP-39)
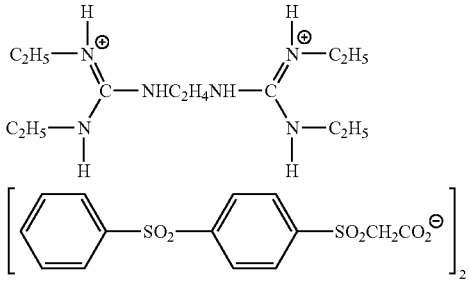
The amount of the base precursor to be in the photothermographic material of the invention is preferably from 1 to 100 times, more preferably from 3 to 30 times by mol of the amount of the thermally decolorable dye also in the material.

One or more different types of base precursors may be in the photothermographic material either singly or as combined.

Preferably, the photothermographic material of the invention contains a substance that decreases the melting point of the base precursor by 3 to 30° C. when mixed with the base precursor (the substance is hereinafter referred to as "melting point depressant").

When the melting point depressant is mixed with the base precursor, the melting point of the resulting mixture becomes lower by 3 to 30° C. than that of the base precursor alone. More preferably, the melting point depressant decreases, when mixed with the base precursor, the melting point of the base precursor by 3 to 20° C., even more preferably by 5 to 15° C.

The melting point change may be confirmed as follows: A base precursor and a melting point depressant are mixed in powder, or a dispersion of the two is mixed and dried at room temperature, and the resulting sample is analyzed through differential scanning calorimetry (DSC).

Two or more different types of melting point depressants may be combined for use herein.

The melting point depressant may be such that one type thereof alone can decrease the melting point of the base precursor by 3 to 30° C., or, only after mixed, a mixture of two or more different types of the substances can decrease it by 3 to 30° C.

Regarding its addition, it is desirable that the melting point depressant is added to the photothermographic material of the invention as a co-dispersion thereof with a base precursor, more preferably as a solid particulate co-dispersion thereof with it. Preferably, the mean particle size of the solid particulate co-dispersion is from 0.03 to 0.3 μm.

Preferably in the invention, a non-photosensitive layer that contains a dye or its salt decolorable with a base and a base precursor is formed on the back of a support, and another non-photosensitive layer that contains a melting point depressant is formed to be adjacent to the former non-photosensitive layer. The photothermographic material of the invention is therefore advantageous since the color residue therein is reduced.

Also preferably in the invention, a non-photosensitive layer that contains a dye or its salt decolorable with a base, a base precursor and a first melting point depressant is formed on the back of a support, and another non-photosensitive layer that contains a second melting point depressant is formed to be adjacent to the former non-photosensitive layer. The photothermographic material of the invention is therefore advantageous good since the color residue therein is reduced.

Preferred examples of the melting point depressant for use in the invention are described in detail hereinunder.

Preferred examples of the melting point depressant are compounds represent by the following general formulae (M1) to (M3).

General Formula (M1)

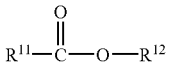

In general formula (M1), $R^{11}$ and $R^{12}$ each independently represent an aliphatic group, an aromatic group or a heterocyclic group; but when $R^{12}$ is an aliphatic group, $R^{11}$ is an aromatic group or a heterocyclic group.

Compounds of general formula (M1) are described in detail.

The "aliphatic group" in general formula (M1) means an alkyl group, a substituted alkyl group, an alkenyl group, a substituted alkenyl group, an alkynyl group, a substituted alkynyl group, an aralkyl group or a substituted aralkyl group. In the invention, the aliphatic group is preferably an alkyl group, a substituted alkyl group, an alkenyl group, a substituted alkenyl group, an aralkyl group or a substituted aralkyl group, more preferably an alkyl group, a substituted alkyl group, an aralkyl group or a substituted aralkyl group. The acyclic aliphatic group may be branched.

Preferably, the alkyl group in general formula (M1) has from 1 to 30 carbon atoms, more preferably from 1 to 20, even more preferably from 1 to 15 carbon atoms. The alkyl moiety of the substituted alkyl group may be the same as the alkyl group.

In general formula (M1), the alkenyl group or the alkynyl group preferably has from 2 to 30 carbon atoms, more preferably from 2 to 20, even more preferably from 2 to 15 carbon toms. The alkenyl moiety of the substituted alkenyl group, and the alkynyl moiety of the substituted alkynyl group may be the same as the alkenyl group and the alkynyl group, respectively.

In general formula (M1), the aralkyl group preferably has from 2 to 30 carbon atoms, more preferably from 2 to 20, even more preferably from 2 to 15 carbon atoms. The aralkyl moiety of the substituted aralkyl group may be the same as the aralkyl group.

In general formula (M1), the "aromatic group" means a monocyclic or condensed cyclic aryl group, which may be substituted. The aryl group preferably has from 6 to 30 carbon atoms, more preferably from 6 to 20, even more preferably from 6 to 15 carbon atoms. The aryl moiety of the substituted aryl group may be the same as the aryl group. For example, it includes a benzene ring and a naphthalene ring.

In general formula (M1), the "heterocyclic group" means a 5-membered or 6-membered, optionally-substituted heterocyclic group. The heterocyclic moiety of the substituted heterocyclic group may be the same as the heterocyclic group.

Examples of the heterocycle for the heterocyclic group in general formula (M1) are pyrrole, indole, furan, thiophene, imidazole, pyrazole, indolidine, quinoline, carbazole, phenothiazine, indoline, thiazole, pyridine, pyridazine, thiadiazine, pyran, thiopyran, oxadiazole, benzoquinoline, thiadiazole, pyrrolothiazole, pyrrolopyridazine, tetrazole, oxazole, coumarin and chroman. These may be substituted.

Not including a carboxyl group and salts of a carboxyl group, the substituents that the above-mentioned groups may have are not specifically defined. For example, they include a sulfonamido group having from 1 to 20 carbon atoms (e.g., methanesulfonamido, benzenesulfonamido, butanesulfonamido, n-octanesulfonamido), a sulfamoyl group having from 0 to 20 carbon atoms (e.g., unsubstituted sulfamoyl, methylsulfamoyl, phenylsulfamoyl, butylsulfamoyl), a sulfonylcarbamoyl having from 2 to 20 carbon atoms (e.g., methanesulfonylcarbamoyl, propanesulfonylcarbamoyl, benzenesulfonylcarbamoyl), an acylsulfamoyl group having from 1 to 20 carbon atoms (e.g., acetylsulfamoyl, propionylsulfamoyl, benzoylsulfamoyl), an acyclic or cyclic alkyl group having from 1 to 20 carbon atoms (e.g., methyl, ethyl, cyclohexyl, 2-hydroxyethyl, 4-carboxybutyl, 2-methoxyethyl, benzyl, 4-carboxybenzyl, 2-diethylaminoethyl), an alkenyl group having from 2 to 20 carbon atoms (e.g., vinyl, allyl), an alkoxy group having from 1 to 20 carbon atoms (e.g., methoxy, ethoxy, butoxy), a halogen atom (e.g., F, Cl, Br), an amino group having from 0 to 20 carbon atoms (e.g., unsubstituted amino, dimethylamino, diethylamino, carboxyethylamino), an alkoxycarbonyl group having from 2 to 20 carbon atoms (e.g., methoxycarbonyl), an amido group having from 1 to 20 carbon atoms (e.g., acetamido, benzamido), a carbamoyl group having from 1 to 20 carbon atoms (e.g., unsubstituted carbamoyl, methylcarbamoyl, phenylcarbamoyl), an aryl group having from 6 to 20 carbon atoms (e.g., phenyl, naphthyl, 4-carboxyphenyl, 4-methanesulfonamidophenyl, 3-benzoylaminophenyl), an aryloxy group having from 6 to 20 carbon atoms (e.g., phenoxy, 3-methylphenoxy, naphthoxy), an alkylthio group having from 1 to 20 carbon atoms (e.g., methylthio, octylthio), an arylthio group having from 6 to 20 carbon atoms (e.g., phenylthio, naphthylthio), an acyl group having from 1 to 20 carbon atoms (e.g., acetyl, benzoyl, 4-chlorobenzoyl), a sulfonyl group having from 1 to 20 carbon atoms (e.g., methanesulfonyl, benzenesulfonyl), an ureido group having from 1 to 20 carbon atoms (e.g., methylureido, phenylureido), an alkoxycarbonylamino group having from 2 to 20 carbon atoms (e.g., methoxycarbonylamino, hexyloxycarbonylamino), a cyano group, a hydroxyl group, a nitro group, and a heterocyclic group (for which the heterocycle includes, for example, 5-ethoxycarbonylbenzoxazole ring, pyridine ring, sulforane ring, furan ring, pyrrole ring, pyrrolidine ring, morpholine ring, piperazine ring, pyrimidine ring).

In general formula (M1), $R^{11}$ is preferably an aromatic group. For the substituent for the substituted aryl group for it, preferred are a substituted or unsubstituted alkyl group, a substituted or unsubstituted aryl group, a substituted or unsubstituted aralkyl group, an acyl group, a sulfonyl group, an alkoxycarbonyl group, an alkoxy group, a substituted or unsubstituted carbamoyl group, and a halogen atom. More preferred are a substituted or unsubstituted alkyl group, a substituted or unsubstituted aryl group, a sulfonyl group, an alkoxy group, and a halogen atom; and most preferred are a substituted or unsubstituted alkyl group, a sulfonyl group, and a halogen atom.

In general formula (M1), $R^{12}$ is preferably an aromatic group or a heterocyclic group. In case where $R^{12}$ is an aromatic group, the substituents for the substituted aryl group for it are preferably any of a substituted or unsubstituted alkyl group, a substituted or unsubstituted aryl group, a substituted or unsubstituted aralkyl group, an acyl group, a sulfonyl group, an alkoxycarbonyl group, an alkoxy group, a substituted or unsubstituted carbamoyl group, and a halogen atom. More preferred for the substituents are a substituted or unsubstituted alkyl group, a substituted or unsubstituted aryl group, a sulfonyl group, an alkoxy group, and a halogen atom; and most preferred are a substituted or unsubstituted alkyl group, a sulfonyl group, and a halogen atom. In case where $R^{11}$ or $R^{12}$ is an aliphatic group, it is preferably an aralkyl group.

Specific examples (M1-1 to M1-17) of the compounds of general formula (M1) are mentioned below, which, however, are not limitative.

M1-1

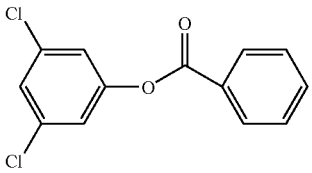

M1-2

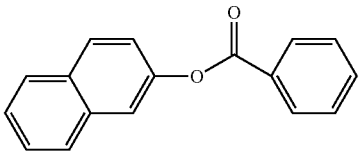

-continued

M1-3

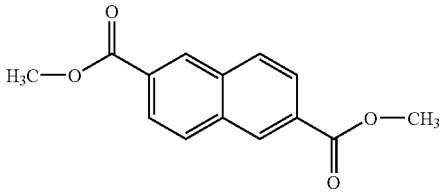

M1-4

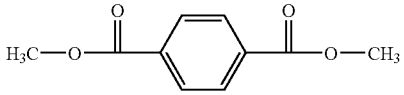

M1-5

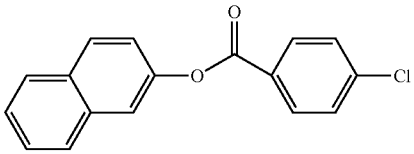

M1-6

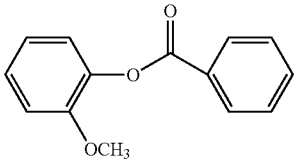

M1-7

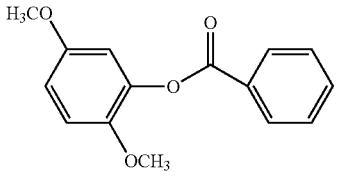

M1-8

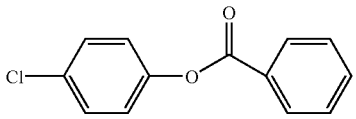

M1-9

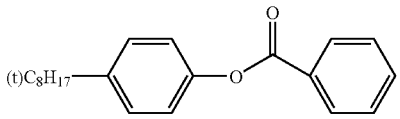

M-10

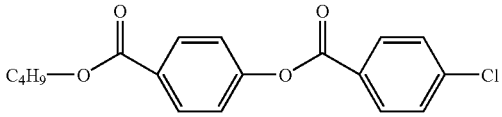

M-11

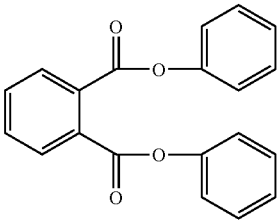

-continued

M-12

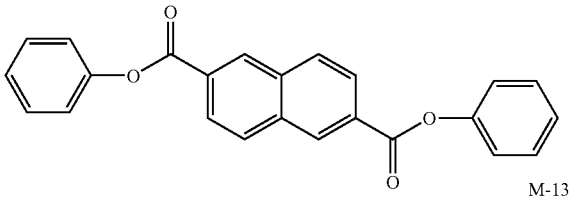

M-13

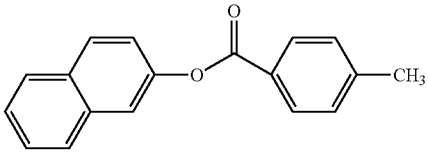

M-14

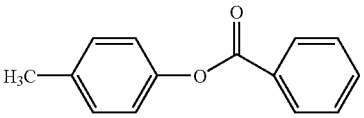

M1-15

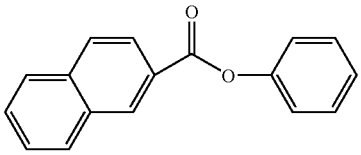

M1-16

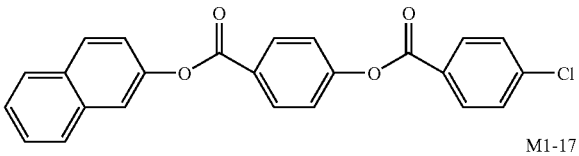

M1-17

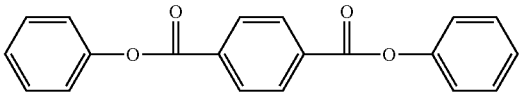

Other preferred examples of the melting point depressant for use in the invention are compounds of general formula (M2), and these are described below.

$R^2$—X—$R^{22}$ General Formula (M2)

In general formula (M2), $R^{21}$ and $R^{22}$ each independently represent an aromatic group or a heterocyclic group; and X represents a linking group except a sulfonyl group and a carboxyl group.

In general formula (M2), the "aromatic group" has the same meaning as the "aromatic group" in general formula (M1) mentioned hereinabove. The "heterocyclic group" in general formula (M2) also has the same meaning as the "heterocyclic group" in general formula (M1) mentioned above.

For the substituents that the above-mentioned groups may have, referred to are those mentioned hereinabove for "the substituents that the groups mentioned above may have" in general formula (M1).

The compounds of general formula (M2) do not include those of general formula (M1). The linking group for X is preferably a divalent linking group. However, in case where X is a trivalent or more polyvalent linking group, the compounds may have any other substituents selected from a hydrogen atom, an aliphatic group, an aromatic group and a heterocyclic group, independently of the substituents $R^{21}$ and $R^{22}$ therein. Examples of the linking group are —C(═O)—, —OC(═O)O—, —SO—, a substituted or unsubstituted methylene chain having from 1 to 3 carbon atoms, —C(═O)—C(═O)—, —C(OH)—C(═O)—, —S—, —O—, and the following groups:

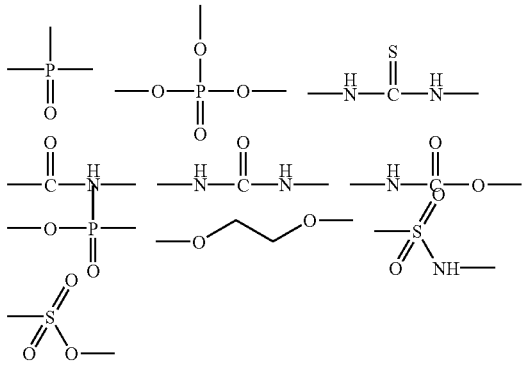

In general formula (M2), $R^{21}$ is preferably an aromatic group. For the substituent for the substituted aryl group for it, preferred are a substituted or unsubstituted alkyl group, a substituted or unsubstituted aryl group, a substituted or unsubstituted aralkyl group, an acyl group, a sulfonyl group, an alkoxycarbonyl group, an alkoxy group, a substituted or unsubstituted carbamoyl group, and a halogen atom. More preferred are a substituted or unsubstituted alkyl group, a substituted or unsubstituted aryl group, a sulfonyl group, an alkoxy group, and a halogen atom; and most preferred are a substituted or unsubstituted alkyl group, a sulfonyl group, and a halogen atom.

In general formula (M2), $R^{22}$ is preferably an aromatic group. In case where $R^{22}$ is an aromatic group, the substituents for the substituted aryl group for it are preferably any of a substituted or unsubstituted alkyl group, a substituted or unsubstituted aryl group, a substituted or unsubstituted aralkyl group, an acyl group, a sulfonyl group, an alkoxycarbonyl group, an alkoxy group, a substituted or unsubstituted carbamoyl group, and a halogen atom. More preferred for the substituents are a substituted or unsubstituted alkyl group, a substituted or unsubstituted aryl group, a sulfonyl group, an alkoxy group, and a halogen atom; and most preferred are a substituted or unsubstituted alkyl group, a sulfonyl group, and a halogen atom.

In case where $R^{21}$ and $R^{22}$ each are an aliphatic group, it is preferably an aralkyl group.

If desired, the substituents of $R^{21}$ and $R^{22}$ may bond to each other to form a ring along with X.

Specific examples (M2-1 to M2-16) of the compounds of general formula (M2) are mentioned below, which, however, are not limitative.

M2-1

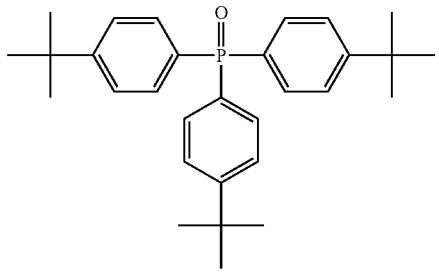

-continued
M2-2
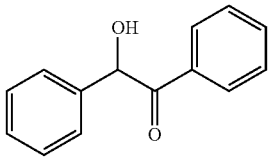
M2-3
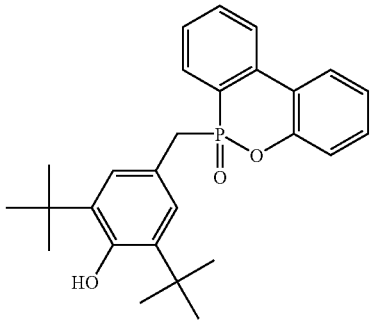
M2-4
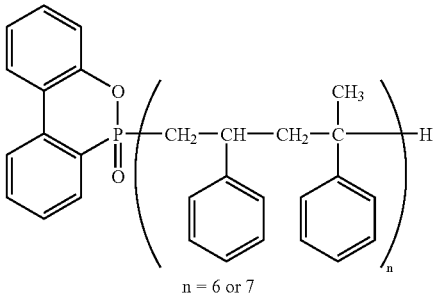
n = 6 or 7
M2-5
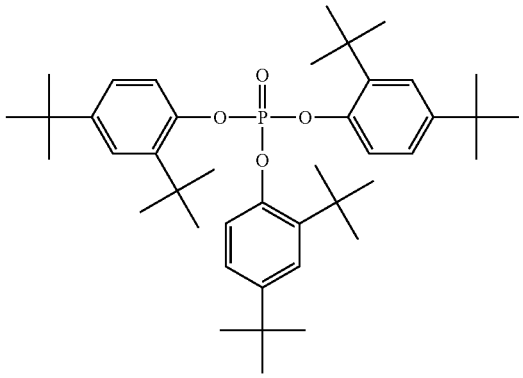
M2-6
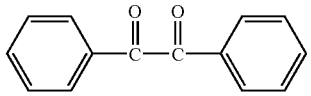
M2-7
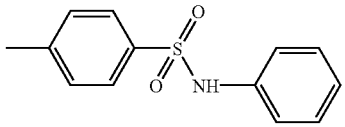
M2-8
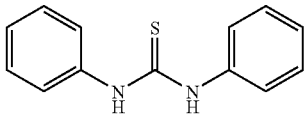
-continued
M2-9
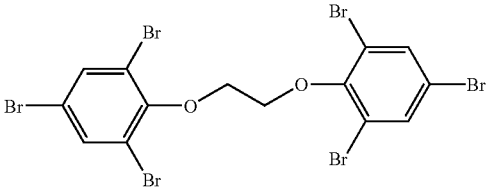
M2-10
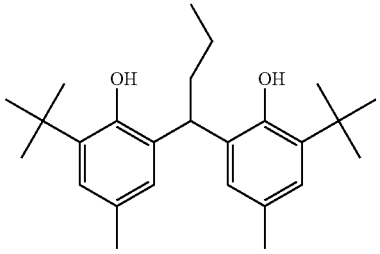
M2-11
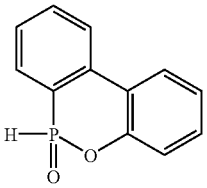
M2-12
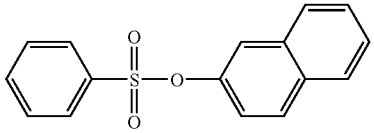
M2-13
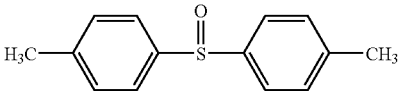
M2-14
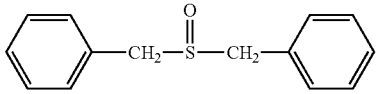
M2-15
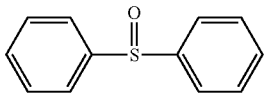
M2-16
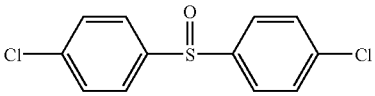
Still other preferred examples of the melting point depressant for use in the invention are compounds of general formula (M3), and these are described below.
General Formula (M3)
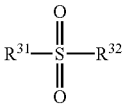
In general formula (M3), $R^{31}$ and $R^{32}$ each independently represent an aromatic group or a heterocyclic group; but the compounds of general formula (M3) do not have a substituent of a carboxyl group or a salt of a carboxyl group.

In general formula (M3), the "aromatic group" has the same meaning as the "aromatic group" in general formula (M1) mentioned hereinabove. The "heterocyclic group" in general formula (M3) also has the same meaning as the "heterocyclic group" in general formula (M1) mentioned above.

For the substituents that the above-mentioned groups may have, referred to are those mentioned hereinabove for "the substituents that the groups mentioned above may have" in general formula (M1).

In general formula (M3), $R^{31}$ is preferably an aromatic group. For the substituent for the substituted aryl group for it, preferred are a substituted or unsubstituted alkyl group, a substituted or unsubstituted aryl group, a substituted or unsubstituted aralkyl group, an acyl group, a sulfonyl group, an alkoxycarbonyl group, an alkoxy group, a substituted or unsubstituted carbamoyl group, and a halogen atom. More preferred are a substituted or unsubstituted alkyl group, a substituted or unsubstituted aryl group, a sulfonyl group, an alkoxy group, and a halogen atom; and most preferred are a substituted or unsubstituted alkyl group, a sulfonyl group, and a halogen atom.

In general formula (M3), $R^{32}$ is preferably an aromatic group. In case where $R^{32}$ is an aromatic group, the substituents for the substituted aryl group for it are preferably any of a substituted or unsubstituted alkyl group, a substituted or unsubstituted aryl group, a substituted or unsubstituted aralkyl group, an acyl group, a sulfonyl group, an alkoxycarbonyl group, an alkoxy group, a substituted or unsubstituted carbamoyl group, and a halogen atom. More preferred for the substituents are a substituted or unsubstituted alkyl group, a substituted or unsubstituted aryl group, a sulfonyl group, an alkoxy group, and a halogen atom; and most preferred are a substituted or unsubstituted alkyl group, a sulfonyl group, and a halogen atom.

Specific examples (M3-1 to M3-14) of the compounds of general formula (M3) are mentioned below, which, however, are not limitative.

M3-1

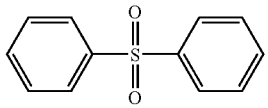

M3-2

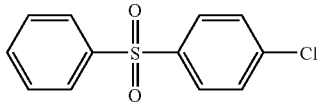

M3-3

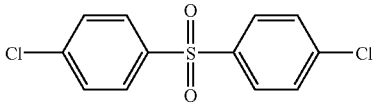

M3-4

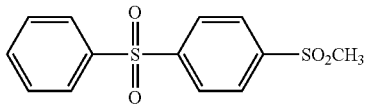

M3-5

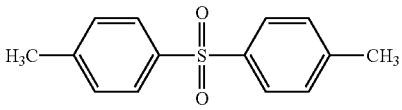

-continued

M3-6

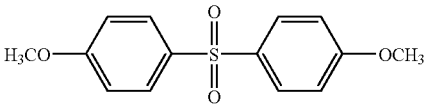

M3-7

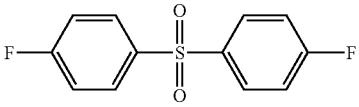

M3-8

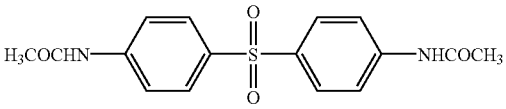

M3-9

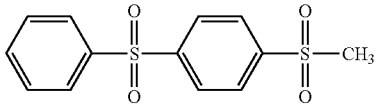

M3-10

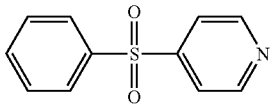

M3-11

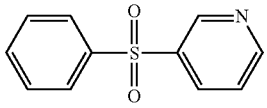

M3-12

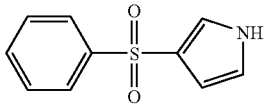

M3-13

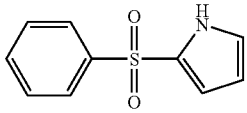

M3-14

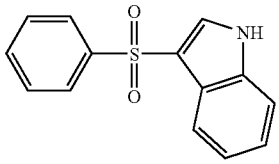

Preferably, the melting point of the compounds of general formulae (M1) to (M3) is the same as or higher than that of the base precursor; more preferably it is from 70° C. to 400° C., even more preferably from 100° C. to 300° C.

The overall amount of the compounds of general formulae (M1) to (M3) that may be in the photothermographic material of the invention is preferably from 20 parts by weight to 200 parts by weight relative to 100 parts by weight of the base precursor in the material.

Also preferably, the compounds of general formulae (M1) to (M3) do not have an absorption peak in the wavelength range of from 400 nm to 700 nm and do not substantially absorb any light that will have some negative influence on the photothermographic material of the invention, since they remain in the background of the processed photothermographic material in which the thermally decolorable dye has been decolored through heat development. More preferably, the compounds of general formulae (M1) to (M3) do not also absorb light shorter than 400 nm, substantially not having any negative influence on the photothermographic material.

Preferably, the photothermographic material of the invention contains a matting agent which is for improving the transferability of the material. Matting agents are described in JP-A No. 11-65021, paragraphs [0126] to [0127]. The amount of the matting agent to be added to the photothermographic material of the invention is preferably from 1 to 400 $mg/m^2$, more preferably from 5 to 300 $mg/m^2$ of the material.

Regarding its morphology, the matting agent for use in the invention may be in any form of regular or irregular particles, but preferred are regular particles, and more preferred are spherical particles. The mean particle size of the particles is preferably from 0.5 to 10 μm, more preferably form 1.0 to 8.0 μm, still more preferably from 2.0 to 6.0 μm. The fluctuation coefficient of the particle size distribution of the particles is preferably less than or equal to 50%, more preferably less than or equal to 40%, even more preferably less than or equal to 30%. The particle size fluctuation coefficient is represented by (standard deviation of particle size)/(mean value of particle size)×100. Also preferably, two different types of matting agents are combined for use herein, both having a small fluctuation coefficient but differing from each other in the ratio of the mean particle size of the two by at least 3.

The degree to which the surface of the emulsion layer of the photothermographic material of the invention is matted is not specifically defined, so far as the matted layer surface is free from star dust shaped defects, but is preferably such that the Beck's smoothness of the matted surface could be from 30 seconds to 2000 seconds, more preferably from 40 seconds to 1500 seconds. The Beck's smoothness is readily obtained according to JIS P8119 (method of testing surface smoothness of paper and paper boards with Beck tester), and to TAPPI Standard T479.

Regarding the matting degree of the back layer of the photothermographic material of the invention, the Beck's smoothness of the matted back layer is preferably from 10 seconds to 1200 seconds, more preferably from 20 seconds to 800 seconds, even more preferably from 40 seconds to 500 seconds.

Preferably, the photothermographic material of the invention contains a matting agent in the outermost surface layer, or in a layer functioning as an outermost surface layer, or in a layer nearer to the outermost surface of the material. Also preferably, it may contain a matting agent in a layer of the material that functions as a protective layer.

The photothermographic material of the invention is further described hereinunder. Preferably, the photothermographic material of the invention is of a monosheet type. The monosheet type does not require any additional sheet to receive images thereon, such as an image-receiving material, but may directly form images on itself. In particular, the invention is effective for photothermographic materials for exposure to near-IR rays.

The photothermographic material of the invention contains a non-photosensitive silver source, a photosensitive silver halide (catalytic amount of photocatalyst) and a reducing agent. Preferably, the material contains these in one and the same photosensitive layer. The photosensitive layer contains a binder (generally a synthetic polymer). In addition, the layer preferably contains a hydrazine compound (ultrahard gradation enhancing agent) and a color toning agent (for controlling silver tone).

The photothermographic material of the invention may have two or more photosensitive layers. For example, it may have a high-sensitivity photosensitive layer and a low-sensitivity photosensitive layer for controlling the image gradation. The order of the high-sensitivity photosensitive layer and the low-sensitivity photosensitive layer to be formed on the support of the photothermographic material of the invention is not specifically defined. For example, the low-sensitivity photosensitive layer may be lower than the high-sensitivity photosensitive layer, or that is, the former may be nearer to the support, and vice versa.

In addition to the photosensitive layer, the photothermographic material of the invention has a non-photosensitive layer. Depending on its configuration, the non-photosensitive layer is grouped into (1) a protective layer to be formed on the photosensitive layer (remoter from the support), (2) an interlayer to be provided between neighboring photosensitive layers or between a photosensitive layer and a protective layer, (3) an undercoat layer to be provided between a photosensitive layer and a support, and (4) a back layer to be formed on the back of the support opposite to the face thereof coated with a photosensitive layer (this back layer may include an optional back-protective layer). The filter layer to be in a photographic material is the layer (1) or (2); and the antihalation layer to be therein is the layer (3) or (4). The present invention is characterized in that the specific gelatin is added to the non-photosensitive layer of the layer type (4).

The non-photosensitive layer may be any other functional layer such as a surface protective layer, in addition to the layer that contains the dye mentioned above, or that is, the filter layer or the antihalation layer.

(Description of Non-Photosensitive Silver Source)

At least one non-photosensitive layer of the photothermographic material of the invention contains a non-photosensitive silver source, and one example of the non-photosensitive silver source is a non-photosensitive organic silver salt (this will be hereinafter referred to simply as "organic silver salt").

The organic silver salt usable in the invention is relatively stable to light, but, when heated at 80° C. or higher in the presence of an exposed photocatalyst (e.g., latent image of photosensitive silver halide) and a reducing agent, it forms a silver image. The organic silver salt may be any and every organic substance that contains a source having the ability to reduce silver ions. Some non-photosensitive organic silver salts of that type are described, for example, in JP-A No. 10-62899, paragraphs [0048] to [0049]; EP 0803764A1, from page 18 line 24 to page 19, line 37; and EP 0962812A1; and JP-A Nos. 11-349591, 2000-7683 and 2000-72711. Preferred for use herein are silver salts of fatty acids, especially silver salts of long-chain (C10 to C30, preferably C15 to C28) aliphatic carboxylic acids. Preferred examples of silver salts of such fatty acids are silver behenate, silver arachidate, silver stearate, silver oleate, silver laurate, silver caproate, silver myristate, silver palmitate, silver erucate and their mixtures. Of such silver salts of fatty acids, especially preferred for use in the invention are those having a silver behenate content of at least 50 mol %, more preferably at least 85 mol %, even more preferably at least 95 mol %.

The organic silver salt for use herein is not specifically defined for its morphology, and may be in any form of acicular, rod-like, tabular or scaly solids.

Scaly organic silver salts are preferred for use in the invention. Also preferred are short acicular grains having an aspect ratio (major axis/minor axis) of less than or equal to 5, or rectangular-parallelepiped or cubic grains, or irregular grains such as potato-like grains. The organic silver grains of these types prefer to other long acicular grains having an aspect ratio (major axis/minor axis) of more than 5 in that they are fogged little in heat development. The scaly organic silver salts for use herein are defined as follows: A sample of an organic silver salt to be analyzed is observed with an electronic microscope, and the grains of the salt seen in the field are approximated to rectangular parallelopipedons. The three different edges of the thus-approximated, one rectangular parallelopipedone are represented by a, b and c. a is the shortest, c is the longest, and c and b may be the same. From the shorter edges a and b, x is obtained according to the following equation:

$$x=b/a.$$

About 200 grains seen in the field are analyzed to obtain the value x, and the data of x are averaged. Samples that satisfy the requirement of x (average)≧1.5 are scaly. For scaly grains, preferably, 30≧x (average)≧1.5, more preferably 20≧x (average)≧2.0. In this connection, the value x of acicular (needle-like) grains falls within a range of 1≦x (average) <1.5.

In scaly grains, it is understood that a corresponds to the thickness of tabular grains of which the main plane is represented by b×c. In scaly grains of the organic silver salt for use herein, a (average) is preferably from 0.01 μm to 0.23 μm, more preferably from 0.1 μm to 0.20 μm; and c/b (average) is preferably from 1 to 6, more preferably from 1.05 to 4, even more preferably from 1.1 to 3, still more preferably from 1.1 to 2.

Regarding its grain size distribution, the organic silver salt is preferably a mono-dispersed one. Mono-dispersion of grains referred to herein is such that the value (in terms of percentage) obtained by dividing the standard deviation of the minor axis and the major axis of each grain by the minor axis and the major axis thereof, respectively, is preferably less than or equal to 100%, more preferably less than or equal to 80%, even more preferably less than or equal to 50%. To determine its morphology, a dispersion of the organic silver salt may be analyzed on its image taken by the use of a transmission electronic microscope. Another method for analyzing the organic silver salt for mono-dispersion morphology comprises determining the standard deviation of the volume weighted mean diameter of the salt grains. In the method, the value in terms of percentage (coefficient of variation) obtained by dividing the standard deviation by the volume weighted mean diameter of the salt grains is preferably less than or equal to 100%, more preferably less than or equal to 80%, even more preferably less than or equal to 50%. For example, a sample of the organic silver salt is dispersed in a liquid, the resulting dispersion is exposed to a laser ray, and the self-correlation coefficient of the salt grains relative to the time-dependent change of the degree of fluctuation of the scattered ray is obtained. Based on this, the grain size (volume weighted mean diameter) of the salt grains is obtained.

For preparing and dispersing the organic silver salts for use in the invention, employable is any known method. For it, for example, referred to are JP-A No. 10-62899; EP 0803763A1 and 0962812A1; JP-A Nos. 11-349591, 2000-7683 and 2000-72711; Japanese Patent Application Nos. 11-348228 to 348230, 11-203413, 2000-90093, 2000-195621, 2000-191226, 2000-213813 and 2000-214155.

It is desirable that the organic silver salt is dispersed substantially in the absence of a photosensitive silver salt, since the photosensitive silver salt, if any in the dispersing system, will be fogged and its sensitivity will be significantly lowered. For the photothermographic material of the invention, the amount of the photosensitive silver salt that may be in the aqueous dispersion of the organic silver salt is preferably less than or equal to 0.1 mol %, more preferably less than or equal to 0.1 mol % relative to one mol of the organic silver salt therein, and even more preferably, any photosensitive silver salt is not forcedly added to the aqueous dispersion.

An organic silver salt dispersion may be mixed with an aqueous, photosensitive silver salt dispersion to prepare a coating liquid for the image-forming layer of the photothermographic material of the invention. The blend ratio of the organic silver salt to the photosensitive silver salt in the mixture may be suitably determined depending on the object of the invention. Preferably, the blend ratio of the photosensitive silver salt to the non-photosensitive silver salt of a fatty acid in the mixture is from 1 to 30 mol %, more preferably from 2 to 20 mol %, even more preferably from 3 to 15 mol %. Mixing two or more different types of aqueous, organic silver salt dispersions with two or more different types of aqueous, photosensitive silver salt dispersions is preferred for controlling the photographic properties of the resulting mixture.

The amount of the organic silver salt to be in the photothermographic material of the invention is not specifically defined, and may be any desired one. Preferably, the amount of the salt is from 0.1 to 5 g/m$^2$, more preferably from 0.3 to 3 g/m$^2$, even more preferably form 0.5 to 2 g/m$^2$ in terms of the amount of silver in the salt.

(Description of Reducing Agent)

The photothermographic material of the invention contains a reducing agent that acts as a heat-developing agent for the organic silver salt therein. The reducing agent for the organic silver salt may be any and every substance capable of reducing silver ions into metal silver, but is preferably an organic substance. Some examples of the reducing agent are described in JP-A No. 11-65021, paragraphs [0043] to [0045] and in EP 0803764A1, from page 7, line 34 to page 18, line 12.

Especially preferred for the reducing agent for use herein are hindered phenols and bisphenols, and more preferred are compounds of the following general formula (R):

General Formula (R)

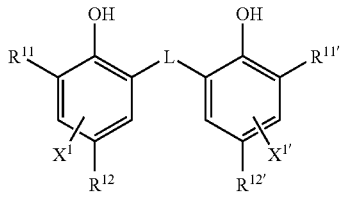

In general formula (R), $R^{11}$ and $R^{11'}$ each independently represent an alkyl group having from 1 to 20 carbon atoms; $R^{12}$ and $R^{12'}$ each independently represent a hydrogen atom, or a substituent substitutable to the benzene ring; L represents a group of —S— or —CHR$^{13}$—; $R^{13}$ represents a hydrogen atom or an alkyl group having from 1 to 20 carbon atoms; $X^1$ and $X^{1'}$ each independently represent a hydrogen atom, or a substituent substitutable to the benzene ring.

Compounds of general formula (R) are described in detail.

In general formula (R), $R^{11}$ and $R^{11'}$ each independently represent a substituted or unsubstituted alkyl group having from 1 to 20 carbon atoms. The substituent for the alkyl group is not specifically defined, but preferably includes, for example, an aryl group, a hydroxyl group, an alkoxy group, an aryloxy group, an alkylthio group, an arylthio group, an acylamino group, a sulfonamido group, a sulfonyl group, a phosphoryl group, an acyl group, a carbamoyl group, an ester group, an ureido group, an urethane group, and a halogen atom.

In general formula (R), $R^{12}$ and $R^{12'}$ each independently represent a hydrogen atom, or a substituent substitutable to the benzene ring.

In general formula (R), $X^1$ and $X^{1'}$ each independently represent a hydrogen atom, or a substituent substitutable to the benzene ring. Preferred examples of the substituent substitutable to the benzene ring are an alkyl group, an aryl group, a halogen atom, an alkoxy group, and an acylamino group.

In general formula (R), L represents a group of —S— or —$CHR^3$—.

In general formula (R), $R^{13}$ represents a hydrogen atom or an alkyl group having from 1 to 20 carbon atoms. The alkyl group may be substituted.

Examples of the unsubstituted alkyl group for $R^{13}$ are methyl, ethyl, propyl, butyl, heptyl, undecyl, isopropyl, 1-ethylpentyl and 2,4,4-trimethylpentyl groups. For the substituent for the alkyl group for $R^{13}$, referred to are the examples mentioned hereinabove for the substituent for $R^{13}$.

For $R^{11}$ and $R^{11'}$, preferred is a secondary or tertiary alkyl group having from 3 to 15 carbon atoms, including, for example, isopropyl, isobutyl, t-butyl, t-amyl, t-octyl, cyclohexyl, cyclopentyl, 1-methylcyclohexyl and 1-methylcyclopropyl groups. For $R^{11}$ and $R^{11'}$, more preferred is a tertiary alkyl group having from 4 to 12 carbon atoms; even more preferred are t-butyl, t-amyl and 1-methylcyclohexyl groups; and most preferred is a t-butyl group.

For $R^{12}$ and $R^{12'}$, preferred is an alkyl group having from 1 to 20 carbon atoms, including, for example, methyl, ethyl, propyl, butyl, isopropyl, t-butyl, t-amyl, cyclohexyl, 1-methylcyclohexyl, benzyl, methoxymethyl and methoxyethyl groups. More preferred are methyl, ethyl, propyl, isopropyl and t-butyl groups.

For $X^1$ and $X^{1'}$, preferred are a hydrogen atom, a halogen atom and an alkyl group; and more preferred is a hydrogen atom.

L is preferably —$CHR^{13}$.

$R^{13}$ is preferably a hydrogen atom or an alkyl group having from 1 to 15 carbon atoms. For the alkyl group, preferred are methyl, ethyl, propyl, isopropyl and 2,4,4-trimethylpentyl groups. More preferably, $R^{13}$ is a hydrogen atom, a methyl group, a propyl group or an isopropyl group.

In case where $R^{13}$ is a hydrogen atom, $R^{12}$ and $R^{12'}$ each are preferably an alkyl group having from 2 to 5 carbon atoms, more preferably an ethyl or propyl group, most preferably an ethyl group.

In case where $R^{13}$ is a primary or secondary alkyl group having from 1 to 8 carbon atoms, $R^{12}$ and $R^{12'}$ are preferably both methyl groups.

For the primary or secondary alkyl group having from 1 to 8 carbon atoms for $R^{13}$, preferred are methyl, ethyl, propyl and isopropyl group; and more preferred are methyl, ethyl and propyl groups.

In case where $R^{11}$, $R^{11'}$, $R^{12}$ and $R^{12'}$ are all methyl groups, $R^{13}$ is preferably a secondary alkyl group. The secondary alkyl group for $R^{13}$ is preferably any of isopropyl, isobutyl or 1-ethylpentyl group, and more preferably an isopropyl group.

Depending on the combination of the groups $R^{11}$, $R^{11'}$, $R^{12}$, $R^{12'}$ and $R^{13}$ therein, the reducing agents exhibit different heat-developability and produce different silver tone. Combining two or more different types of the reducing agents makes it possible to control the heat-developability to produce a controlled silver tone. Therefore, combining two or more different types of the reducing agents in the photothermographic material is preferred, depending on the object of the material.

Specific examples (R-1 to R-34) of the compounds of general formula (R) and other reducing agents for use in the invention are mentioned below, to which, the invention is not limited.

(R-1)

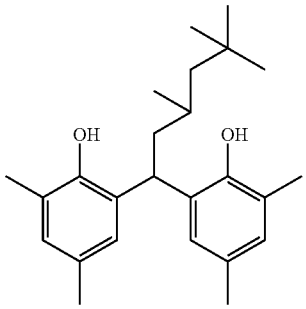

(R-2)

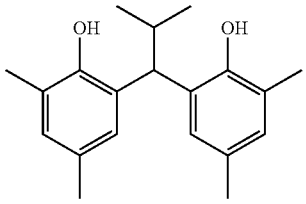

(R-3)

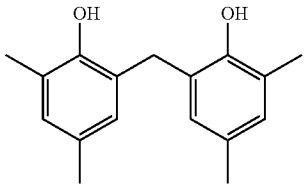

(R-4)

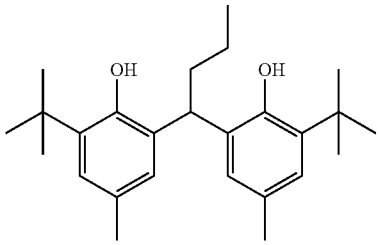

(R-5)

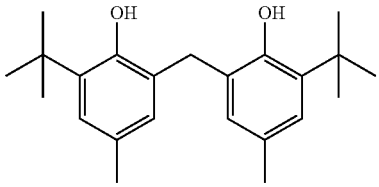

(R-6)

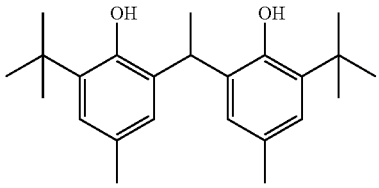

(R-7)

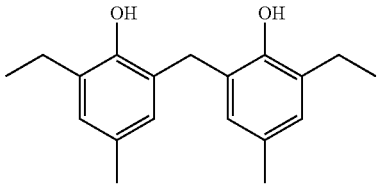

-continued
(R-8)
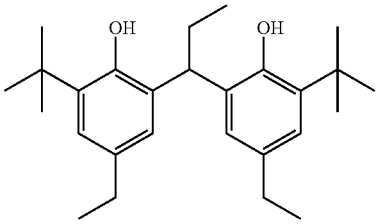
(R-9)
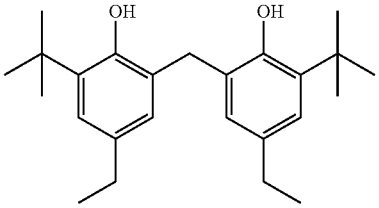
(R-10)
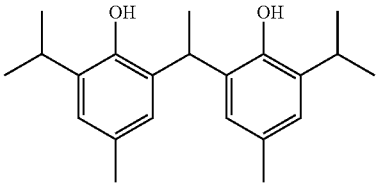
(R-11)
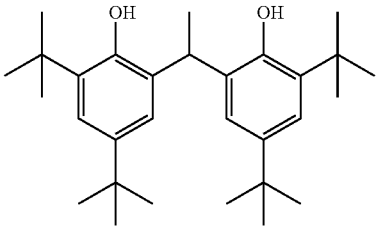
(R-12)
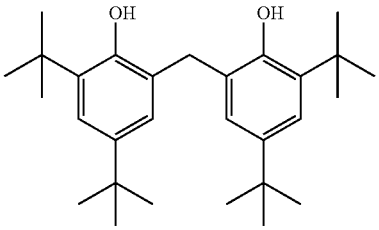
(R-13)
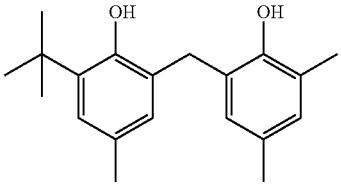
(R-14)
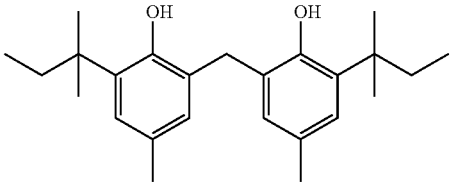
-continued
(R-15)
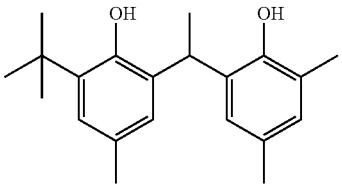
(R-16)
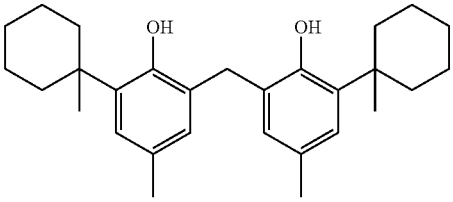
(R-17)
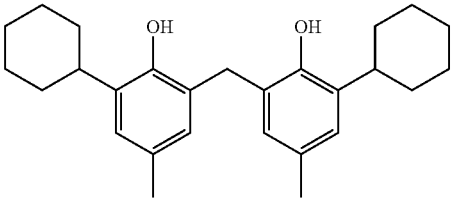
(R-18)
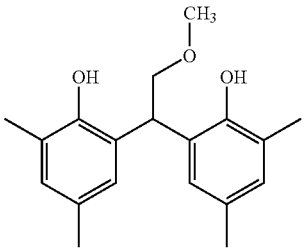
(R-19)
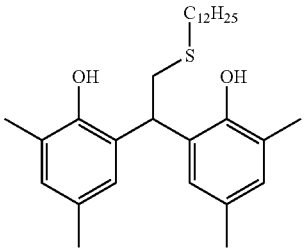
(R-20)
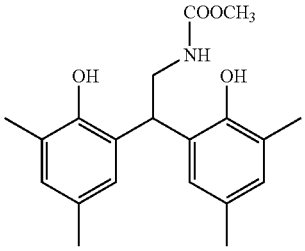

-continued
(R-21)
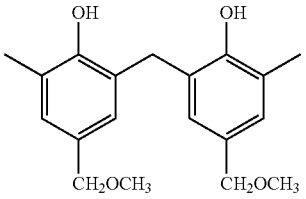
(R-22)
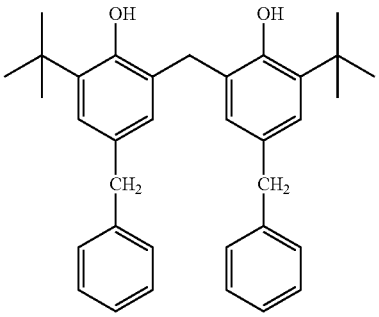
(R-23)
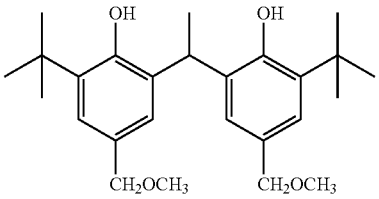
(R-24)
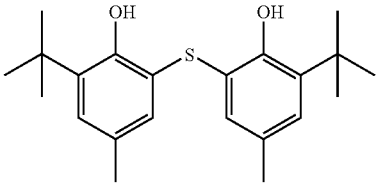
(R-25)
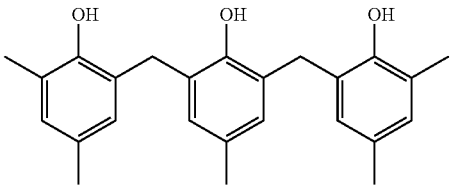
(R-26)
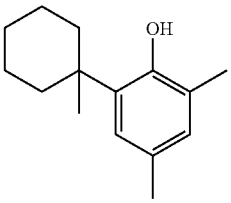
(R-27)
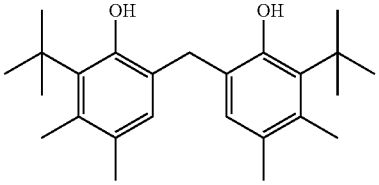
-continued
(R-28)
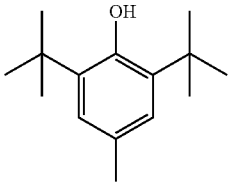
(R-29)
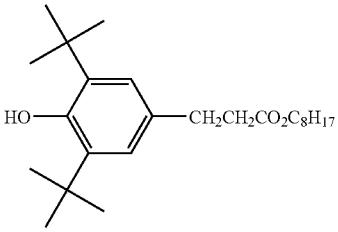
(R-30)
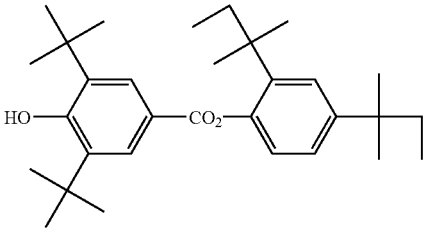
(R-31)
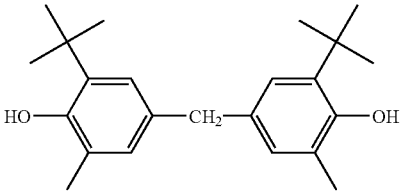
(R-32)
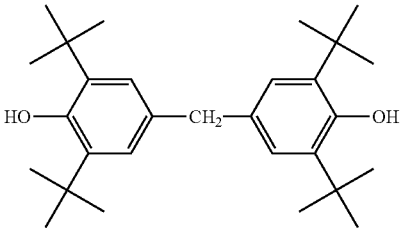
(R-33)
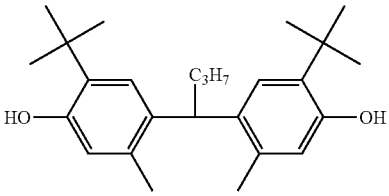
(R-34)
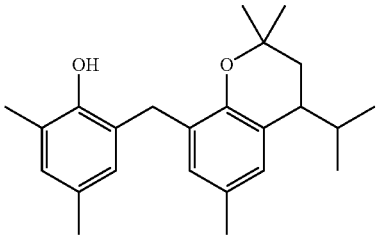

In the photothermographic material of the invention, the amount of the reducing agent is preferably from 0.1 to 3.0 g/m$^2$, more preferably from 0.2 to 1.5 g/m$^2$, even more preferably from 0.3 to 1.0 g/m$^2$. Also preferably, the amount of the reducing agent to be therein is from 5 to 50 mol %, more preferably from 8 to 30 mol %, even more preferably from 10 to 20 mol %, per mol of silver existing in the face of the image-forming layer of the material. Still preferably, the reducing agent is present in the image-forming layer of the material.

The reducing agent may be in any form of solution, emulsified dispersion or fine solid particle dispersion, and may be added to the coating liquid in any known method so as to be incorporated into the photothermographic material of the invention.

One well known method of emulsifying the reducing agent to prepare its dispersion comprises dissolving the reducing agent in an auxiliary solvent such dibutyl phthalate, tricresyl phosphate, glyceryl triacetate, diethyl phthalate or the like oily solvent, or in ethyl acetate or cyclohexanone, followed by mechanically emulsifying it into a dispersion.

For preparing a fine solid particle dispersion of the reducing agent, for example, employable is a method that comprises dispersing a powder of the reducing agent in water or in any other suitable solvent by the use of a ball mill, a colloid mill, a shaking ball mill, a sand mill, a jet mill or a roller mill, or ultrasonically dispersing it therein to thereby prepare the intended solid dispersion of the reducing agent. In this method, optionally used is a protective colloid (e.g., polyvinyl alcohol), and a surfactant (e.g., anionic surfactant such as sodium triisopropylnaphthalenesulfonate—this is a mixture of the salts in which the three isopropyl groups are all in different positions). In these mills, generally used are beads of zirconia or the like that serve as a dispersion medium. Zr or the like may dissolve out of the beads and will often contaminate the dispersion formed. Though varying depending on the dispersion condition, the contaminant content of the dispersion formed may be generally form 1 ppm to 1000 ppm. So far as the Zr content of the photothermographic material finally fabricated herein is not larger than 0.5 mg per gram of silver in the material, the contaminant will cause no practical problem.

Preferably, the aqueous dispersion contains a preservative (e.g., sodium benzoisothiazolinone).

Preferably, the reducing agent is used in the form of its solid dispersion in fabricating the photothermographic material of the invention that contains it.

(Description of Development Accelerator)

Preferably, the photothermographic material of the invention contains a development accelerator. Preferred examples of the development accelerator are sulfonamidophenol compounds of general formula (A) in JP-A Nos. 2000-267222 and 2000-330234; hindered phenol compounds of general formula (II) in JP-A No. 2001-92075; compounds of general formula (I) in JP-A Nos. 10-62895 and 11-15116; hydrazine compounds of general formula (I) in Japanese Patent Application No. 2001-074278; and phenol or naphthol compounds of general formula (2) in Japanese Patent Application No. 2000-76240.

The amount of the development accelerator to be in the material may be from 0.1 to 20 mol %, but preferably from 0.5 to 10 mol %, more preferably from 1 to 5 mol % relative to the reducing agent therein. The development accelerator may be introduced into the material like the reducing agent thereinto. Preferably, however, it is added to the material in the form of its solid dispersion or emulsified dispersion. In case where it is added to the material in the form of its emulsified dispersion, the emulsified dispersion thereof is preferably prepared by emulsifying and dispersing the development accelerator in a mixed solvent of a high-boiling point solvent that is solid at room temperature and an auxiliary solvent having a low boiling point; or the emulsified dispersion is preferably an oilless dispersion with no high-boiling-point solvent therein.

Specific examples (A-1 to A-10) of the development accelerator preferred for use in the invention are mentioned below, to which, however, the invention is not limited.

(A-1)

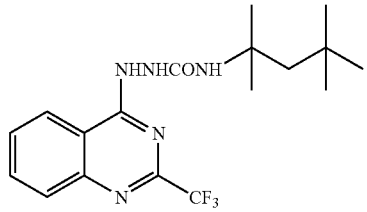

(A-2)

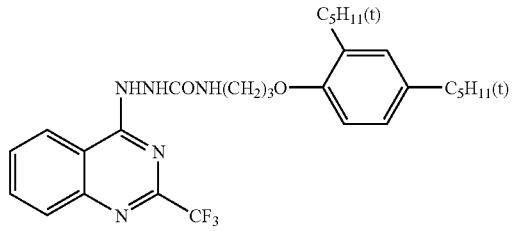

(A-3)

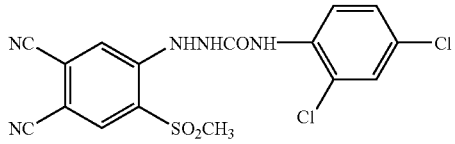

(A-4)

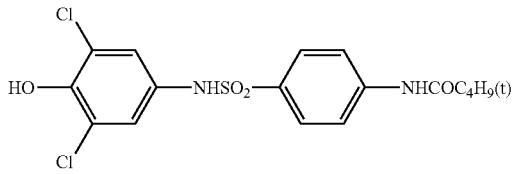

(A-5)

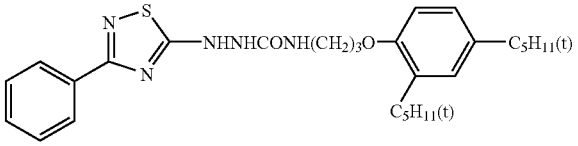

(A-6)

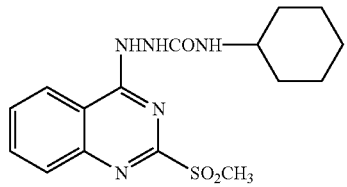

(A-7)

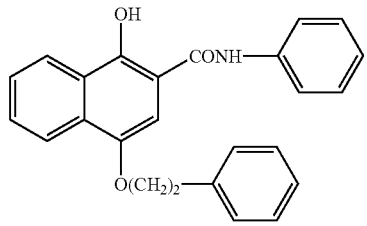

-continued (A-8)

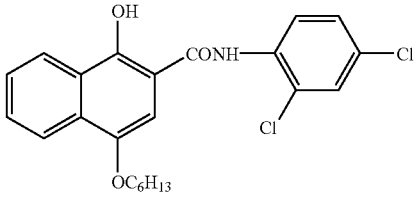

(A-9)

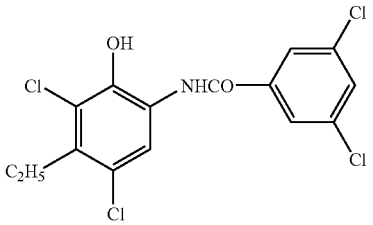

(A-10)

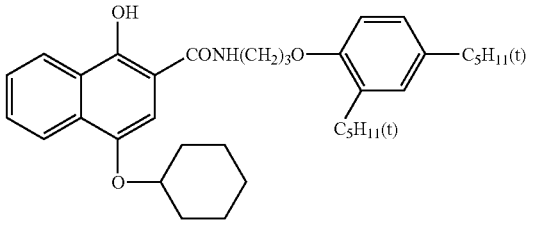

(Description of Hydrogen Bond-Forming Compound)

In case where the reducing agent to be in the photothermographic material of the invention has an aromatic hydroxyl group (—OH), especially when it is any of the above-mentioned bisphenols, the reducing agent is preferably combined with a non-reducing compound that has a group capable of forming a hydrogen bond with the group in the reducing agent. The hydrogen bond-forming compound usable in the invention is described in detail, for example, in EP 1091310.

Especially preferred examples of the hydrogen bond-forming compound for use in the invention are those represent by the following general formula (D):

General Formula (D)

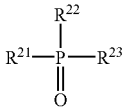

In general formula (D), $R^{21}$, $R^{22}$ and $R^{23}$ each independently represent a substituted or unsubstituted alkyl, aryl, alkoxy, aryloxy, amino or heterocyclic group.

Specific examples (D-1 to D-21) of the compounds of general formula (D) and other hydrogen bond-forming compounds usable in the invention are mentioned below, to which, however, the invention is not limited.

(D-1)

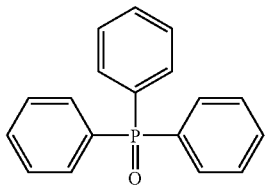

-continued (D-2)

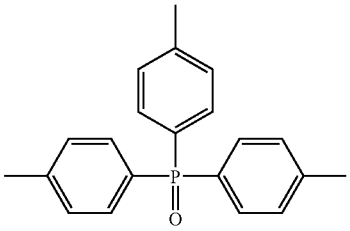

(D-3)

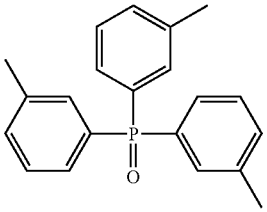

(D-4)

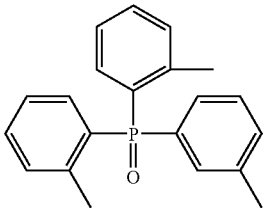

(D-5)

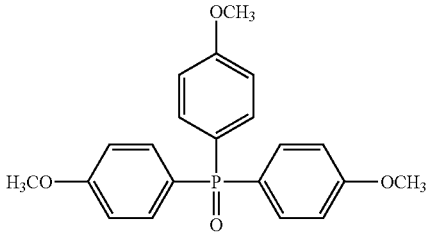

(D-6)

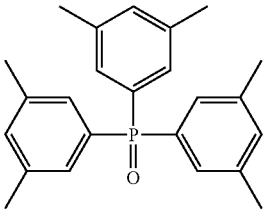

(D-7)

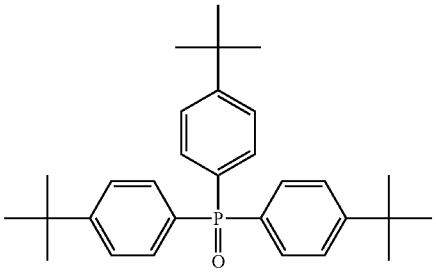

(D-8)

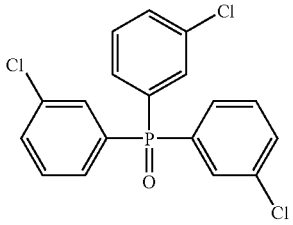

-continued (D-9)

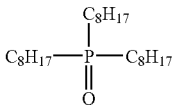

(D-10)

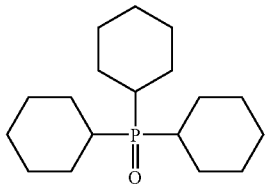

(D-11)

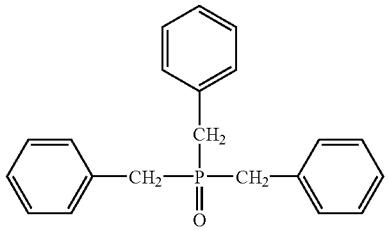

(D-12)

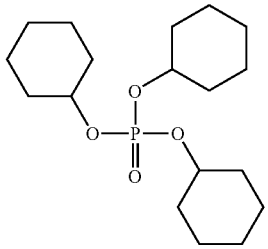

(D-13)

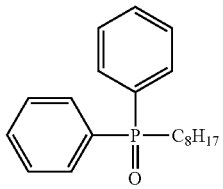

(D-14)

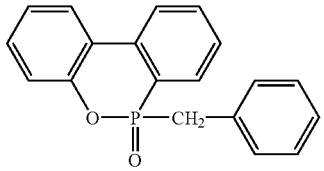

(D-15)

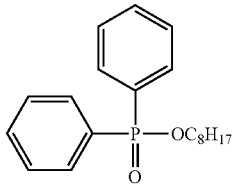

(D-16)

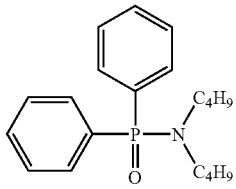

-continued (D-17)

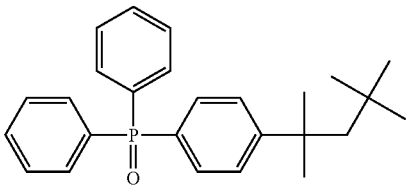

(D-18)

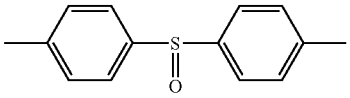

(D-19)

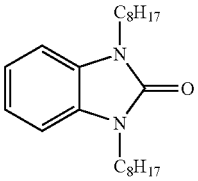

(D-20)

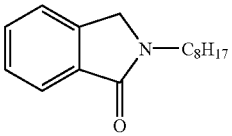

(D-21)

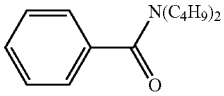

Apart from the above, other hydrogen bond-forming compounds such as those described in EP 1096310 and in Japanese Patent Application Nos. 2000-270498 and 2001-124796 are also usable herein.

Like the reducing agent mentioned above, the compound of general formula (D) may be added to the coating liquid for the photothermographic material of the invention, for example, in the form of its solution, emulsified dispersion or solid particle dispersion. Preferably, the compound of general formula (D) is used herein as its solid dispersion. Also preferably, the amount of the compound of general formula (D) to be added to the reducing agent is from 1 is 200 mol %, more preferably from 10 to 150 mol %, even more preferably from 20 to 100 mol % relative to the reducing agent.

(Description of Photosensitive Silver Halide)

The halogen composition of the photosensitive silver halide grains for use in the invention is not specifically defined, including, for example, silver chloride, silver chlorobromide, silver bromide, silver iodobromide, and silver iodochlorobromide. Of those, preferred are silver bromide and silver iodobromide. Regarding the halogen composition distribution in each grain, the composition may be uniform throughout the grain, or may stepwise vary, or may continuously vary. Core/shell structured silver halide grains are also preferred for use herein. Preferably, the core/shell structure of the grains has from 2 to 5 layers, more preferably from 2 to 4 layers. A technique of localizing silver bromide in the surface of silver chloride or silver chlorobromide grains is preferably employed herein.

Methods of forming the photosensitive silver halides are well known in the art, for example, as in *Research Disclosure* 17029 (June 1978), and U.S. Pat. No. 3,700,458, and any known method is employable in the invention. Concretely, a silver source compound and a halogen source compound are added to gelatin or any other polymer latex solution to prepare a photosensitive silver halide, and it is then mixed with an organic silver salt. This method is preferred for the invention. Also preferred are the methods described in JP-A No. 11-119374, paragraphs [0217] to [0224]; and the methods described in Japanese Patent Application Nos. 11-98708 and 2000-347335.

The grain size of the photosensitive silver halide grains is preferably smaller, for preventing the images formed from becoming cloudy. Concretely, it is preferably less than or equal to 0.20 μm, more preferably from 0.01 μm to 0.15 μm, even more preferably from 0.02 μm to 0.12 μm. The grain size referred to herein is meant to indicate the diameter of the circular image having the same area as the projected area of each silver halide grain (for tabular grains, the main face of each grain is projected to determine the projected area of the grain).

The photosensitive silver halide grains may have different types of morphology, including, for example, cubic grains, octahedral grains, tabular grains, spherical grains, rod-like grains, and potato-like grains. Cubic grains are especially preferred for use in the invention.

Silver halide grains having a hexacyano-metal complex in their outermost surfaces are preferred for use in the invention. The hexacyano-metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, $[Re(CN)_6]^{3-}$. The hexacyano-Fe complexes are preferred for the grains for use in the invention.

The amount of the hexacyano-metal complex to be added to the silver halide grains for use in the invention is preferably from $1\times10^{-5}$ mols is $1\times10^{-2}$ mols, per mol of silver, more preferably from $1\times10^{-4}$ mols to $10^{-3}$ mols.

The photosensitive silver halide grains for use in the invention may contain a metal or metal complex of Groups 8 to 10 of the Periodic Table (including Groups 1 to 18). The metal of Groups 8 to 10, or the center metal of the metal complex is preferably rhodium, ruthenium or iridium. In the invention, one metal complex may be used alone, or two or more metal complexes of one and the same type of metal or different types of metals may also be used herein as combined. The metal or metal complex content of the grains is preferably from $1\times10^{-9}$ mols is $1\times10^{-3}$ mols per mol of silver. Such heavy metals and metal complexes, and methods of adding them to silver halide grains are described in, for example, JP-A No. 7-225449; JP-A No. 11-65021, paragraphs [0018] to [0024]; and JP-A No. 11-119374, paragraphs [0227] to [0240].

The metal atoms (e.g., $[Fe(CN)_6]^{4-}$) that may be added to the photosensitive silver halide grains for use in the invention, as well as the methods of desalting or chemical sensitization of the photosensitive silver halide emulsions are described, for example, in JP-A No. 11-84574, paragraphs [0046] to [0050]; JP-A No. 11-65021, paragraphs [0025] to [0031]; and JP-A No. 11-119374, paragraphs [0242] to [0250].

Gelatin of different types may be used in preparing the photosensitive silver halide emulsions for use in the invention. For better dispersion of the photosensitive silver halide emulsion in an organic silver salt-containing coating liquid in producing the photothermographic material of the invention, preferred is low-molecular gelatin having a molecular weight of from 500 to 60,000. The low-molecular gelatin of the type may be used in forming the silver halide grains or in dispersing the grains after the grains have been desalted. Preferably, it is used in dispersing the grains after they have been desalted.

The photothermographic material of the invention may contain a sensitizing dye. Usable herein are sensitizing dyes which, after adsorbed by photosensitive silver halide grains, can spectrally sensitize the grains within a desired wavelength range. Depending on the spectral characteristics of the light source to be used for exposure, favorable sensitizing dyes having good spectral sensitivity are selected for use in the photothermographic material of the invention. For the details of the sensitizing dyes usable herein and the methods for adding them to the photothermographic material of the invention, referred to are paragraphs [0103] to [0109] in JP-A No. 11-65021; compounds of formula (II) in JP-A No. 10-186572; dyes of formula (I) and paragraph [0106] in JP-A No. 11-119374; dyes described in U.S. Pat. Nos. 5,510,236 and 3,871,887 (Example 5); dyes described in JP-A Nos. 2-96131 and 59-48753; from page 19, line 38 to page 20, line 35 in EP 0803764A1; Japanese Patent Application Nos. 2000-86865, 2000-102560 and 2000-205399. One or more such sensitizing dyes may be used herein either singly or as combined. Regarding the time at which the sensitizing dye is added to the photosensitive silver halide emulsion in the invention, it is desirable that the sensitizing dye is added thereto after the desalting step but before the coating step, more preferably after the desalting step but before the chemical ripening step.

The amount of the sensitizing dye to be in the photothermographic material of the invention varies, depending on the sensitivity and the fogging resistance of the material. In general, it is preferably from 10-6 to 1 mol, more preferably from $10^{-4}$ to $10^{-1}$ mols, per mol of the silver halide in the photosensitive layer (image-forming layer) of the material.

For its better spectral sensitization, the photothermographic material of the invention may contain a supersensitizer. For the supersensitizer, for example, usable are the compounds described in EP 587,338; U.S. Pat. Nos. 3,877,943 and 4,873,184; and JP-A Nos. 5-341432, 11-109547 and 10-111543.

Preferably, the photosensitive silver halide grains for use in the invention are chemically sensitized with, for example, sulfur, selenium or tellurium (chalcogen sensitization). For such sulfur, selenium or tellurium sensitization, any known compounds are usable. For example, preferred are the compounds described in JP-A No. 7-128768. The grains for use in the invention are especially preferably sensitized with tellurium, for which more preferred are the compounds described in the literature referred to in paragraph [0030] in JP-A No. 11-65021; and the compounds of formulae (II), (III) and (IV) given in JP-A No. 5-313284.

Preferably, the photosensitive silver halide grains for use in the invention are chemically sensitized with gold alone or with gold combined with chalcogen. Gold in the gold sensitizer for them preferably has a valence of +1 or +3. Any ordinary gold compounds for gold sensitization are usable herein. Preferred examples of the gold sensitizer for use herein are chloroauric acid, bromoauric acid, potassium chloroaurate, potassium bromoaurate, auric trichloride, potassium auric thiocyanate, potassium iodoaurate, tetracyanoauric acid, ammonium aurothiocyanate, pyridyltrichlorogold. Also preferred for use herein are the gold sensitizers described in U.S. Pat. No. 5,858,637, and Japanese Patent Application No. 2001-79450.

In the invention, the photosensitive silver halides may be chemically sensitized in any stage after their formation but before their coating. For example, they may be chemically sensitized after desalted, but (1) before spectral sensitization, or (2) along with spectral sensitization, or (3) after spectral sensitization, or (4) just before coating. Especially preferably, the grains are chemically sensitized after spectral sensitization.

The amount of the sulfur, selenium or tellurium sensitizer for such chemical sensitization in the invention varies, depending on the type of the photosensitive silver halide grains to be sensitized therewith and the condition for chemically ripening the grains, but may be generally from $10^{-8}$ to $10^{-2}$ mols, preferably from $10^{-7}$ to $10^{-3}$ mols or so, per mol of the photosensitive silver halide.

The amount of the gold sensitizer to be added to the photosensitive silver halide grains also varies depending on various conditions. In general, it may be form $10^{-7}$ to $10^{-3}$ mols, preferably from $10^{-6}$ to $5\times10^{-4}$ mols, per mol of the photosensitive silver halide.

Though not specifically defined, the condition for chemical sensitization in the invention may be such that the pH is from 5 to 8, the pAg is from 6 to 11, and the temperature is from 40 to 95° C. or so.

If desired, a thiosulfonic acid compound may be added to the photosensitive silver halide emulsions for use in the invention, according to the method described in EP Laid-Open 293,917.

Preferably, the photosensitive silver halide grains in the invention are processed with a reduction sensitizer. Preferred examples of the compounds for such reduction sensitization are ascorbic acid, thiourea dioxide, as well as stannous chloride, aminoimimomethanesulfinic acid, hydrazine derivatives, borane derivatives, silane compounds and polyamine compounds. The reduction sensitizer may be added to the grains in any stage of preparing the photosensitive emulsions including the stage of grain growth to just before coating the emulsions. Preferably, the emulsions are subjected to such reduction sensitization while they are kept ripened at a pH of 7 or more and at a pAg of 8.3 or less. Also preferably, they may be subjected to reduction sensitization while the grains are formed with a single addition part of silver ions being introduced thereinto.

Preferably, the photosensitive silver halide emulsion for use in the invention contains an FED sensitizer (fragmentable electron donating sensitizer) of a compound capable of generating two electrons from one photon. For the FED sensitizer for use herein, preferred are the compounds described in U.S. Pat. Nos. 5,747,235, 5,747,236 and 5,994,051, and Japanese Patent Application No.2001-86161. The FED sensitizer may be added to the grains in any stage of preparing the photosensitive emulsions including the stage of grain growth to just before coating the emulsions.

The amount of the FED sensitizer that may be added to the emulsion varies, depending on various condition, but may be generally from $10^{-7}$ to $10^{-1}$ mols, but preferably from $10^{-6}$ to $5\times10^{-2}$ mols per mol of the silver halide in the emulsion.

The photothermographic material of the invention may contain only one type or two or more different types of photosensitive silver halide grains (these will differ in their mean grain size, halogen composition or crystal habit, or in the condition for their chemical sensitization), either singly or as combined. Combining two or more types of photosensitive silver halide grains differing in their sensitivity will enable to control the gradation of the images to be formed in the photothermographic material. For the technique relating to it, referred to are JP-A Nos. 57-119341, 53-106125, 47-3929, 48-55730, 46-5187, 50-73627 and 57-150841. The sensitivity difference between the combined silver halide grains is preferably such that the respective emulsions differ from each other at least by 0.2 logE.

The amount of the photosensitive silver halide grains to be in the photothermographic material of the invention is, in terms of the amount of silver per $m^2$ of the material, preferably from 0.03 to 0.6 $g/m^2$, more preferably from 0.07 to 0.4 $g/m^2$, most preferably from 0.05 to 0.3 $g/m^2$. Relative to one mol of the organic silver salt therein, the amount of the photosensitive silver halide grains to be in the material is preferably from 0.01 mols to 0.5 mols, more preferably from 0.02 mols to 0.3 mols, even more preferably from 0.03 mols to 0.2 mols.

Regarding the method and the condition for mixing the photosensitive silver halide grains and an organic silver salt having been prepared separately, for example, employable is a method of mixing them in a high-performance stirrer, a ball mill, a sand mill, a colloid mill, a shaking mill, a homogenizer or the like; or a method of adding the photosensitive silver halide grains having been prepared to the organic silver salt being prepared, in any desired timing to produce the organic silver salt mixed with the silver halide grains. However, there is no specific limitation thereon, so far as the methods employed ensure the advantages of the invention. Mixing two or more different types of aqueous, organic silver salt dispersions with two or more different types of aqueous, photosensitive silver salt dispersions is preferred for suitably controlling the photographic properties of the photothermographic material of the invention.

The preferred time at which the photosensitive silver halide grains are added to the coating liquid which is to form the image-forming layer on the support of the photothermographic material of the invention may be from 180 minutes before coating the liquid to a time just before the coating, preferably from 60 minutes before the coating to 10 seconds before it. However, there is no specific limitation thereon, so far as the method and the condition employed for adding the grains to the coating liquid ensure the advantages of the invention. Concretely for mixing them, employable is a method of adding the grains to the coating liquid in a tank in such a controlled manner that the mean residence time for the grains in the tank, as calculated from the amount of the grains added and the flow rate of the coating liquid to a coater, could be a predetermined period of time; or a method of mixing them with a static mixer, for example, as in N. Harnby, M. F. Edwards & A. W. Nienow's *Liquid Mixing Technology*, Chap. 8 (translated by Koji Takahasi, published by Nikkan Kogyo Shinbun, 1989).

(Description of Binder)

The binder in the organic silver salt-containing layer in the invention may be polymer of any type, but is preferably transparent or semitransparent and is generally colorless. For it, for example, preferred are natural resins, polymers and copolymers; synthetic resins, polymers and copolymers; and other film-forming media. More concretely, they include, for example, gelatins, rubbers, poly(vinyl alcohols), hydroxyethyl celluloses, cellulose acetates, cellulose acetate butyrates, poly(vinylpyrrolidones), casein, starch, poly (acrylic acids), poly(methyl methacrylates), poly(vinyl chlorides), poly(methacrylic acids), styrene-maleic anhydride copolymers, styrene-acrylonitrile copolymers, styrene-butadiene copolymers, poly(vinylacetals) (e.g., poly(vinylformal), poly(vinylbutyral)), poly(esters), poly(urethanes), phenoxy resins, poly(vinylidene chlorides), poly(epoxides), poly (carbonates), poly(vinyl acetates), poly(olefins), cellulose esters, and poly(amides). The binder may be prepared from water or an organic solvent or an emulsion through microencapsulation.

The glass transition point of the binder to be in the organic silver salt-containing layer in the invention is preferably from 10° C. to 80° C. (the binder of the type will be hereinafter referred to as a high-Tg binder), more preferably from 15° C. to 70° C., even more preferably from 20° C. to 65° C.

Polymers that serve as the binder in the invention are preferably dispersible in aqueous solvents. Polymer dispersions include, for example, a type of hydrophobic polymer latex with water-insoluble fine polymer particles being dispersed, and a type of molecular or micellar polymer dispersion with polymer molecules or micelles being dispersed. Any of these may be used in the invention, but preferred is the type of hydrophobic polymer latex dispersion. The particles in the polymer dispersion preferably have a mean particle size falling between 1 and 50000 nm, more preferably between 5 and 1000 nm, even more preferably between 50 and 200 nm or so.

The particle size distribution of the dispersed polymer particles is not specifically defined. For example, the dispersed polymer particles may have a broad particle size distribution, or may have a narrow particle size distribution for monodispersion. Mixing two or more monodispersions having different particle size distributions is preferred in the invention for controlling the physical properties of the coating liquid that contains the mixture.

In preferred embodiments of the photothermographic material of the invention, favorably used are hydrophobic polymers that are dispersible in aqueous media. The hydrophobic polymers of the type include, for example, acrylic polymers, poly(esters), rubbers (e.g., SBR resins), poly(urethanes), poly(vinyl chlorides), poly(vinyl acetates), poly(vinylidene chlorides), and poly(olefins). These polymers may be linear, branched or crosslinked ones. They may be homopolymers from one type of monomer, or copolymers from two or more different types of monomers. The copolymers may be random copolymers or block copolymers. The polymers for use herein preferably have a number-average molecular weight falling between 5000 and 1000000, more preferably between 10000 and 200000. Polymers having a too small molecular weight are unfavorable to the invention, since the mechanical strength of the emulsion layer comprising such a polymer is low; but others having a too large molecular weight are also unfavorable since their workability into films is not good. Crosslinked polymer latex is especially preferred for use in the invention.

<Specific Examples of Polymer Latex>

Preferred examples of polymer latex for use herein are mentioned below. They are expressed by the constituent monomers, in which each numeral parenthesized indicates the proportion, in terms of % by weight, of the monomer unit, and the molecular weight of each constituent monomer is in terms of the number-average molecular weight thereof. Polyfunctional monomers form a crosslinked structure in polymer latex comprising them, to which, therefore, the concept of molecular weight does not apply. The polymer latex of the type is referred to as "crosslinked", and the molecular weight of the constituent monomers is omitted. Tg indicates the glass transition point of the polymer latex.

P-1: Latex of -MMA(70)-EA(27)-MAA(3)-(molecular weight 37000, Tg 61° C.)

P-2: Latex of -MMA(70)-2EHA(20)-St(5)-AA(5)-(molecular weight 40000, Tg 59° C.)

P-3: Latex of -St(50)-Bu(47)-MAA(3)-(crosslinked, Tg 17° C.)

P-4: Latex of -St(68)-Bu(29)-AA(3)-(crosslinked, Tg 17° C.)

P-5: Latex of -St(71)-Bu(26)-AA(3)-(crosslinked, Tg 24° C.)

P-6: Latex of -St(70)-Bu(27)—IA(3)-(crosslinked)

P-7: Latex of -St(75)-Bu(24)-AA(1)-(crosslinked, Tg 29° C.)

P-8: Latex of -St(60)-Bu(35)-DVB(3)-MAA(2)-(crosslinked)

P-9: Latex of -St(70)-Bu(25)-DVB(2)-AA(3)-(crosslinked)

P-10: Latex of -VC(50)-MMA(20)-EA(20)-AN-(5)-AA(5)-(molecular weight 80000)

P-11: Latex of -VDC(85)-MMA(5)-EA(5)-MAA(5)-(molecular weight 67000)

P-12: Latex of -Et(90)-MAA(10)-(molecular weight 12000)

P-13: Latex of -St(70)-2EHA(27)-AA(3)-(molecular weigh: 130000, Tg 43° C.)

P-14: Latex of -MMA(63)-EA(35)-AA(2)-(molecular weight 33000, Tg 47° C.)

P-15: Latex of -St(70.5)-Bu(26.5)-AA(3)-(crosslinked, Tg 23° C.)

P-16: Latex of -St(69.5)-Bu(27.5)-AA(3)-(crosslinked, Tg 20.5° C.)

Abbreviations of the constituent monomers are as follows:

MMA: methyl methacrylate
EA: ethyl acrylate
MAA: methacrylic acid
2EHA: 2-ethylhexyl acrylate
St: styrene
Bu: butadiene
AA: acrylic acid
DVB: divinylbenzene
VC: vinyl chloride
AN: acrylonitrile
VDC: vinylidene chloride
Et: ethylene
IA: itaconic acid The polymer latexes mentioned above are available on the market. Some commercial products employable herein are mentioned below. Examples of acrylic polymers are CEBIAN A-4635, 4718, 4601 (all from Daicel Chemical Industries), and Nipol Lx811, 814, 821, 820, 857 (all from Nippon Zeon);

examples of poly(esters) are FINETEX ES650, 611, 675, 850 (all from Dai-Nippon Ink & Chemicals), and WD-size, WMS (both from Eastman Chemical);

examples of poly(urethanes) are HYDRAN AP10, 20, 30, 40 (all from Dai-Nippon Ink & Chemicals);

examples of rubbers are LACSTAR 7310K, 3307B, 4700H, 7132C (all from Dai-Nippon Ink & Chemicals), and Nipol Lx416, 410, 438C, 2507 (all from Nippon Zeon);

examples of poly(vinyl chlorides) are G351, G576 (both from Nippon Zeon);

examples of poly(vinylidene chlorides) are L502, L513 (both from Asahi Kasei);

and examples of poly(olefins) are CHEMIPEARL S120, SA100 (both from Mitsui Petrochemical).

These polymer latexes may be used either singly or as combined in any desired manner.

<Preferred Examples of Polymer Latex>

For the polymer latex for use herein, especially preferred is styrene-butadiene copolymer latex. In the styrene-butadiene copolymer, the ratio of styrene monomer units to butadiene monomer units is preferably from 40/60 to 95/5 by weight. Also preferably, the styrene monomer units and the butadiene monomer units account for from 60 to 99% by weight of the copolymer. Still preferably, the polymer latex contains from 1 to 6% by weight, more preferably from 2 to 5% by weight of acrylic acid or methacrylic acid relative to the sum of styrene and butadiene. Even more preferably, the polymer latex contains acrylic acid.

Preferred examples of the styrene-butadiene copolymer latex for use in the invention are the above-mentioned P-3 to P-8 and P-15, and commercial products, LACSTAR-3307B, 7132C, and Nipol Lx416.

The organic silver salt-containing layer (that is, the image-forming layer) of the photographic material of the invention may optionally contain a hydrophilic polymer such as gelatin, polyvinyl alcohol, methyl cellulose, hydroxypropyl cellulose, and carboxymethyl cellulose. The amount of the hydrophilic polymer that may be in the layer is preferably less than or equal to 30% by weight, more preferably less than or equal to 20% by weight of all the binder in the organic silver salt-containing layer.

Preferably, the polymer latex as above is used in forming the organic silver salt-containing layer in the invention. Concretely, the amount of the binder in the organic silver salt-containing layer is such that the ratio by weight of total binder/organic silver salt is from 1/10 to 10/1, more preferably from 1/3 to 5/1, even more preferably from 1/1 to 3/1.

The organic silver salt-containing layer is a photosensitive layer (emulsion layer) generally containing a photosensitive silver salt, that is, a photosensitive silver halide. In the layer, the ratio by weight of total binder/silver halide is preferably from 400 to 5, more preferably from 200 to 10.

The overall amount of the binder in the image-forming layer of the photothermographic material of the invention is preferably from 0.2 to 30 g/m$^2$, more preferably from 1 to 15 g/m$^2$, even more preferably from 2 to 10 g/m$^2$.

The image-forming layer may optionally contain a crosslinking agent, and a surfactant which is for improving the coatability of the coating liquid for the layer.

(Preferred Examples of Solvent for Coating Liquid)

Preferably, the solvent for the coating liquid for the organic silver salt-containing layer (that is, the image-forming layer) of the photothermographic material of the invention is an aqueous solvent that contains at least 30% by weight of water. The solvent referred to herein is meant to indicate both solvent and dispersion medium for simple expression. Except water, the other components of the aqueous solvent may be any organic solvents that are miscible with water, including, for example, methyl alcohol, ethyl alcohol, isopropyl alcohol, methyl cellosolve, ethyl cellosolve, dimethylformamide, and ethyl acetate. The water content of the solvent for the coating liquid is preferably at least 50% by weight, more preferably at least 70% by weight. Preferred examples of the solvent composition are water alone, water/methyl alcohol=90/10, water/methyl alcohol=70/30, water/methyl alcohol/dimethylformamide=80/15/5, water/methyl alcohol/ethyl cellosolve=85/10/5, water/methyl alcohol/isopropyl alcohol=85/10/5. The ratio is in terms of % by weight.

(Description of Fogging Inhibitor)

Fogging inhibitors, stabilizers and stabilizer precursors usable in the invention are described, for example, in JP-A No. 10-62899, paragraph [0070]; EP 0803764A1, from page 20, line 57 to page 21, line 7; JP-A Nos. 9-281637 and 9-329864. Fogging inhibitors preferred for use in the invention are organic halides. These are described, for example, in patent publications mentioned in JP-A No. 11-65021, paragraphs [0111] to [0112]. Especially preferred are organic halides of formula (P) in Japanese Patent Application No. 11-87297; organic polyhalogen compounds of formula (II) in JP-A No. 10-339934; and organic polyhalogen compounds in Japanese Patent Application No. 11-205330.

<Description of Polyhalogen Compound>

Polyhalogen compounds for use in the invention are described concretely.

Preferably, the polyhalogen compounds for use in the invention are represented by the following general formula (H):

$$Q\text{-}(Y)n\text{-}C(Z_1)(Z_2)X \qquad (H)$$

wherein Q represents an alkyl, aryl or heterocyclic group; Y represents a divalent linking group; n indicates 0 or 1; $Z_1$ and $Z_2$ each represent a halogen atom; and X represents a hydrogen atom or an electron-attracting group.

In general formula (H), Q is preferably a phenyl group substituted with an electron-attracting group having a positive Hammett's substituent constant up. For the Hammett's substituent constant, referred to is, for example, *Journal of Medicinal Chemistry,* 1973, Vol. 16, No. 11, 1207-1216.

X is preferably an electron-attracting group. More preferably, it is a halogen atom, an aliphatic, aryl or heterocyclic sulfonyl group, an aliphatic, aryl or heterocyclic acyl group, an aliphatic, aryl or heterocyclic oxycarbonyl group, a carbamoyl group or a sulfamoyl group. Even more preferably, it is a halogen atom. For the halogen atom for X, preferred are chlorine, bromine and iodine atoms, more preferred are chlorine and bromine atoms, and even more preferred is a bromine atom.

Y is preferably —C(═O)—, —SO— or —$SO_2$—, more preferably —C(═O)— or —$SO_2$—, even more preferably —$SO_2$—. n is 0 or 1, but preferably 1.

Specific examples (H-1 to H-24) of the compounds of general formula (H) are mentioned below.

(H-1)

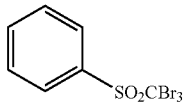

(H-2)

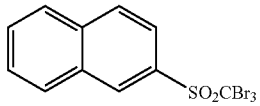

(H-3)

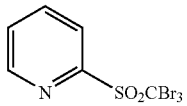

(H-4)

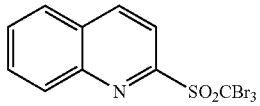

(H-5)

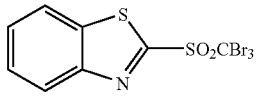

(H-6)

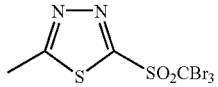

(H-7)

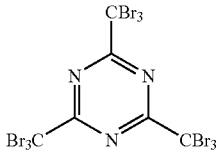

(H-8)

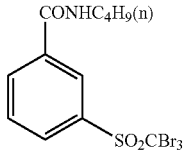

(H-9)

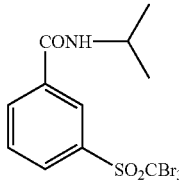

(H-10)

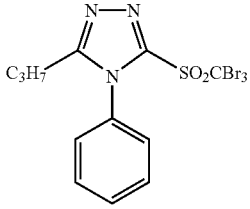

-continued (H-11)

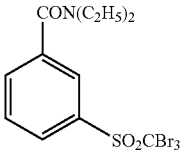

(H-12)

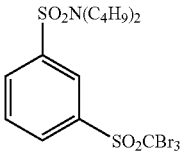

(H-13)

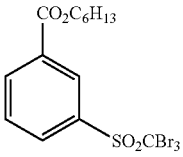

(H-14)

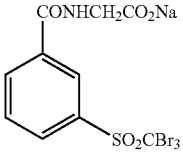

(H-15)

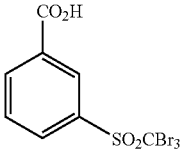

(H-16)

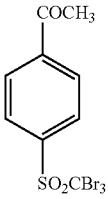

(H-17)

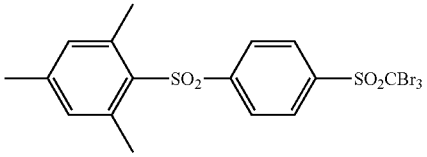

(H-18)

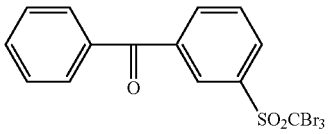

(H-19)

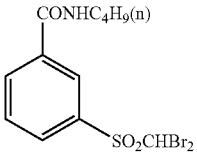

(H-20)

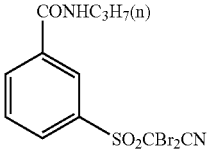

-continued (H-21)

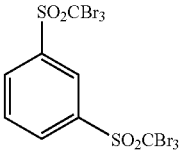

(H-22)

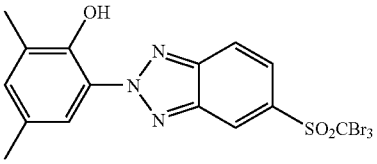

(H-23)

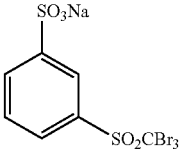

(H-24)

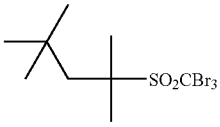

Preferably, the amount of the compound of general formula (H) to be in the photothermographic material of the invention is from $10^{-4}$ to 1 mol, more preferably from $10^{-3}$ to 0.5 mols, even more preferably from $1\times10^{-2}$ to 0.2 mols per mol of the non-photosensitive organic silver salt in the image-forming layer of the material.

The fogging inhibitor may be incorporated into the photothermographic material of the invention in the same manner as that mentioned hereinabove for incorporating the reducing agent thereinto. Preferably, the organic polyhalogen compound is in the form of a fine solid particle dispersion when it is incorporated into the material. <Other Fogging Inhibitors>

Other fogging inhibitors usable herein are mercury(II) salts as in JP-A No. 11-65021, paragraph [0113]; benzoic acids as in JP-A No. 11-65021, paragraph [0114]; salicylic acid derivatives as in JP-A No. 2000-206642; formalin scavenger compounds of formula (S) in JP-A No. 2000-221634; triazine compounds claimed in claim 9 in JP-A No. 11-352624; compounds of formula (III) in JP-A No. 6-11791; and 4-hydroxy-6-methyl-1,3,3a,7-tetrazaindene.

The photothermographic material of the invention may also contain an azolium salt serving as an fogging inhibitor. The azolium salt includes, for example, compounds of formula (XI) in JP-A No. 59-193447, compounds as in JP-B No. 55-12581, and compounds of formula (II) in JP-A No. 60-153039.

The photothermographic material of the invention may optionally contain any of mercapto compounds, disulfide compounds and thione compounds which are for retarding, promoting or controlling the developability of the material, or for enhancing the spectral sensitivity thereof, or for improving the storage stability thereof before and after development. For the additive compounds, for example, referred to are JP-A No. 10-62899, paragraphs [0067] to [0069]; compounds of formula (I) in JP-A No. 10-186572, and their examples in paragraphs [0033] to [0052]; EP 0803764A1, page 20, lines 36 to 56; JP-A Nos. 9-297367, 9-304875 and 2001-100358. Of those described in the references, especially preferred for use herein are mercapto-substituted hetero-aromatic compounds given in JP-A Nos. 9-297367, 9-304875 and 2001-100358.

(Description of Toning Agent)

Adding a toning agent to the photothermographic material of the invention is preferred. Examples of the toning agent usable herein are described in JP-A No. 10-62899, paragraphs [0054] to [0055]; EP 0803764A1, page 21, lines 23 to 48; JP-A Nos. 2000-356317; and Japanese Patent Application No. 2000-187298. Especially preferred for use herein are phthalazinones and combinations of phthalazinones and phthalic acids; and more preferred are combinations of phthalazines and phthalic acids. Above all, even more preferred is a combination of 6-isopropylphthalazine and phthalic acid or 4-methylphthalic acid.

(Other Additives)

Plasticizers and lubricants that may be in the photosensitive layer of the photothermographic material of the invention are described in, for example, JP-A No. 11-65021, paragraph [0117]. As to ultrahard gradation enhancing agent for forming ultrahard gradation images, methods of using them, and their amounts applicable to the invention, for example, referred to are JP-A No. 11-65021, paragraph [0118]; JP-A No. 11-223898, paragraphs [0136] to [0193]; compounds of general formula (H), those of formulae (1) to (3) and those of formulae (A) and (B) in Japanese Patent Application No. 11-87297; compounds of formulae (III) to (V) in Japanese Patent Application No. 11-91652, especially concrete compounds in [Formula 21] to [Formula 24] therein. As to hard gradation promoting agents also applicable to the invention, referred to are JP-A No. 11-65021, paragraph [0102]; and JP-A No. 11-223898, paragraphs [0194] to [0195].

In case where formic acid or its salt is used for a strong foggant in the invention, it may be added to the photosensitive silver halide-containing, image-forming layer of the material, and its amount is preferably less than or equal to 5 mmols, more preferably less than or equal to 1 mmol per mol of silver in the layer.

In case where a ultrahard gradation enhancing agent is used in the photothermographic material of the invention, it is preferably combined with an acid formed through hydration of diphosphorus pentoxide or its salt. The acid to be formed through hydration of diphosphorus pentoxide and its salts include, for example, metaphosphoric acid (and its salts), pyrophosphoric acid (and its salts), orthophosphoric acid (and its salts), triphosphoric acid (and its salts), tetraphosphoric acid (and its salts), and hexametaphosphoric acid (and its salts). For the acid to be formed through hydration of diphosphorus pentoxide and its salts, preferred for use herein are orthophosphoric acid (and its salts), and hexametaphosphoric acid (and its salts). More specifically, their salts are sodium orthophosphate, sodium dihydrogen-orthophosphate, sodium hexametaphosphate, and ammonium hexametaphosphate.

The amount of the acid to be formed through hydration of diphosphorus pentoxide or its salt to be used herein (that is, the amount thereof to be in the unit area, one $m^2$, of the photothermographic material) may be any desired one and may be defined in any desired manner depending on the sensitivity, the fogging resistance and other properties of the material. Preferably, however, it is from 0.1 to 500 $mg/m^2$, more preferably from 0.5 to 100 $mg/m^2$.

(Description of Layer Constitution)

The layer constitution of the photothermographic material of the invention is described below.

The photothermographic material of the invention may have a surface protective layer for preventing surface blocking of the image-forming layer thereof. The surface protective layer may have a single-layered structure or a multi-layered structure. The details of the surface protective layer are described, for example, in JP-A No. 11-65021, paragraphs [0119] to [0120], and Japanese Patent Application No. 2000-171936.

Gelatin is preferred for the binder in the surface protective layer, but polyvinyl alcohol (PVA) is also usable for it. Combining the two for the binder is also preferred in the invention. Gelatin for use herein may be inert gelatin (e.g., Nitta Gelatin 750), or gelatin phthalide (e.g., Nitta Gelatin 801). For PVA usable herein, referred to are those described in JP-A No. 2000-171936, paragraphs [0009] to [0020]. Preferred for PVA for use herein are, for example, completely saponified PVA-105; partially saponified PVA-205, PVA-335; and modified polyvinyl alcohol, MP-203 (all commercial products of Kuraray).

The polyvinyl alcohol content (per $m^2$ of the support) of one surface protective layer is preferably from 0.3 to 4.0 $g/m^2$, more preferably from 0.3 to 2.0 $g/m^2$.

In case where the photothermographic material of the invention is used in the field of printing that requires high-level dimensional stability, it is desirable to use a polymer latex in the surface protective layer or the back layer of the material.

The polymer latex for that purpose is described in, for example, *Synthetic Resin Emulsions* (by Taira Okuda & Hiroshi Inagaki, the Polymer Publishing Association of Japan, 1978); *Applications of Synthetic Latexes* (by Takaaki Sugimura, Yasuo Kataoka, Sohichi Suzuki & Keiji Kasahara, the Polymer Publishing Association of Japan, 1993); and *Chemistry of Synthetic Latexes* (by Sohichi Muroi, the Polymer Publishing Association of Japan, 1970). Concretely, it includes, for example, methyl methacrylate (33.5 wt. %)/ethyl acrylate (50 wt. %)/methacrylic acid (16.5 wt. %) copolymer latex; methyl methacrylate (47.5 wt. %)/butadiene (47.5 wt. %)/itaconic acid (5 wt. %) copolymer latex; ethyl acrylate/methacrylic acid copolymer latex; methyl methacrylate (58.9 wt. %)/2-ethylhexyl acrylate (25.4 wt. %)/styrene (8.6 wt. %)/2-hydroxyethyl methacrylate (5.1 wt. %)/acrylic acid (2.0 wt. %) copolymer latex; and methyl methacrylate (64.0 wt. %)/styrene (9.0 wt. %)/butyl acrylate (20.0 wt. %)/2-hydroxyethyl methacrylate (5.0 wt. %)/acrylic acid (2.0 wt. %) copolymer latex. For the binder for the surface protective layer in the invention, for example, referred to are the polymer latex combinations as in Japanese Patent Application No. 11-6872; the techniques as in Japanese Patent Application No. 11-143058, paragraphs [0021] to [0025]; the techniques as in Japanese Patent Application No. 11-6872, paragraphs [0027] to [0028]; and the techniques as in Japanese Patent Application No. 10-199626, paragraphs [0023] to [0041]. The ratio of the polymer latex in the surface protective layer is preferably from 10% by weight to 90% by weight, more preferably from 20% by weight to 80% by weight of all the binder in the layer.

The overall binder content (including water-soluble polymer and latex polymer, per $m^2$ of the support) of one surface protective layer is preferably from 0.3 to 5.0 $g/m^2$, more preferably from 0.3 to 2.0 $g/m^2$.

The temperature at which the coating liquid for the image-forming layer of the photothermographic material of the invention is prepared is preferably from 30° C. to 65° C., more preferably from 35° C. to lower than 60° C., even more preferably from 35° C. to 55° C. Also preferably, the temperature of the coating liquid is kept from 30° C. to 65° C. immediately after a polymer latex is added thereto.

One or more image-forming layers are formed on one support to produce the photothermographic material of the invention. In case where the material has one image-forming layer, the layer contains an organic silver salt, a photosensitive silver halide, a reducing agent and a binder, and optionally other auxiliary agents such as a toning agent and a coating aid. In case where the material has two or more image-forming layers, the first image-forming layer (in general, this is directly adjacent to the support) contains an organic silver salt and a photosensitive silver halide, and the second image-forming layer or the two layers must contain the other ingredients. The photothermographic material for multi-color expression of the invention may have combinations of these two layers for the respective colors, or may contain all the necessary ingredients in a single layer, for example, as in U.S. Pat. No. 4,708,928. For the photothermographic material of a type containing multiple dyes for multi-color expression, the individual emulsion layers are differentiated and spaced from the others via a functional or non-functional barrier layer between the adjacent emulsion layers, for example, as in U.S. Pat. No. 4,460,681.

The photosensitive layer of the photothermographic material of the invention may contain various types of dyes and pigments (e.g., C.I. Pigment Blue 60, C.I. Pigment Blue 64, C.I. Pigment Blue 15:6) for improving the image tone, for preventing interference fringes during laser exposure, and for preventing irradiation. The details of such dyes and pigments are described in, for example, WO98/36322, and JP-A Nos. 10-268465 and 11-338098.

Preferably, the surface of the photothermographic material of the invention has a pH of less than or equal to 7.0, more preferably less than or equal to 6.6, before developed under heat. The lowermost limit of the pH is not specifically defined, but may be at least 3 or so. Most preferably, the pH range is from 4 to 6.2. For controlling the surface pH of the photothermographic material, employable are nonvolatile acids, for example, organic acids such as phthalic acid derivatives, or sulfuric acid, or volatile bases such as ammonia. These are preferred as effective for reducing the surface pH of the material. Especially preferred for the surface pH-lowering agent is ammonia, as it is highly volatile, and therefore can be readily removed while the coating liquids containing it are coated and surely before heat development.

Also preferred is combining ammonia with a nonvolatile base such as sodium hydroxide, potassium hydroxide or lithium hydroxide. For measuring the surface pH of the photothermographic material, referred to is the description in Japanese Patent Application No. 11-87297, paragraph [0123].

A hardening agent may be added to the photosensitive layer, the protective layer, the back layer and other layers constituting the photothermographic material of the invention. The details of the hardening agent applicable to the invention are described in T. H. James' *The Theory of the Photographic Process,* 4th Ed. (Macmillan Publishing Co., Inc., 1977), pp. 77-87. For example, preferred for use herein are chromium alum, 2,4-dichloro-6-hydroxy-s-triazine sodium salt, N,N-ethylenebis(vinylsulfonacetamide), N,N-propylenebis(vinylsulfonacetamide); as well as polyvalent metal ions described on page 78 of that reference; polyisocyanates described in U.S. Pat. No. 4,281,060 and JP-A No. 6-208193; epoxy compounds described in U.S. Pat. No. 4,791,042; and vinylsulfone compounds described in JP-A No. 62-89048.

The hardening agent is added to the coating liquids in the form of its solution. The time at which the solution is added to the coating liquid for the protective layer may fall between 180 minutes before coating the liquid and a time just before the coating, preferably between 60 minutes before the coating and 10 seconds before it. However, there is no specific limitation on the mixing method and the mixing condition, so far as the method and the condition employed for adding the hardening agent to the coating liquid ensure the advantages of the invention. Concretely for adding it, employable is a method of mixing a hardening agent with a coating liquid in a tank in such a controlled manner that the mean residence time for the agent as calculated from the amount of the agent added and the flow rate of the coating liquid to a coater could be a predetermined period of time; or a method of mixing them with a static mixer, for example, as in N. Harnby, M. F. Edwards & A. W. Nienow's Liquid Mixing Technology, Chap. 8 (translated by Koji Takahasi, published by Nikkan Kogyo Shinbun, 1989).

Surfactants applicable to the photothermographic material of the invention are described in JP-A No. 11-65021, paragraph [0132]; solvents applicable thereto are in the same but in paragraph [0133]; supports applicable thereto are in the same but in paragraph [0134]; antistatic and electroconductive layers applicable thereto are in the same but in paragraph [0135]; methods of forming color images applicable thereto are in the same but in paragraph [0136]; lubricants applicable thereto are in JP-A No. 11-84573, paragraphs [0061] to [0064] and JP-A No. 11-106881, paragraphs [0049] to [0062].

The photothermographic material of the invention preferably has an electroconductive layer that contains a metal oxide. The electroconductive material for the electroconductive layer is preferably a metal oxide increased in the electroconductivity by introducing an oxygen defect or a different metal atom into the metal oxide. Preferred examples of the metal oxide include ZnO, $TiO_2$ and $SnO_2$. It is preferred to add Al or In to $ZnO_2$, add Sb, Nb, P or a halogen element to $SnO_2$, and add Nb or Ta to $TiO_2$. In particular, $SnO_2$ having added thereto Sb is preferred. The amount of the different metal atom added is preferably from 0.01 to 30 mol %, more preferably from 0.1 to 10 mol %. The shape of the metal oxide may be any one of spherical form, needle-like form and plate-like form but in view of its electroconductivity, a needle-like particle having a long axis/short axis ratio of 2.0 or more, preferably from 3.0 to 50 is preferred. The amount of the metal oxide used is preferably from 1 to 1,000 mg/m$^2$, more preferably from 10 to 500 mg/m$^2$, even more preferably from 20 to 200 mg/m$^2$. In the photothermographic material of the invention, the electroconductive layer may be either on the emulsion surface side or on the back surface side but is preferably between the support and the back layer. Specific examples of the electroconductive layer that may be in the photothermographic material of the invention are described in JP-A Nos. 7-295146 and 11-223901.

The photothermographic material of the invention preferably contains a fluorine-containing surfactant. Examples of fluorine-containing surfactants that are preferred for use herein are given, for example, in JP-A Nos. 10-197985, 2000-19680 and 2000-214554. Also preferred for use herein are fluorine-containing polymer surfactants such as those in JP-A No. 9-281636. In the invention, especially preferred are the fluorine-containing surfactants described in Japanese Patent Application No. 2000-206560.

(Description of Support)

The support of the photothermographic material of the invention may be or may not be transparent, but is preferably transparent.

For the transparent support, preferred are biaxially-stretched films of polyesters, especially polyethylene terephthalate heated at a temperature falling between 130 and 185° C. The heat treatment is for removing the internal strain that may remain in the biaxially-stretched films and for preventing the film supports from being heatly shrunk during heat development of the material. In case where the photothermographic material is for medical treatment, the transparent support for it may be colored with a blue dye (for example, with Dye-i used in the examples in JP-A No. 8-240877), or may not be colored. Preferably, the support of the photothermographic material of the invention is undercoated, for example, with a water-soluble polyester as in JP-A No. 11-84574; a styrene-butadiene copolymer as in JP-A No. 10-186565; or a vinylidene chloride copolymer as in JP-A No.2000-39684 or in Japanese Patent Application No. 11-106881, paragraphs [0063] to [0080].

For the antistatic layer and the undercoat layer to be formed in the photothermographic material of the invention, for example, referred to are the techniques disclosed in JP-A Nos. 56-143430, 56-143431, 58-62646, 56-120519, and 11-84573 paragraphs [0040] to [0051]; U.S. Pat. No. 5,575,957; and JP-A No. 11-223898, paragraphs [0078] to [0084 ].

(Others)

Preferably, the photothermographic material of the invention is of a monosheet type. The monosheet type does not require any additional sheet to receive images thereon such as an image-receiving material, but may directly form images on itself.

The photothermographic material of the invention may optionally contain an antioxidant, a stabilizer, a plasticizer, a UV absorbent or a coating aid. Such additives may be in any of the photosensitive layers or the non-photosensitive layers of the material. For the additives, for example, referred to are WO 98/36322, EP 803764A1, and JP-A Nos. 10-186567 and 10-18568.

(Fabrication of Photothermographic Material)

To fabricate the photothermographic material of the invention, the coating liquids may be applied onto the support in any desired manner. Concretely, various types of coating techniques are employable herein, including, for example, extrusion coating, slide coating, curtain coating, dipping, knife coating, and flow coating. Various types of hoppers for extrusion coating employable herein are described in U.S. Pat. No. 2,681,294. Preferred for the photothermographic material of the invention is extrusion coating or slide coating described in Stephen F. Kistler & Petert M. Schweizer's *Liquid Film Coating* (Chapman & Hall, 1997), pp. 399-536. More preferred is slide coating. One example of the shape of a slide coater for slide coating is in FIG. 11b-1, on page 427 of that reference. If desired, two or more layers may be formed at the same time, for example, according to the methods described from page 399 to page 536 of that reference, or to the methods described in U.S. Pat. No. 2,761,791 and BP 837,095.

Preferably, the coating liquid for the organic silver salt-containing layer of the photothermographic material of the invention is a thixotropic flow. For it, referred to is the technique described in JP-A No. 11-52509. Preferably, the coating liquid for the organic silver salt-containing layer in the invention has a viscosity from 400 mPa·s to 100,000 mPa·s, more preferably from 500 mPa·s to 20,000 mPa·s, at a shear rate of 0.1 $sec^{-}$. Also preferably, the viscosity is from 1 mPa·s to 200 mPa·s, more preferably from 5 mPa·s to 80 mPa·s, at a shear rate of 1000 $sec^{-1}$.

In fabricating the photothermographic material of the invention, it is desirable that, after the coating liquids have been applied to the support to form the layers thereon and dried, the thus-fabricated material is heated at a temperature falling between 65 and 85° C. Heating the material is preferred as it reduces color retention in the material. More preferably, the temperature at which the fabricated material is heated falls between 75 and 85° C.

Other techniques applicable to the photothermographic material of the invention are, for example, in EP 803764A1, EP 883022A1, WO98/36322; JP-A Nos. 56-62648, 58-62644, 9-43766, 9-281637, 9-297367, 9-304869, 9-311405, 9-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099 and 11-343420; and Japanese Patent Application Nos. 2000-187298, 2000-10229,2000-47345, 2000-206642, 2000-98530, 2000-98531, 2000-112059, 2000-112060, 2000-112104, 2000-112064 and 2000-171936.

(Description of Wrapping Material)

Preferably, the photographic material of the invention is wrapped with a material of low oxygen and/or moisture permeability for preventing its photographic properties from varying and for preventing it from curling or from having a curled habit while stored as raw films. Preferably, the oxygen permeability at 25° C. of the wrapping material for use herein is less than or equal to 50 ml/atm·$m^2$·day, more preferably less than or equal to 10 ml/atm·$m^2$·day, even more preferably less than or equal to 1.0 ml/atm·$m^2$·day. Also preferably, the moisture permeability thereof is less than or equal to 10 g/atm·$m^2$·day, more preferably less than or equal to 5 g/atm·$m^2$·day, even more preferably less than or equal to 1 g/atm·$m^2$·day.

Preferred examples of the wrapping material of low oxygen and/or moisture permeability for use herein are described, for example, in JP-A Nos. 8-254793 and 2000-206653.

(Description of Heat Development)

The photothermographic material of the invention may be developed in any manner. In general, after having been imagewise exposed, it is developed under heat. Preferably, the temperature for the heat development is from 80 to 250° C., more preferably from 100 to 150° C. The time for the development is preferably from 1 to 60 seconds, more preferably from 3 to 25 seconds, even more preferably from 5 to 15 seconds.

For heat development of the photothermographic material, employable is any of a drum heater system or a plate heater system, but preferred is a plate heater system. For the plate heater system for the material, preferred is the method described in JP-A No. 11-133572. The plate heater system described therein is for heat development of photothermographic materials, in which a photothermographic material having been exposed to have a latent image thereon is brought into contact with a heating unit in a zone for heat development to thereby convert the latent image into a visible image. In this, the heating unit comprises a plate heater, and multiple presser rolls are disposed in series on one surface of the plate heater. The exposed photothermographic material is passed between the multiple presser rolls and the plate heater, whereby it is developed under heat. The plate heater is sectioned into 2 to 6 stages, and it is desirable that the temperature of the top stage is kept lower by 1 to 10° C. or so than that of the others. For example, four pairs of plate heaters of which the temperature is independently controllable may be used, and they are set at 112° C., 119° C., 121° C. and 120° C. The system of the type is described in JP-A No. 54-30032. In the plate heater system, water and the organic solvent that remain in the photothermographic material being processed can be removed out of the material. In this, in addition, the support of the photothermographic material rapidly heated is prevented from being deformed.

The photographic material of the invention may be exposed in any manner. The light source for it is preferably laser. For the laser rays to which the photothermographic material of the invention is exposed, preferred are gas lasers ($Ar^{+}$, He—Ne), YAG lasers, color lasers, or semiconductor lasers. Also employable are semiconductor lasers and secondary harmonics generators. Especially preferred are gas or semiconductor lasers for red to infrared emission.

One example of laser imagers for medical treatment equipped with an exposure unit and a heat development unit that are applicable to the invention is Fuji Medical Dry Laser Imager FM-DP L. The system FM-DP L is described in Fuji Medical Review No. 8, pp. 39-55. Needless-to-say, the technique disclosed therein is applicable to laser imagers for the photothermographic material of the invention. In addition, the photothermographic material of the invention can be processed with the laser imager in the AD Network which Fuji Medical System has proposed for a network system under DICOM Standards.

The photothermographic material of the invention forms a monochromatic image based on silver, and is favorable for use in medical diagnosis, industrial photography, printing, and COM.

EXAMPLES

The present invention is described in more detail with reference to the following Examples, which, however, are not intended to restrict the scope of the invention.

Example 1

Formation of PET Support

From terephthalic acid and ethylene glycol, formed was PET in an ordinary manner. PET thus formed had an intrinsic viscosity, IV of 0.66, measured in phenol/tetrachloroethane (6/4 by weight) at 25° C. This was pelletized, then dried at 130° C. for 4 hours, and melted at 300° C. The PET melt was extruded out through a T-die, and rapidly cooled to be a non-oriented film, of which the thickness was so controlled that its thickness could be 175 μm after heat fixation.

The film was stretched 3.3 times in MD (machine direction), for which were used rolls rotating at different speeds. Next, this was stretched 4.5 times in CD (cross direction) in a tenter. The temperature for MD and CD stretching was 110° C. and 130° C., respectively. Next, this was thermally fixed at 240° C. for 20 seconds, and then relaxed by 4% in CD at the same temperature. Next, the chuck of the tenter was released, the both edges of the film was knurled, and the film was rolled up under $4\times10^4$ Pa (4 kg/cm$^2$). The rolled film had a thickness of 175 μm.

Surface Corona Treatment

Both surfaces of the support were subjected to corona treatment at room temperature at a speed of 20 m/min, for which was used a Pillar's solid-state corona processor, Model 6 KVA. From the data of the current and the voltage read on the device, it was seen that the support was processed at 0.375 kV·A·min/m$^2$. The frequency for the treatment was 9.6 kHz, and the gap clearance between the electrode and the dielectric roll was 1.6 mm.

Formation of Undercoated Support (1) Preparation of Coating Liquid for Undercoat Layer:

Formulation <1> (for undercoat layer to be below image-forming layer):

| Formulation <1> (for undercoat layer to be below image-forming layer): | |
|---|---|
| Takamatsu Yushi's Pesuresin A-515GB (30 wt. % solution) | 59 g |
| Polyethylene glycol monononylphenyl ether (mean number of ethylene oxides = 8.5, 10 wt. % solution) | 5.4 g |

-continued

| | |
|---|---|
| Soken Chemical's MP-1000 (polymer particles having a mean particle size 0.4 μm) | 0.91 g |
| Distilled water | 935 ml |
| Formulation <2> (for first back layer): | |
| Styrene-butadiene copolymer latex (solid content 40 wt. %, styrene/butadiene = 68/32 by weight) | 158 g |
| 2,4-Dichloro-6-hydroxy-S-triazine sodium salt (8 wt. % aqueous soltuion) | 20 g |
| Sodium laurylbenzenesulfonate (1 wt. % aqueous solution) | 10 ml |
| Distilled water | 854 ml |
| Formulation <3> (for second back layer): | |
| $SnO_2$/SbO (9/1 by weight, mean particle size 0.038 μm, 17 wt. % dispersion | 84 g |
| Gelatin (10% aqueous solution) | 89.2 g |
| Shin-etsu Chemical's Netolose TC-5 (2% aqueous solution) | 8.6 g |
| Soken Chemical's MP-1000 | 0.01 g |
| Sodium dodecylbenzenesulfonate (1 wt. % aqueous solution) | 10 ml |
| NaOH (1 wt. %) | 6 ml |
| Proxel (from ICI) | 1 ml |
| Distilled water | 805 ml |

(2) Formation of Undercoated Support:

Both surfaces of the bi-oriented polyethylene terephthalate support (thickness: 175 μm) were subjected to corona discharge treatment in the manner as above. One surface (to have a photosensitive layer thereon) of the support was coated with the coating liquid of undercoat layer formulation <1> by the use of a wire bar, and then dried at 180° C. for 5 minutes. The wet volume of the layer formed was 6.6 ml/m$^2$ (one surface). Next, the other surface (back surface) of the support was coated with the back layer formulation <2> by the use of a wire bar, and then dried at 180° C. for 5 minutes. The wet volume of the layer formed was 5.7 ml/m$^2$. The thus-coated back surface was further coated with the back layer formulation <3> by the use of a wire bar, and then dried at 180° C. for 6 minutes. The wet volume of the layer formed was 7.7 ml/m$^2$. In that manner, the support was undercoated.

Preparation of Coating Liquid for Back Surface (Preparation of Dispersion (A) of Solid Particles of Base Precursor)

2.0 kg of a base precursor compound 1, 300 g of a surfactant (trade name, Demole N by Kao), 625 g of diphenyl sulfone and 20 g of butyl parahydroxybenzoate (trade name, Mekkins by-Ueno Pharmaceutical) were mixed in distilled water to be 8.0 kg in total. The resulting mixture was milled in a horizontal sand mill (UVM-2, by Imex) with beads. Concretely, the mixture was fed into UVM-2 filled with 0.5-mm zirconia beads via a diaphragm pump, and milled therein under an inner pressure of at least 50 hPa into particles having a desired mean particle size.

The dispersion was measured on the spectral absorption and dispersed until the absorbance ratio (D450/D650) of the absorbance at 450 nm in the spectral absorption of the dispersion to the absorbance at 650 nm became 2.8. The obtained dispersion was diluted with distilled water to have a base precursor concentration of 20.0% by weight, diphenyl sulfone concentration of 6.25% by weight, filtered (through a polypropylene-made filter having an average pore size of 3 μm) to remove impurities, and used in practice.

(Preparation of Solid Particle Dispersion of Dye)

6.0 kg of a cyanine dye Compound 1, 3.0 kg of sodium p-dodecylbenzenesulfonate, 0.6 kg of a surfactant (trade name, Demole SNB by Kao) and 0.15 kg of a defoaming agent (trade name, Surfinol 104E by Nisshin Chemical) were mixed with distilled water to be 60 kg in total. The mixed solution was milled in a horizontal sand mill (UVM-2 by Imex) with 0.5-mm zirconia beads therein.

The dispersion was measured on the spectral absorption and dispersed until the absorbance ratio (D650/D750) of the absorbance at 650 nm in the spectral absorption of the dispersion to the absorbance at 750 nm became 4.5. The obtained dispersion was diluted with distilled water to have a cyanine dye concentration of 6% by weight.

(Preparation of Coating Liquid for Antihalation Layer)

42 g of gelatin (G1 in Table 2), 2.4 g of monodispersed polymethyl methacrylate particles (mean particle size: 8 μm, standard deviation of particle size: 0.4), 0.08 g of benzoisothiazolinone, 35.9 g of the solid particle dispersion of dye prepared above, 74.2 g of the solid fine dispersion of base precursor (a) prepared above, 0.6 g of sodium polyethylenesulfonate, 0.21 g of a blue dye Compound 1, 0.15 g of an yellow dye Compound 1 and 8.3 g of an acrylic acid/ethyl acrylate copolymer latex (copolymerization ratio: 5/95) were mixed. Thereto, water was added to make 8183 ml in total. Its pH was controlled with 1 mol/liter NaOH added thereto. This is a coating solution for antihalation layer.

(Preparation of Coating Liquid for Back Surface Protective Layer)

In a reactor kept at 40° C., 40 g of gelatin (G1 in Table 2), 1.5 g (in terms of liquid paraffin) of liquid paraffin emulsion, 35 mg of benzoisothiazolinone, 0.27 g of sodium t-octylphenoxyethoxyethanesulfonate, 0.27 g of sodium polystyrenesulfonate, 37 mg of a fluorine-containing surfactant (F-1: N-perfluorooctylsulfonyl-N-propylalanine potassium salt), 150 mg of a fluorine-containing surfactant (F-2: polyethylene glycol mono(N-perfluorooctylsulfonyl-N-propyl-2-aminoethyl)ether, having a mean degree of polymerization of ethylene oxides of 15), 64 mg of a fluorine-containing surfactant (F-3), 32 mg of a fluorine-containing surfactant (F-4), 6.0 g of acrylic acid/ethyl acrylate copolymer (copolymerization ratio, 5/95 by weight) and 2.0 g of N,N-ethylenebis(vinylsulfonacetamide) were mixed, to which was added water to make 10 liters in total. Its pH was controlled with 1 mol/liter NaOH added thereto. This is a coating liquid for back surface protective layer.

Preparation of Coating Liquid for Photosensitive Layer (Emulsion Layer)

(Preparation of Silver Halide Emulsion)

<<Preparation of Silver Halide Emulsion 1>>

To 1421 ml of distilled water, added were 3.1 ml of aqueous 1 wt. % potassium bromide solution, and then 3.5 ml of aqueous sulfuric acid solution (0.5 mol/liter) and 31.7 g of phthaloylgelatin thereto. The resulting solution was kept stirred at 30° C. in a stainless reactor, to which were added 95.4 ml of a solution A of 22.22 g of silver nitrate diluted with distilled water, and 97.4 ml of a solution B of 15.3 g of potassium bromide and 0.8 g of potassium iodide diluted with distilled water, as constant double jets within 45 seconds. Next, 10 ml of aqueous 3.5 wt. % hydrogen peroxide and then 10.8 ml of aqueous 10 wt. % solution of benzimidazole were added thereto. Next, 317.5 ml of a solution C of 51.86 g of silver nitrate diluted with distilled water, and 400 ml of a solution D of 44.2 g of potassium bromide and 2.2 g of potassium iodide diluted with distilled water were added thereto, as controlled double jets within 20 minutes of such that the flow rate of the solution C was kept constant while the flow rate of the solution D was so controlled as to make the system have a constant pAg of 8.1. 10 minutes after the start of the addition of the solutions C and D to it, $1\times10^{-4}$ mols, per mol of silver in the system, of potassium hexachloroiridate (III) was added thereto. Five seconds after the end of the addition of the solution C, $3\times10^{-4}$ mols, per mol of silver in the system, of aqueous potassium hexacyano-iron(II) solution was added to it. The pH of the system was controlled to be 3.8 with sulfuric acid (0.5 mol/liter) added thereto. Stirring this was stopped, and this was precipitated, desalted and then washed with water. Its pH was controlled to be 5.9 with sodium hydroxide (1 mol/liter) added thereto. The silver halide dispersion thus prepared had pAg of 8.0

With stirring the silver halide emulsion at 38° C., 5 ml of 0.34 wt. % 1,2-benzoisothiazolin-3-one in methanol was added thereto. After 40 minutes, a solution of color-sensitizing dye A and color-sensitizing dye B in a ratio of 1/1 by mol in methanol was added to it. The total amount of the color-sensitizing dyes A and B thus added thereto was $1.2\times10^{-3}$ mols per mol of silver in the system. After 1 minute, this was heated up to 47° C. 20 minutes after the heating, $7.6\times10^{-5}$ mols, per mol of silver in the system, of a methanolic solution of sodium benzenethiosulfonate was added to it; and after 5 minutes, $2.9\times10^{-4}$ mols, per mol of silver therein, of a methanolic solution of tellurium sensitizer C was added thereto. In that condition, this was ripened for 91 minutes. Then, 1.3 ml of a methanolic solution of 0.8 wt. % N,N'-dihydroxy-N"-diethylmelamine was added to it; and after 4 minutes, $4.8\times10^{-3}$ mols, per mol of silver in the system, of a methanolic solution of 5-methyl-2-mercaptobenzimidazole, and $5.4\times10^{-3}$ mols, per mol of silver, of a methanolic solution of 1-phenyl-2-heptyl-5-mercapto-1,3,4-triazole were added thereto. Thus prepared, this is silver halide emulsion 1.

The grains in the thus-prepared silver halide emulsion were silver iodobromide grains having a mean sphere-corresponding diameter of 0.042 μm and having a sphere-corresponding diameter fluctuation coefficient of 20%. The iodide content of the grains was 3.5 mol %, and the iodide was uniformly dispersed in the grains. To obtain the mean grain size, 1000 grains were analyzed with an electronic microscope, and their data were averaged. The {100} plane ratio of the grains was 80%, measured according to the Kubelka-Munk method.

<<Preparation of Silver Halide Emulsion 2>>

Like the silver halide emulsion 1, a silver halide emulsion 2 was prepared, for which, however, the liquid temperature in forming the grains was 47° C. and not 30° C.; the solution B was prepared by diluting 15.9 g of potassium bromide with distilled water to have a volume of 97.4 ml; the solution D was prepared by diluting 45.8 g of potassium bromide with distilled water to have a volume of 400 ml; the solution C was added to the system within 30 minutes; and potassium hexacyano-iron(II) was not added. Also like the silver halide emulsion 1, the silver halide emulsion 2 thus prepared was precipitated, desalted, washed with water and dispersed. Next, also like the silver halide emulsion 1, the silver halide emulsion 2 was spectrally sensitized and chemically sensitized, and 5-methyl-2-mercaptobenzimidazole and 1-phenyl-2-heptyl-5-mercapto-1,3,4-triazole were added thereto. Concretely, the amount of the methanolic solution of the color-sensitizing dye A and the color-sensitizing dye B (1/1 by mol) added to the emulsion 2 was $7.5\times10^{-4}$ mols per mol of silver in the system and in terms of the total of the color-sensitizing dyes A and B; the amount of the tellurium sensitizer C added thereto was $1.1\times10^{-4}$ mols per mol of silver; and the amount of 1-phenyl-2-heptyl-5-mercapto-1,3,4-triazole added thereto was $3.3\times10^{-3}$ mols per mol of silver. The emulsion grains in the thus-prepared silver halide emulsion 2 were cubic, pure silver bromide grains having a mean sphere-corresponding diameter of 0.080 μm and having a sphere-corresponding diameter fluctuation coefficient of 20%.

<<Preparation of Silver Halide Emulsion 3>>

Like the silver halide emulsion 1, a silver halide emulsion 3 was prepared, for which, however, the liquid temperature in forming the grains was 27° C. and not 30° C. Also like the silver halide emulsion 1, the silver halide emulsion 3 thus prepared was precipitated, desalted, washed with water and dispersed. Next, also like the silver halide emulsion 1, the silver halide emulsion 3 was spectrally sensitized and chemically sensitized, to which, however, a solid dispersion (in aqueous gelatin) of the color-sensitizing dye A and the color-sensitizing dye B (1/1 by mol) was added, and its amount added was $6\times10^{-3}$ mols per mol of silver in the system and in terms of the total of the color-sensitizing dyes A and B; and the amount of the tellurium sensitizer C added to the emulsion 3 was $5.2\times10^{-4}$ mols per mol of silver. The emulsion grains in the thus-prepared silver halide emulsion 3 were silver iodobromide grains having a mean sphere-corresponding diameter of 0.034 μm and having a sphere-corresponding diameter fluctuation coefficient of 20%. The iodide content of the grains was 3.5 mol %, and the iodide was uniformly dispersed in the grains.

<<Preparation of Mixed Emulsion A for Coating Liquid>>

70% by weight of the silver halide emulsion 1, 15% by weight of the silver halide emulsion 2 and 15% by weight of the silver halide emulsion 3 were mixed, to which was added $7\times10^{-3}$ mols, per mol of silver in the system, of an aqueous solution of 1 wt. % benzothiazolium iodide. Next, water was added to it to thereby make the resulting mixed emulsion have a silver halide content of 38.2 g, in terms of silver per kg of the emulsion.

(Preparation of Fatty Acid Silver Salt Dispersion A)

87.6 kg of behenic acid (Henkel's Edenor C22-85R), 423 liters of distilled water, 49.2 liters of aqueous NaOH solution (5 mol/liter), and 120 liters of t-butyl alcohol were mixed and reacted with stirring at 75° C. for 1 hour to prepare a sodium behenate solution A. Apart from this, 206.2 liters of an aqueous solution (pH 4.0) of 40.4 kg of silver nitrate was prepared, and kept at 10° C. 635 liters of distilled water and 30 liters of t-butyl alcohol were put into a reactor, and kept at 30° C. With stirring it, all the sodium behenate solution A prepared previously and all the aqueous silver nitrate solution also prepared previously were fed into the reactor as constant double jets, which took 93 minutes and 15 seconds, and 90 minutes, respectively. Feeding them into the reactor was so controlled that, for 11 minutes after the start of feeding the aqueous silver nitrate solution, only the aqueous silver nitrate solution could be fed into the reactor, then feeding the sodium behenate solution A was started, and for 14 minutes and 15 seconds after feeding the aqueous silver nitrate was finished, only the sodium behenate solution A was fed into the reactor. In this stage, the temperature inside the reactor was 30° C., and the temperature outside it was so controlled that the temperature of the reaction system in the reactor could be kept constant. The pipe line for the sodium behenate solution A was thermally insulated by circulating hot water through the interspace of the double-walled pipe, and the steam opening was so controlled that the temperature of the liquid at the outlet of the nozzle tip could be 75° C. The pipe line for the aqueous silver nitrate solution was thermally insulated by circulating cold water through the interspace of the double-walled pipe. Regarding the position at which the sodium behenate solution A is added to the reaction system and that at which the aqueous silver nitrate solution is added thereto, the two were disposed symmetrically to each other relative to the shaft of the stirrer disposed in the reactor, and the nozzle tips for the two solutions were spaced from the reaction liquid in the reactor.

After adding the sodium behenate solution A was finished, the reaction system was kept stirred for 20 minutes at the determined temperature, and then cooled to 35° C. within 30 minutes. Then, this was ripened for 210 minutes. Immediately after thus ripened, this was centrifuged to take out the solid, which was then washed with water until the conductivity of the wash waste reached 30 μS/cm. The solid thus obtained is of a silver salt of the fatty acid. Not dried, this was stored as wet cake.

The silver behenate grains obtained herein were analyzed for morphology on their images taken through electronmicroscopic photography. Their data were as follows: a=0.14 μm, b=0.4 μm and c=0.6 μm all on average (a, b and c are defined hereinabove). The mean aspect ratio was 5.2. The mean sphere-corresponding diameter was 0.52 μm. The mean sphere-corresponding fluctuation coefficient was 15%. The grains were identified as scaly crystals by these data.

To the wet cake corresponding to 260 kg of its dry weight, added was 19.3 kg of polyvinyl alcohol (trade name, PVA-217) along with water to make 1000 kg in total. The resulting mixture was formed into slurry in a blade dissolver, and then pre-dispersed in a pipe-line mixer (Model PM-10 by Mizuho Industry).

Next, the pre-dispersed stock was processed three times in a dispersion mixer (Microfluidizer M-610 by Microfluidex International Corporation, equipped with a Z-type interaction chamber) under a controlled pressure of 1260 kg/cm$^2$. Thus prepared, this is a silver behenate dispersion. To cool it, bellows-type heat exchangers were disposed before and after the interaction chamber. The temperature of the coolant in these heat exchangers was so controlled that the system could be processed at a constant temperature of 18° C.

(Preparation of Fatty Acid Silver Salt Dispersion B)

<<Preparation of Recrystallized Behenic Acid>>

Behenic acid (100 kg, Henkel's trade name, Edenor C22-85R) was mixed with 1,200 kg of isopropyl alcohol, dissolved at 50° C., filtered through a filter of 10 μm and then cooled to 30° C., thereby performing the recrystallization. At the recrystallization, the cooling speed was controlled to 3° C./hour. The crystals obtained were separated by centrifugal filtration, washed by splashing with 100 kg of isopropyl alcohol and then dried. The resulting crystals were esterified and analyzed through GC-FID. The behenic acid content of the product was 95%, and other than behenic acid, the product contained 2% of lignoceric acid and 2% of arachidinic acid.

<<Preparation of Fatty Acid Silver Salt Dispersion B>>

The recrystallized behenic acid (88 kg), 422 liters of distilled water, 49.2 liters of aqueous NaOH solution in a concentration of 5 mol/liter, and 120 liters of t-butyl alcohol were mixed. The mixture was reacted by stirring at 75° C. for one hour to obtain a sodium behenate solution B. Separately, 206.2 liters (pH 4.0) of an aqueous solution containing 40.4 kg of silver nitrate was prepared and kept at 10° C. A reactor containing 635 liters of distilled water and 30 liters of t-butyl alcohol was kept at 30° C. and while thoroughly stirring, the entire amount of the sodium behenate solution B obtained above and the entire amount of the aqueous silver nitrate solution prepared above were added as constant double jets, which took 93 minutes and 15 seconds and 90 minutes, respectively. At this time, only the aqueous silver nitrate solution was added for 11 minutes after the initiation of addition of the aqueous silver nitrate solution, then addition of the sodium behenate solution B was started, and only the sodium behenate solution B was added for 14 minutes and 15 second after the completion of addition of the aqueous silver nitrate solution. During the addition, the temperature inside the reactor was kept at 30° C. and the outer temperature was controlled to make constant the system temperature. The pipe line for the sodium behenate solution B was thermally insulated by circulating hot water through the interspace of the double-walled pipe, and the steam opening was so controlled that the temperature of the liquid at the outlet of the nozzle tip could be 75° C. The pipe line for the aqueous silver nitrate solution was thermally insulated by circulating cold water through the interspace of the double-walled pipe. Regarding the position at which the sodium behenate solution B is added to the reaction system and that at which the aqueous silver nitrate solution is added thereto, the two were disposed symmetrically to each other relative to the shaft of the stirrer disposed in the reactor, and the nozzle tips for the two solutions were spaced from the reaction liquid in the reactor.

After adding the sodium behenate solution B was finished, the reaction system was kept stirred for 20 minutes at the determined temperature, and then cooled to 35° C. within 30 minutes. Then, this was ripened for 210 minutes. Immediately after thus ripened, this was centrifuged to take out the solid, which was then washed with water until the conductivity of the wash waste reached 30 μS/cm. The solid thus obtained is of a silver salt of the fatty acid. Not dried, this was stored as wet cake.

The silver behenate grains obtained herein were analyzed for morphology on their images taken through electronmicroscopic photography. Their data were as follows: a=0.21 μm, b=0.4 μm and c=0.4 μm all on average (a, b and c are defined hereinabove). The mean aspect ratio was 2.1. The mean sphere-corresponding diameter was 0.51 μm. The mean sphere-corresponding fluctuation coefficient was 11%.

To the wet cake corresponding to 260 kg of its dry weight, added was 19.3 kg of polyvinyl alcohol (trade name, PVA-217) along with water to make 1000 kg in total. The resulting mixture was formed into slurry in a blade dissolver, and then pre-dispersed in a pipe-line mixer (Model PM-10 by Mizuho Industry).

Next, the pre-dispersed stock was processed three times in a dispersion mixer (Microfluidizer M-610 by Microfluidex International Corporation, equipped with a Z-type interaction chamber) under a controlled pressure of 1150 kg/cm$^2$. Thus prepared, this is a silver behenate dispersion. To cool it, bellows-type heat exchangers were disposed before and after the interaction chamber. The temperature of the coolant in these heat exchangers was so controlled that the system could be processed at a constant temperature of 18° C.

(Preparation of Reducing Agent Dispersion)

<<Preparation of Reducing Agent Complex 1 Dispersion>>

10 kg of water was added to 10 kg of a reducing agent complex 1 (1/1 complex of 6,6'-di-t-butyl-4,4'-dimethyl-2,2'-butylidenediphenol and triphenylphosphine oxide), 0.12 kg of triphenylphosphine oxide and 16 kg of aqueous 10 wt. % solution of modified polyvinyl alcohol (Kuraray's Poval MP203), and well mixed to give a slurry. Via a diaphragm pump, the slurry was fed into a horizontal sand mill (Imex's UVM-2) filled with zirconia beads having a mean diameter of 0.5 mm, and dispersed therein for 4 hours and 30 minutes. Then, 0.2 g of benzoisothiazolinone sodium salt was added thereto along with water to prepare a reducing agent complex dispersion having a concentration of 22% by weight. Thus prepared, this is a reducing agent complex 1 dispersion. The reducing agent complex grains in the dispersion had a median diameter of 0.45 μm, and a maximum grain size of less than or equal to 1.4 μm. The reducing agent complex dispersion was filtered through a polypropylene filter having a pore size of 3.0 μm to remove impurities from it, and then stored.

<<Preparation of Reducing Agent 2 Dispersion>>

10 kg of water was added to 10 kg of a reducing agent 2 (6,6'-di-t-butyl-4,4'-dimethyl-2,2'-butylidenediphenol) and 16 kg of aqueous 10 wt. % solution of modified polyvinyl alcohol (Kuraray's Poval MP203), and well mixed to give a slurry. Via a diaphragm pump, the slurry was fed into a horizontal sand mill (Imex's UVM-2) filled with zirconia beads having a mean diameter of 0.5 mm, and dispersed therein for 3 hours and 30 minutes. Then, 0.2 g of benzoisothiazolinone sodium salt was added thereto along with water to prepare a reducing agent dispersion having a concentration of 25% by weight. Thus prepared, this is a reducing agent 2 dispersion. The reducing agent grains in the dispersion had a median diameter of 0.40 μm, and a maximum grain size of less than or equal to 1.5 μm. The reducing agent dispersion was filtered through a polypropylene filter having a pore size of 3.0 μm to remove impurities from it, and then stored.

(Preparation of Hydrogen Bond-forming Compound 1 Dispersion)

10 kg of water was added to 10 kg of a hydrogen bond-forming compound 1 (tri(4-t-butylphenyl)phosphine oxide) and 16 kg of aqueous 10 wt. % solution of modified polyvinyl alcohol (Kuraray's Poval MP203), and well mixed to give a slurry. Via a diaphragm pump, the slurry was fed into a horizontal sand mill (Imex's UVM-2) filled with zirconia beads having a mean diameter of 0.5 mm, and dispersed therein for 3 hours and 30 minutes. Then, 0.2 g of benzoisothiazolinone sodium salt was added thereto along with water to prepare a hydrogen bond-forming compound 1 dispersion having a concentration of 25% by weight. The hydrogen bond-forming compound grains in the dispersion had a median diameter of 0.35 μm, and a maximum grain size of less than or equal to 1.5 μm. The hydrogen bond-forming compound dispersion was filtered through a polypropylene filter having a pore size of 3.0 μm to remove impurities from it, and then stored.

(Preparation of Development Accelerator Dispersion)

<<Preparation of Development Accelerator 1 Dispersion>>

10 kg of water was added to 10 kg of a development accelerator 1 and 20 kg of aqueous 10 wt. % solution of modified polyvinyl alcohol (Kuraray's Poval MP203), and well mixed to give a slurry. Via a diaphragm pump, the slurry was fed into a horizontal sand mill (Imex's UVM-2) filled with zirconia beads having a mean diameter of 0.5 mm, and dispersed therein for 3 hours and 30 minutes. Then, 0.2 g of benzoisothiazolinone sodium salt was added thereto along with water to prepare a development accelerator 1 dispersion having a concentration of 20% by weight. The development accelerator grains in the dispersion had a median diameter of 0.48 μm, and a maximum grain size of less than or equal to 1.4 μm. The development accelerator dispersion was filtered through a polypropylene filter having a pore size of 3.0 μm to remove impurities from it, and then stored.

<<Preparation of Development Accelerator 2 Dispersion and Development Accelerator 3 Dispersion>>

In the same manner as that for the development accelerator 1, solid dispersions of development accelerator 2 and development accelerator 3 were prepared, each having a concentration of 20% by weight.

(Preparation of Toning Regulator Dispersion)

In the same manner as that for the development accelerator 1, a solid dispersion of toning regulator 1 was prepared, having a concentration of 20% by weight.

(Preparation of Polyhalogen Compound Dispersion)

<<Preparation of Organic Polyhalogen Compound 1 Dispersion>>

10 kg of an Organic Polyhalogen Compound 1 (tribromomethanesulfonylbenzene), 10 kg of aqueous 20 wt. % solution of modified polyvinyl alcohol (Kuraray's Poval MP203), 0.4 kg of aqueous 20 wt. % solution of sodium triisopropylnaphthalenesulfonate, and 14 kg of water were well mixed to prepare a slurry. Via a diaphragm pump, the slurry was fed into a horizontal sand mill (Imex's UVM-2) filled with zirconia beads having a mean diameter of 0.5 mm, and dispersed therein for 5 hours. Then, 0.2 g of benzoisothiazolinone sodium salt was added thereto along with water to prepare a 26 wt. % dispersion of the organic polyhalogen compound. This is an organic polyhalogen compound 1 dispersion. The organic polyhalogen compound grains in the dispersion had a median diameter of 0.41 μm, and a maximum grain size of less than or equal to 2.0 μm. The organic polyhalogen compound dispersion was filtered through a polypropylene filter having a pore size of 10.0 μm to remove impurities from it, and then stored.

<<Preparation of Organic Polyhalogen Compound 2 Dispersion>>

10 kg of an organic polyhalogen compound 2 (N-butyl-3-tribromomethanesulfonylbenzamide), 20 kg of aqueous 10 wt. % solution of modified polyvinyl alcohol (Kuraray's Poval MP203), 0.4 kg of aqueous 20 wt. % solution of sodium triisopropylnaphthalenesulfonate, and 8 kg of water were well mixed to prepare a slurry. Via a diaphragm pump, the slurry was fed into a horizontal sand mill (Imex's UVM-2) filled with zirconia beads having a mean diameter of 0.5 mm, and dispersed therein for 5 hours. Then, 0.2 g of benzoisothiazolinone sodium salt was added thereto along with water to prepare a 25 wt. % dispersion of the organic polyhalogen compound. The dispersion was heated at 40° C. for 5 hours. This is an organic polyhalogen compound 2 dispersion. The organic polyhalogen compound grains in the dispersion had a median diameter of 0.40 μm, and a maximum grain size of less than or equal to 1.3 μm. The organic polyhalogen compound dispersion was filtered through a polypropylene filter having a pore size of 3.0 μm to remove impurities from it, and then stored.

(Preparation of Phthalazine Compound 1 Solution)

8 kg of Kuraray's modified polyvinyl alcohol MP203 was dissolved in 174.57 kg of water, to which were added 3.15 kg of aqueous 20 wt. % solution of sodium triisopropylnaphthalenesulfonate and 14.28 kg of aqueous 70 wt. % solution of a phthalazine compound 1 (6-isopropylphthalazine) to prepare aqueous 5 wt. % solution of phthalazine compound 1.

(Preparation of Mercapto Compound)

<<Preparation of Aqueous Mercapto Compound 1 Solution>>

7 g of a mercapto compound 1 (1-(3-sulfophenyl)-5-mercaptotetrazole sodium salt) was dissolved in 993 g of water to give an aqueous 0.7 wt. % solution of the mercapto compound.

<<Preparation of Aqueous Mercapto Compound 2 Solution>>

20 g of a mercapto compound 2 (1-(3-methylureido)-5-mercaptotetrazole sodium salt) was dissolved in 980 g of water to give an aqueous 2.0 wt. % solution of the mercapto compound.

(Preparation of Pigment 1 Dispersion)

250 g of water was added to 64 g of C.I. Pigment Blue 60 and 6.4 g of Kao's Demole N, and well mixed to give a slurry. 800 g of zirconia beads having a mean diameter of 0.5 mm were prepared and put into a vessel along with the slurry. The slurry thus in the vessel was milled by the use of a dispersion mill (Imex's 1/4G Sand Grinder Mill) for 25 hours to obtain a pigment 1 dispersion. The pigment grains in the dispersion had a mean grain size of 0.21 μm.

(Preparation of SBR Latex)

An SBR latex having Tg of 22° C. was prepared as follows:

Ammonium persulfate was used for a polymerization initiator, and an anionic surfactant for an emulsifier. Along with these, 70.0 parts by weight of styrene, 27.0 parts by weight of butadiene and 3.0 parts by weight of acrylic acid were polymerized in a mode of emulsion polymerization, and then aged at 80° C. for 8 hours. Then, this was cooled to 40° C., and its pH was made to be 7.0 with aqueous ammonia added thereto. To this was added Sanyo Kasei's Sandet-BL so that the concentration in the resulting latex dilution could be 0.22%. Next, aqueous 5% sodium hydroxide solution was added to it so that its pH could be 8.3, and then aqueous ammonia was added thereto so that its pH could be 8.4. The ion ratio of $Na^+/NH_4^+$ in the latex dilution was 1/2.3 by mol. To 1 kg of the resulting latex, further added was 0.15 ml of aqueous 7% benzoisothiazolinone sodium salt. Thus prepared, this is SBR latex.

The SBR latex is -St(70.0)-Bu(27.0)-AA(3.0)-latex, having Tg of 22° C.

The mean grain size of the thus-processed latex was 0.1 μm, the concentration thereof was 43% by weight, the equilibrium water content thereof at 25° C. and 60% RH was 0.6% by weight, the ion conductivity thereof was 4.2 mS/cm, and the pH thereof was 8.4. To measure the ion conductivity, used was a Toa Denpa Kogyo's conductometer CM-30S. In the device, the 43% latex was measured at 25° C.

Other SBR latexes having different Tg can be prepared in the same manner as above by suitably varying the ratio of styrene to butadiene.

(Preparation of Coating Liquid for Emulsion Layer (Photosensitive Layer))

<<Preparation of Coating Liquid 1 for Emulsion Layer (Photosensitive Layer)>>

1000 g of the fatty acid silver salt dispersion A prepared in the above, 276 ml of water, 33.2 g of the pigment 1 dispersion, 21 g of the organic polyhalogen compound 1 dispersion, 58 g of the organic polyhalogen compound 2 dispersion, 173 g of the phthalazine compound 1 solution, 1082 g of the SBR latex (Tg: 22° C.), 299 g of the reducing agent complex 1 dispersion, 6 g of the development accelerator 1 dispersion, 9 ml of the aqueous mercapto compound 1 solution, and 27 ml of the aqueous mercapto compound 2 solution were put into a reactor in that order, and mixed, to which was added 117 g of the silver halide mixed emulsion A just before applied to a support, and well mixed to prepare a coating liquid for an emulsion layer. This was directly fed into a coating die and applied onto a support.

The viscosity of the emulsion layer coating liquid was measured with a Tokyo Keiki's B-type viscometer, and was 25 [mPa·s] at 40° C. when stirred with No. 1 rotor at 60 rpm.

On the other hand, when measured with Rheometrics Far East's RFS Fluid Spectrometer at 25° C., the viscosity of the coating liquid was 230, 60,46,24 and 18 [mPa·s] at a shear rate of 0.1, 1,10, 100 and 1000 [1/sec], respectively.

The zirconium content of the coating liquid was 0.38 mg per g of silver.

<<Preparation of Coating Liquid 2 for Emulsion Layer (Photosensitive Layer)>>

1000 g of the fatty acid silver salt dispersion B prepared in the above, 276 ml of water, 32.8 g of the pigment 1 dispersion, 21 g of the organic polyhalogen compound 1 dispersion, 58 g of the organic polyhalogen compound 2 dispersion, 173 g of the phthalazine compound 1 solution, 1082 g of the SBR latex (Tg: 20° C.), 155 g of the reducing agent 2 dispersion, 55 g of the hydrogen bond-forming compound 1 dispersion, 6 g of the development accelerator 1 dispersion, 2 g of the development accelerator 2 dispersion, 3 g of the development accelerator 3 dispersion, 2 g of the toning regulator 1 dispersion, and 6 ml of the aqueous mercapto compound 2 solution were put into a reactor in that order, and mixed, to which was added 117 g of the silver halide mixed emulsion A just before applied to a support, and well mixed to prepare a coating liquid for an emulsion layer. This was directly fed into a coating die and applied onto a support.

The viscosity of the emulsion layer coating liquid was measured with a Tokyo Keiki's B-type viscometer, and was 40 [mPa·s] at 40° C. when stirred with No. 1 rotor at 60 rpm.

On the other hand, when measured with Rheometrics Far East's RFS Fluid Spectrometer at 25° C., the viscosity of the coating liquid was 530, 144, 96, 51 and 28 [mPa·s] at a shear rate of 0.1, 1, 10, 100 and 1000 [1/sec], respectively.

The zirconium content of the coating liquid was 0.25 mg per g of silver.

<<Preparation of Coating Liquid for Interlayer to be on Emulsion Layer>>

To 1000 g of a polyvinyl alcohol, Kuraray's PVA-205, 272 g of the 5 wt. % pigment dispersion, and 4200 ml of 19 wt. % latex of methyl methacrylate/styrene/butyl acrylate/hydroxyethyl methacrylate/acrylic acid copolymer (copolymerization ratio 64/9/20/5/2 by weight), added were 27 ml of aqueous 5 wt. % solution of Aerosol OT (from American Cyanamid), 135 ml of aqueous 20 wt. % solution of diammonium phthalate, and water to make 10000 gin total. This was controlled to have a pH of 7.5 with NaOH added thereto. The resulting mixture is a coating liquid for interlayer. This was fed into a coating die, with its flow rate being so controlled that its coating amount could be 9.1 ml/m$^2$.

The viscosity of the coating liquid, measured with a B-type viscometer (with No. 1 rotor at 60 rpm), was 58 [mPa·s] at 40° C.

<<Preparation of Coating Liquid for First Protective Layer to be on Emulsion Layer>>

64 g of inert gelatin was dissolved in water, to which were added 80 g of 27.5 wt. % latex of methyl methacrylate/styrene/butyl acrylate/hydroxyethyl methacrylate/acrylic acid copolymer (copolymerization ratio 64/9/20/5/2 by weight), 23 ml of 10 wt. % solution of phthalic acid in methanol, 23 ml of aqueous 10 wt. % solution of 4-methylphthalic acid, 28 ml of sulfuric acid (0.5 mol/liter), 5 ml of aqueous 5 wt. % solution of Aerosol OT (from American Cyanamid), 0.5 g of phenoxyethanol, 0.1 g of benzoisothiazolinone, and water to make 750 g in total. Just before use, 26 ml of 4 wt. % chromium alum was added to the mixture, and stirred with a static mixer. Thus prepared, the coating liquid was fed into a coating die, with its flow rate being so controlled that its coating amount could be 18.6 ml/m$^2$.

The viscosity of the coating liquid, measured with a B-type viscometer (with No. 1 rotor at 60 rpm), was 20 [mPa·s] at 40° C.

<<Preparation of Coating Liquid for Second Protective Layer to be on Emulsion Layer>>

80 g of inert gelatin was dissolved in water, to which were added 102 g of 27.5 wt. % latex of methyl methacrylate/styrene/butyl acrylate/hydroxyethyl methacrylate/acrylic acid copolymer (copolymerization ratio 64/9/20/5/2 by weight), 3.2 ml of 5 wt. % solution of a fluorine-containing surfactant (F-1: N-perfluorooctylsulfonyl-N-propylalanine potassium salt), 32 ml of aqueous 2 wt. % solution of a fluorine-containing surfactant (F-2: polyethylene glycol mono(N-perfluorooctylsulfonyl-N-propyl-2-aminoethyl) ether [mean degree of polymerization of ethylene oxides=15]), 23 ml of 5 wt. % solution of Aerosol OT (from American Cyanamid), 4 g of fine polymethyl methacrylate grains (mean grain size 0.7 μm), 21 g of fine polymethyl methacrylate grains (mean grain size 4.5 μm), 1.6 g of 4-methylphthalic acid, 4.8 g of phthalic acid, 44 ml of sulfuric acid (0.5 mol/liter), 10 mg of benzoisothiazolinone, and water to make 650 g in total. Just before use, 445 ml of aqueous solution of 4 wt. % chromium alum with 0.67 wt. % phthalic acid was added to the mixture, and stirred with a static mixer. This is a coating liquid for surface protective layer. The coating liquid was fed into a coating die, with its flow rate being so controlled that its coating amount could be 8.3 ml/m$^2$.

The viscosity of the coating liquid, measured with a B-type viscometer (with No. 1 rotor at 60 rpm), was 19 [mPa·s] at 40° C.

(Preparation of Comparative Photothermographic Material 1-1)

Onto the back surface of the undercoated support, simultaneously applied were the coating liquid for antihalation layer (its coating amount is 0.44 g/m$^2$ in terms of gelatin) and the coating liquid for back-protective layer (its coating amount is 1.7 g/m$^2$ in terms of gelatin) to form the two layers thereon, and dried. Thus, the back surface of the support was coated with the two layers.

Onto the other undercoated surface opposite to the back surface of the support, simultaneously applied were the coating liquid for photosensitive layer, that for interlayer, that for first protective layer and that for second protective layer in that order, according to a slide bead coating system. Thus fabricated, this is a comparative photothermographic material. Fabricating it, the temperature was so controlled that both the photosensitive layer and the interlayer could be at 31° C., the first protective layer could be at 36° C. and the second protective layer could be 37° C.

The coating amount (g/m$^2$) of the constitutive components of the emulsion layer is mentioned below.

| | |
|---|---|
| Silver behenate | 5.55 |
| Pigment (C.I. Pigment Blue 60) | 0.036 |
| Organic polyhalogen compound dispersion 1 | 0.12 |
| Organic polyhalogen compound dispersion 2 | 0.37 |
| Phthalazine compound 1 | 0.19 |
| SBR latex | 9.97 |
| Reducing agent complex 1 | 1.41 |
| Development accelerator 1 | 0.024 |
| Mercapto compound 1 | 0.002 |
| Mercapto compound 2 | 0.012 |
| Silver halide (as Ag) | 0.091 |

The coating and drying condition is mentioned below.

The coating speed was 160 m/min. The distance between the coating die tip and the support is from 0.10 to 0.30 mm. The pressure in the degassing chamber was kept lower by 196 to 882 Pa than the atmospheric pressure. Before coated, the support was destaticized with an ion blow being applied thereto.

In the subsequent chilling zone, the coated support was chilled with an air blow (its dry-bulb temperature is from 10 to 20° C.) being applied thereto. In the next helical lifting-up drying zone, this was dried with a dry air blow (its dry-bulb temperature is 23 to 45° C., and its wet-bulb temperature is 15 to 21° C.) being applied thereto. In this zone, the coated support to be dried was kept not in contact with the drier.

After thus dried, this was conditioned at 25° C. and 40 to 60% RH, and then heated so that its surface could have a temperature from 70 to 90° C. After thus heated, this was cooled to have a surface temperature of 25° C.

The process gave the photothermographic material 1-1.

(Fabrication of Photothermographic Materials 1-2 to 1-10 of the Invention)

Photothermographic materials 1-2 to 1-10 of the invention were fabricated in the same manner as that for the photothermographic material 1-1, for which, however, the coating liquid for antihalation layer and the coating liquid for back protective layer were changed as in Table 1 below. The details of the preparation method, the isoelectric point and the jelly strength of each gelatin used herein are given in Table 2 below.

The degree of matting, in terms of the Beck's smoothness, of the thus-fabricated photothermographic materials 1-1 to 1-10 was 550 seconds on the photosensitive layer-coated surface and 130 seconds on the back surface. The pH of the photosensitive layer-coated surface of each sample was 6.0.

Evaluation of Photographic Properties

Each sample thus fabricated was cut into pieces of a half-size, wrapped with a wrapping material mentioned below at 25° C. and 50% RH, then stored for 2 weeks at room temperature, and tested according to the test methods mentioned below.

Wrapping Material

The wrapping material used herein is a 50 μm-thick polyethylene film of 10 μm PET/12 μm PE/9 μm aluminium foil/15 μm Ny/3% carbon. Its oxygen transmittance is 0 ml/atm·m$^2$·25° C.·day; and its moisture transmittance is 0 g/atm·m$^2$·25° C.·day.

<Evaluation for Color Retention>

Using Fuji Medical Dry Laser Imager FM-DP L (equipped with a 660 nm semiconductor laser capable of producing a maximum output of 60 mW (IIIB)), the photothermographic material samples fabricated hereinabove were exposed, and heat-developed with four panel heaters set at 112° C., 119° C., 121° C. and 121° C., for 14 seconds in total. The images formed were organoleptically evaluated for color retention in the Dmin area (having a minimum density). The criteria for evaluation are mentioned below. The test results are given in Table 1.

-Criteria for Evaluation-

A: No color retention is found anywhere in the center part and the last edge of the processed film sample, and the sample is very good.

B: No color retention is found in the center part of the processed film sample, but some color retention is found in the last edge thereof. The sample is good.

C: Some color retention is found everywhere in the processed film sample, which, however, is negligible in practical use.

D: Clear color retention is found, and it is problematic in practical use.

<Evaluation for Traces of Water Drops on Heat-Developed Samples>

After heat-developed, water drops were given to the antihalation layer-coated surface of each sample, and the samples were organoleptically checked for the traces of water drops. The criteria for evaluation are mentioned below. The test results are given in Table 1.

-Criteria for Evaluation-

A: No gloss change is found anywhere in the water drops-given area and therearound, and the sample is very good.

B: Some gloss change is found somewhere in the water drops-given area and therearound, but the sample is good.

C: Some visible gloss change is found everywhere in the water drops-given area and therearound, which, however, is negligible in practical use.

D: Definite gloss change is found everywhere in the water drops-given area and therearound, and it is problematic in practical use.

TABLE 1

| Photothermographic Material | Type of Gelatin in AH Layer | pH of Coating Liquid for AH Layer | Type of Gelatin in Back Protective Layer | pH of Coating Liquid for Back Protective Layer | Color Retention | Traces of Water Drops on Heat-Developed Samples |
|---|---|---|---|---|---|---|
| 1-1 | G1 | 6.0 | G1 | 6.3 | D | D |
| 1-2 | G2 | 6.0 | G1 | 6.3 | C | B |
| 1-3 | G3 | 6.0 | G1 | 6.3 | A | B |
| 1-4 | G4 | 6.0 | G1 | 6.3 | A | B |
| 1-5 | G5 | 7.0 | G1 | 6.3 | A | B |
| 1-6 | G6 | 7.5 | G1 | 6.3 | B | C |
| 1-7 | G3 | 6.0 | G2 | 6.3 | A | A |
| 1-8 | G3 | 6.0 | G3 | 6.3 | A | A |
| 1-9 | G4 | 6.0 | G2 | 6.3 | A | A |
| 1-10 | G4 | 6.0 | G4 | 6.3 | A | A |

The coating amount of the solid dye dispersion in each sample was so controlled that the optical density at the absorption peak could be 0.3.

TABLE 2

| Gelatin Code | Production Method | Isoelectric Point | Jelly Strength |
|---|---|---|---|
| G1 | lime processing | 4.80 | 231 g |
| G2 | lime processing | 5.30 | 275 g |
| G3 | acid processing | 6.60 | 295 g |
| G4 | acid processing | 6.98 | 315 g |
| G5 | acid processing | 7.40 | 320 g |
| G6 | acid processing | 9.00 | 245 g |

From the test results in Table 1, it is understood that the photothermographic materials 1-2 to 1-10 of the invention have, after processed, little color retention and few traces of water drops, and are very good.

Example 2

Fabrication of Photothermographic Materials 2-1 to 2-10

In the same manner as that for the photothermographic materials 1-1 to 1-10 in Example 1, herein fabricated were photothermographic materials 2-1 to 2-10, for which, however, the coating liquid 2 for emulsion layer (photosensitive layer) was used in place of the coating liquid 1, the yellow dye compound 1 was not in the antihalation layer, and the fluorine-containing surfactants F-5, F-6, F-7 and F-8 but not F-1, F-2, F-3 and F-4 were used in forming the back protective layer and the emulsion protective layer.

The coating amount (g/m$^2$) of the constitutive components of the emulsion layer of the samples produced herein is mentioned below.

| | |
|---|---|
| Silver behenate | 5.55 |
| Pigment (C.I. Pigment Blue 60) | 0.036 |
| Organic polyhalogen compound dispersion 1 | 0.12 |
| Organic polyhalogen compound dispersion 2 | 0.37 |
| Phthalazine compound 1 | 0.19 |
| SBR latex | 9.97 |

-continued

| | |
|---|---|
| Reducing agent complex 1 | 1.41 |
| Development accelerator 1 | 0.024 |
| Development accelerator 2 | 0.010 |
| Development accelerator 3 | 0.015 |
| Toning regulator 1 | 0.010 |
| Mercapto compound 2 | 0.002 |
| Silver halide (as Ag) | 0.091 |

Thus fabricated, the photothermographic materials 2-1 to 2-10 were evaluated in the same manner as in Example 1. The test results confirmed that the photothermographic materials 2-2 to 2-10 of the invention are good, as having little color retention and few traces of water drops after processed.

The chemical structures of the compounds used in producing the photothermographic material samples are shown below.

Spectral Sensitizing Dye A

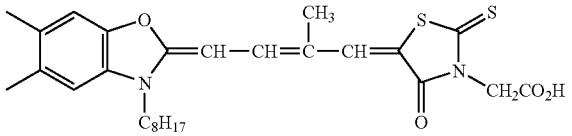

Spectral Sensitizing Dye B

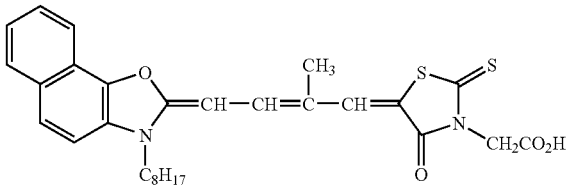

Tellurium Sensitizer C

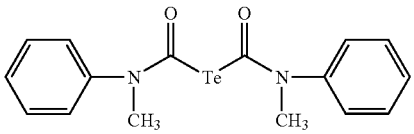

Base Precursor Compound 1

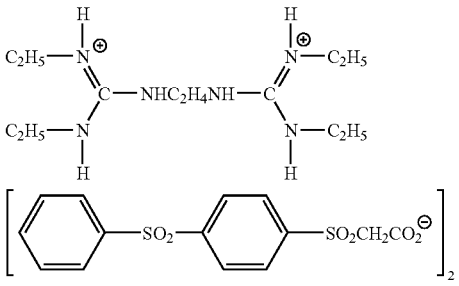

Cyanine Dye Compound 1

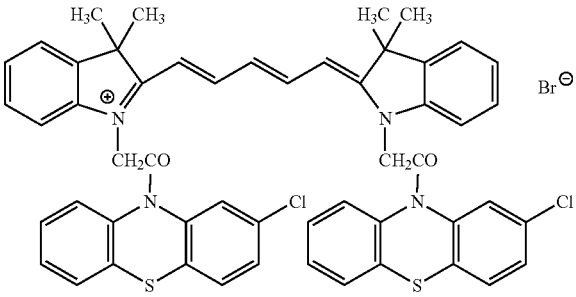

-continued

Blue Dye Compound 1

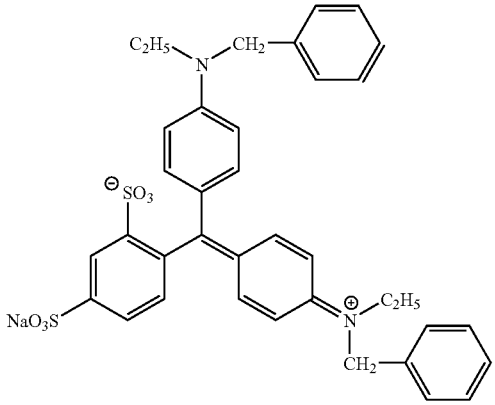

Yellow Dye Compound 1

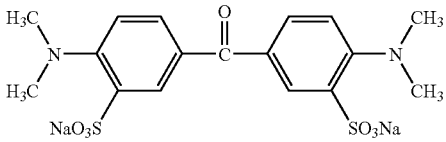

Reducing Agent Complex 1

Complex (1/1) of

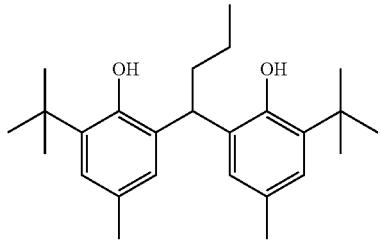

and

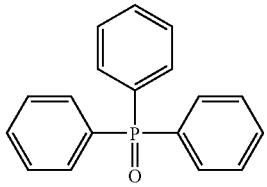

Reducing Agent 2

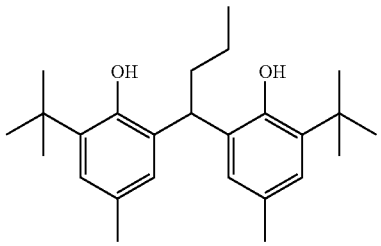

Hydrogen Bond-Forming Compound 1

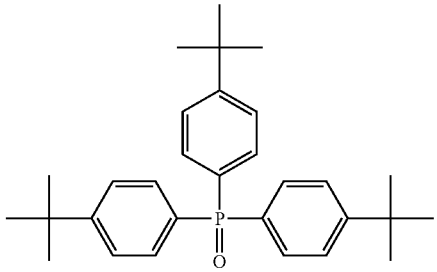

-continued

Polyhalogen Compound 1

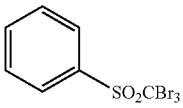

Polyhalogen Compound 2

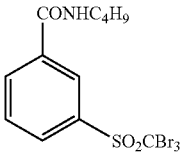

Mercapto Compound 1

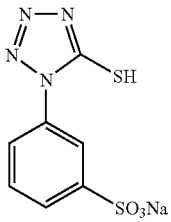

Mercapto Compound 2

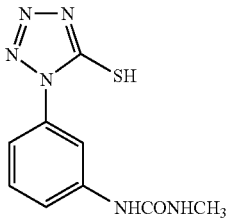

Phthalazine Compound 1

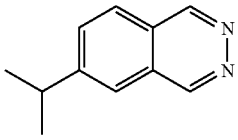

Development accelarator 1

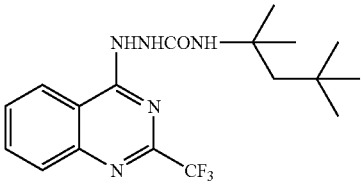

Development accelator 2

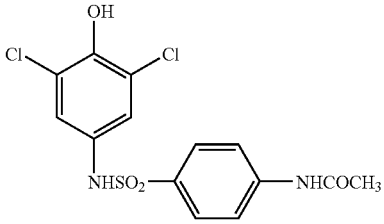

Development accelator 3

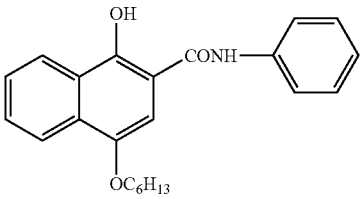

-continued

Toning Regulator 1

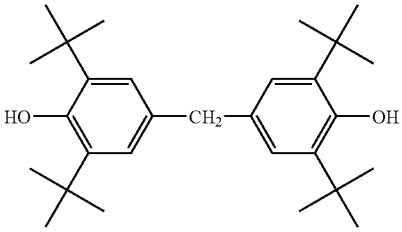

(F-1)

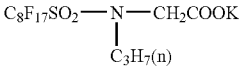

(F-2)

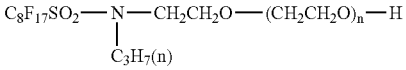

n = 15 (average)

(F-3)

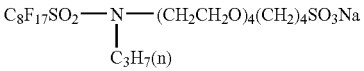

(F-4)

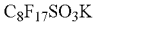

(F-5)

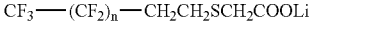

mixture of n of from 5 to 11

(F-6)

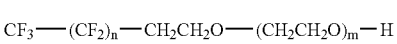

mixture of n of from 5 to 11 and m of from 5 to 15

(F-7)

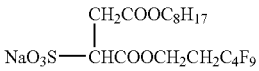

(F-8)

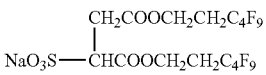

As described in detail hereinabove with reference to its preferred embodiments, the present invention provides a photothermographic material in which the dye added for improving the image sharpness of the processed material is readily decolored by heat development of the material.

In addition, the invention also provides a photothermographic material of good water resistance, which, when having received water drops on its surface that contains an image sharpness-improving dye and has an image formed after heat development, well repels the traces of such water drops.

What is claimed is:

1. A photothermographic material comprising a support having disposed on a surface thereof, a non-photosensitive silver source, a photosensitive silver halide, and a reducing agent, and having disposed on another surface thereof at least one non-photosensitive layer, wherein at least one of the non-photosensitive layers contains at least one acid processed gelatin having an isoelectric point of from 5.5 to 8.0, a polymer latex, at least one dye that is decolored by heat development, and a base precursor.

2. The photothermographic material according to claim 1, wherein the jelly strength of the gelatin is from 200 g to 350 g.

3. The photothermographic material according to claim 1, wherein the viscosity of the gelatin is from 20 mP to 120 mP.

4. The photothermographic material according to claim 1, wherein the transmittance of the gelatin is at least 50%.

5. The photothermographic material according to claim 1, wherein the electroconductivity of the gelatin is less than or equal to 800 μs/cm.

6. The photothermographic material according to claim 1, wherein a pH of the gelatin is from 4.0 to 7.0.

7. The photothermographic material according to claim 1, wherein the amount of gelatin is from 0.1 g/m$^2$ to 2.0 g/m$^2$, and wherein at least one of the non-photosensitive layers contains at least one of a dye that is decolored by heat development and a base precursor.

8. The photothermographic material according to claim 1, wherein the dye is a cyanine dye represented by the following formula (1) or a salt thereof:

Formula (1)

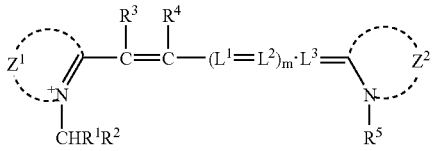

wherein $R^1$ represents an electron-attracting group; $R^2$ represents a hydrogen atom, an aliphatic group or an aromatic group; $R^3$ and $R^4$ each independently represent a hydrogen atom, a halogen atom, an aliphatic group, an aromatic group, —$NR^6R^7$, —$OR^6$ or —$SR^7$; $R^6$ and $R^7$ each independently represent a hydrogen atom, an aliphatic group or an aromatic group; $R^5$ represents an aliphatic group; $L^1$, $L^2$ and $L^3$ each independently represent an optionally-substituted methine group, and the substituents, if any, of the methine group may bond to each other to form an unsaturated aliphatic ring or an unsaturated heterocycle; $Z^1$ and $Z^2$ each independently represent an atomic group to form a 5-membered or 6-membered, nitrogen-containing heterocycle, the nitrogen-containing heterocycle may be condensed with an aromatic ring, and the nitrogen-containing heterocycle and its condensed ring may be substituted; m indicates 0, 1, 2 or 3.

9. The photothermographic material according to claim 8, wherein the cyanine dye of formula (1) is represented by the following formula (1a):

Formula (1a)

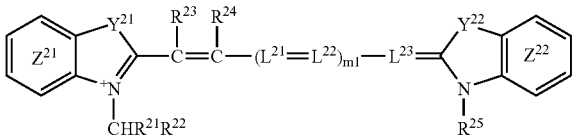

wherein $R^{21}$, $R^{22}$, $R^{23}$, $R^{24}$, $R^{25}$, $L^{21}$, $L^{22}$, $L^{23}$ and $m_1$ have the same meanings as those of $R^1$, $R^2$, $R^3$, $R^4$, $R^5$, $L^1$, $L^2$, $L^3$ and m in formula (1); $Y^{21}$ and $Y^{22}$ each independently represent —$CR^{26}R^{27}$—, —$NR^{26}$—, —O—, —S— or —Se—; $R^{26}$ and $R^{27}$ each independently represent a hydrogen atom or an aliphatic group, and they may bond to each other to form a ring; the benzene rings $Z^{21}$ and $Z^{22}$ may be condensed with any other benzene ring.

10. The photothermographic material according to claim 1, wherein the amount of the dye is from 0.001 to 1 g/m$^2$.

11. The photothermographic material according to claim 1, wherein the base precursor is a decarboxylating base precursor.

12. The photothermographic material according to claim 1, wherein the base precursor is a diacidic base precursor of an amidine derivative or a guanidine derivative.

13. The photothermographic material according to claim 1, wherein the amount of the base precursor is from 1 to 100 times by mol of the dye.

14. The photothermographic material according to claim 1, further comprising on the another surface of the support, a substance that decreases the melting point of the base precursor by 3 to 30° C. when mixed with the base precursor.

15. The photothermographic material according to claim 14, wherein the substance that decreases the melting point of the base precursor is at least one selected from those represented by the following formulae (M1) to (M3):

Formula (M1)

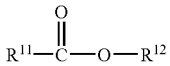

wherein $R^{11}$ and $R^{12}$ each independently represent an aliphatic group, an aromatic group or a heterocyclic group; but when $R^{12}$ is an aliphatic group, $R^{11}$ is an aromatic group or a heterocyclic group;

$R^{21}$—X—$R^{22}$ Formula (M2)

wherein $R^{21}$ and $R^{22}$ each independently represent an aromatic group or a heterocyclic group; and X represents a linking group except a sulfonyl group and a carboxyl group;

Formula (M3)

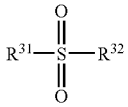

wherein $R^{31}$ and $R^{32}$ each independently represent an aromatic group or a heterocyclic group; but the compound of formula (M3) does not have a substituent of a carboxyl group or a salt of a carboxyl group.

16. A photothermographic material according to claim 1, wherein one of the non-photosensitive layers is a back surface protective layer comprising a acid processed gelatin having an isoelectric point of from 5.5 to 8.0.

17. A photothermographic material according to claim 16, wherein the back surface protective layer further comprising a polymer latex.

18. A photothermographic material according to claim 1, wherein the non-photosensitive layer containing the gelatin is formed by a coating liquid whose pH is lower than the isoelectric point of the gelatin.

19. A method for processing a photothermographic material comprising the steps of:

(a) providing a photothermographic material comprising a support having disposed on a surface thereof, a non-photosensitive silver source, a photosensitive silver halide, and a reducing agent, and having disposed another surface thereof at least one non-photosensitive layer, wherein at least one of the non-photosensitive layers contains at least one acid processed gelatin having an isoelectric point of from 5.5 to 8.0, a polymer latex, at least one dye that is decolored by heat development, and a base precursor; and (b) imagewise exposing and then heat-developing the photothermographic material at a temperature of from 80° C. to 250° C. for a period of time of from 1 second to 60 seconds.

* * * * *